US006609936B2

(12) United States Patent
Bricaud et al.

(10) Patent No.: US 6,609,936 B2
(45) Date of Patent: Aug. 26, 2003

(54) SMART CARD CONNECTOR

(75) Inventors: Herve' Guy Bricaud, Dole (FR); Yves Pizard, Dole (FR); Fabrice Valcher, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 9 days.

(21) Appl. No.: 09/883,041

(22) Filed: Jun. 15, 2001

(65) Prior Publication Data

US 2002/0006751 A1 Jan. 17, 2002

Related U.S. Application Data

(63) Continuation-in-part of application No. PCT/EP00/10261, filed on Oct. 18, 2000.

(30) Foreign Application Priority Data

Oct. 20, 1999 (FR) ..... 99 13066

(51) Int. Cl.[7] ..... H01R 4/00

(52) U.S. Cl. ..... 439/630; 439/159; 439/608; 439/108; 439/541.1

(58) Field of Search ..... 439/630, 159, 439/607, 608, 609, 610, 108, 160, 541.1

(56) References Cited

U.S. PATENT DOCUMENTS 5,139,435 A 8/1992 Komatsu et al.
5,503,564 A 4/1996 Futatsugi et al.
5,577,922 A 11/1996 Enomoto et al.
5,655,918 A 8/1997 Soh
5,823,828 A 10/1998 Bricaud et al.
6,095,868 A * 8/2000 Hyland et al. ..... 439/630
6,290,136 B1 * 9/2001 Koseki et al. ..... 235/475

FOREIGN PATENT DOCUMENTS

EP 0580983 A1 2/1994

* cited by examiner

*Primary Examiner*—P. Austin Bradley
*Assistant Examiner*—Truc Nguyen
(74) *Attorney, Agent, or Firm*—Roger C. Turner

(57) ABSTRACT

A smart card connector includes an insulative support (52) with contacts thereon and a sheet metal cover (54) with an upper portion (60) that lies over a support face (62) to form a front portion of a card-receiving cavity (58) between them, and with the cover having a lower portion (191) lying under opposite sides of the cavity. The opposite sides of the cavity extend rearward of the support. A card ejecting mechanism (141) includes a pusher (144) that can be manually pushed forward to pivot a lever (146) that pushes the card rearwardly so the card can be grasped and manually pulled out. The pusher is formed of sheet metal with lower and upper flanges (190, 188) that lie against upper and lower portions of the cover, the pusher being confined to solely slideable movement and the lever being pivoting mounted about a pivot axis (A1) on the support. The pivot axis of the lever lies forward of a front edge (78) that limits full insertion of a card, and preferably lies in the area where a polarizing front corner of the card is cut at a 45° angle.

11 Claims, 54 Drawing Sheets

110
C
54
188
144
52
57
190
182

146
174
132
170
176
188
144
190
136
182

66
98
146
14
16
122
204
61
196
194
202
176
170
90
61'
144
206
196
194
60
54
188
182
110
C
F12
F13

230B
52B
275B
274B
104B
57B
256B
260B
244B
52B
274B
230B
D44
104B
228B
254B
258B
84B
272B
269B
264B
236B
237B
268B
140B

236B
D42
264B
104B
54B
142B
144B
D43
262B 267B
262B
142B
144B
266B
270B

SMART CARD CONNECTOR

CROSS-REFERENCE TO RELATED APPLICATION

This is a continuation-in-part of PCT application PCT/EP 00/10261 filed Oct. 18, 2000, which claims priority from French application FR 9913066 filed Oct. 20, 1999.

BACKGROUND OF THE INVENTION

Smart cards are thin, with a thickness no more than about 1 mm, and have generally rectangular upper and lower faces. One corner generally has a cut-away at a 45° angle to polarize the card so it cannot be fully inserted in an upside-down orientation. One of the card faces is an active face that has contact pads that connect to an integrated circuit embedded in the card. Information is read into and out of the card by a card connector that includes an insulative support with contacts mounted on the support that engage the contact pads of a fully inserted card. As shown in our earlier U.S. Pat. No. 5,823,828, a sheet metal cover can have an upper portion that lies over the support upper face to form a card-receiving cavity between them. The sheet metal cover can have opposite sides that are bent around and under sides of the support to form a lower cover portion that holds the cover in place.

It is desirable to provide a mechanism that can be operated from the rear end of the connector, to partially eject a card that has been fully forwardly inserted. The mechanism can move the card rearwardly by a plurality of millimeters so a person can grasp the rear end of the card and pull it out. It is desirable to make the smart card connector so it is of minimum size and can be manufactured at minimum cost. A particular connector can be constructed to connect to a smart card of a particular size, it being noted that there are smart cards of different sizes in wide use. It is desirable to enable connection to smart cards of different types which have different dimensions and contact pad arrangements, or to connect to two or more smart cards simultaneously.

SUMMARY OF THE INVENTION

In accordance with one embodiment of the present invention, a connector is provided for use with a smart card, where the connector is of small size and low cost. The connector includes an insulative support with an upper face that lies adjacent to an active face of a smart card, with contacts mounted on the support to engage the contact pads on the active face. A sheet metal cover includes an upper portion that lies over the support upper face to form a cavity front portion between them, into which a smart card can be forwardly inserted to a fully inserted position. The sheet metal cover also includes sides that extend down along opposite sides of the support and a lower portion that form flanges lying under the support. The upper and lower sheet metal portions extend rearward of the support to form a rear cavity portion that is at least about as long as the front cavity portion.

An ejecting mechanism includes a lever pivotally mounted on the support and a sheet metal pusher that has upper and lower portions that straddle a side of the cover and that can be pushed forwardly to pivot the lever and eject the card a plurality of millimeters so the card can be pulled out.

The card has a polarizing cutout at one of its forward corners, which assures that the card will not be inserted upside-down. The vertical pivot axis of the ejection lever lies forward of the front edge of the fully inserted card, and lies in the polarizing corner cutout region. This reduces the length and width of the connector.

The upper and lower cover portions have rear ends that form card leadins that guide the card into a cavity. The cover upper portion has a rear end with an upper leadin part extending at a rearward-upper incline, while the cover lower portion has a rear end with lower leadin parts extending at rearward-downward inclines.

Two or more connectors can be stacked one on another to form a stack of connectors that each can receive a smart card. The contacts of each connector have tails that extend to traces on a circuit board to which they are soldered. In one type of stack, the tails of a lower connector extend from the rear edge of the support down to the circuit board, while the tails of an upper connector extend from the front edge of its support down to the circuit board. Slots in the sheet metal upper portions of each connector enable direct observance of solder connections. The rear portions of the covers are deformed to form loops at sides of one connector that receive prongs extending from the other connector.

In a stack where corresponding tails of each contact are connected to the same traces on the circuit board, the tails of the lower contacts forms loops that extend at least partially around the tails of the upper contacts to connect to them.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
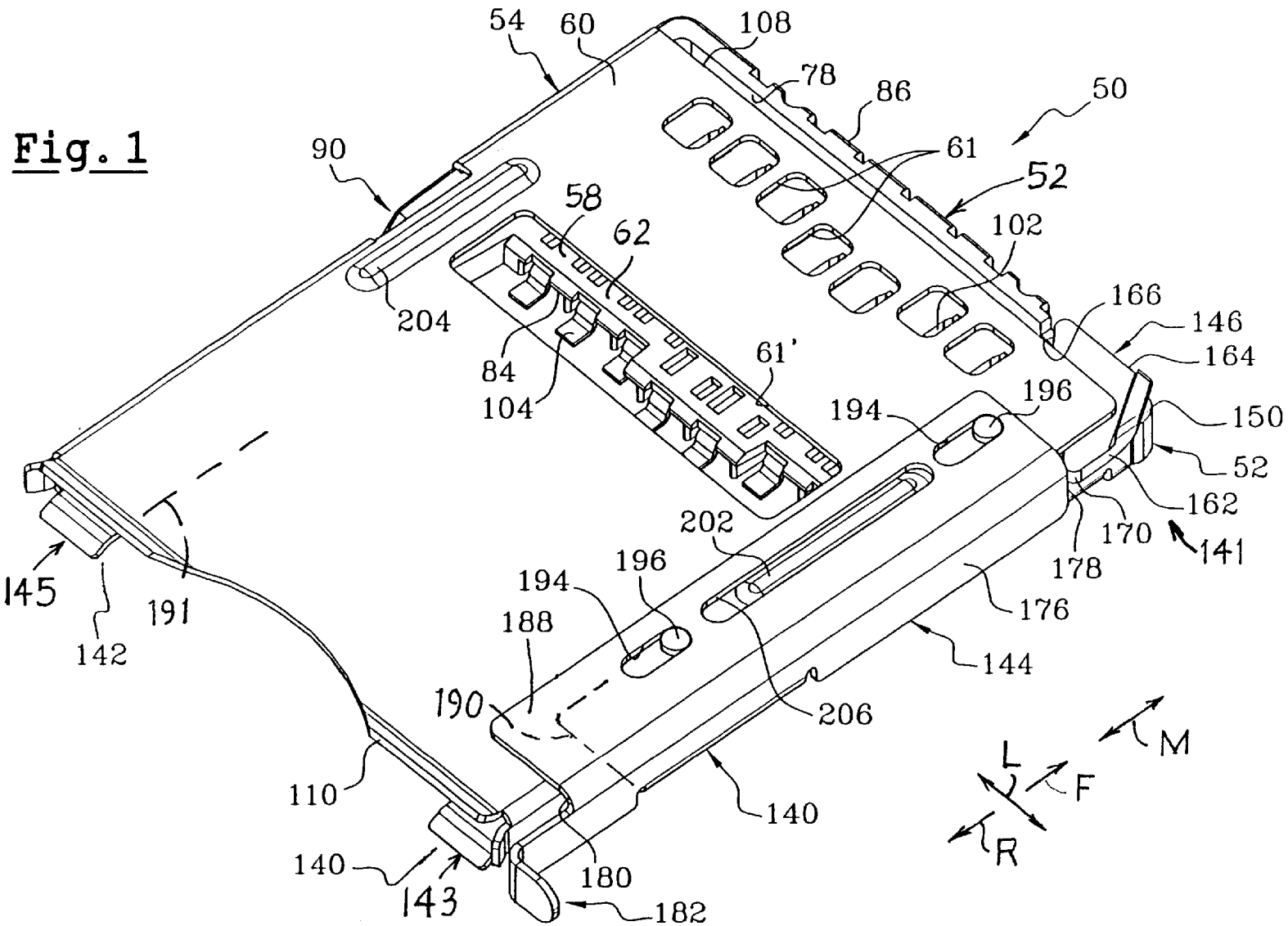
FIG. 1 is a top and rear isometric view of a connector of one embodiment of the invention, with the ejection pusher in its rearward position.

FIG. 1 shows an electrical connector 50 of a first embodiment of the invention, which includes a largely plate-shaped molded plastic insulative support 52 and a cover 54 of thin metal which is preferably of bent sheet metal but which can be formed of metalized plastic. The cover includes an upper portion 60 with a front section that lies over an upperwardly-facing cavity wall 62 on the support, to form a cavity 58 with a front portion of the cavity lying between the cover and support. The cover upper portion has a rear section that extends rearward of the support. The cavity is designed to receive a smart card, which is a card of largely rectangular shape, with one face being an active face that has contact pads thereon that are connected to an integrated circuit embedded in the card.

Figure 2:
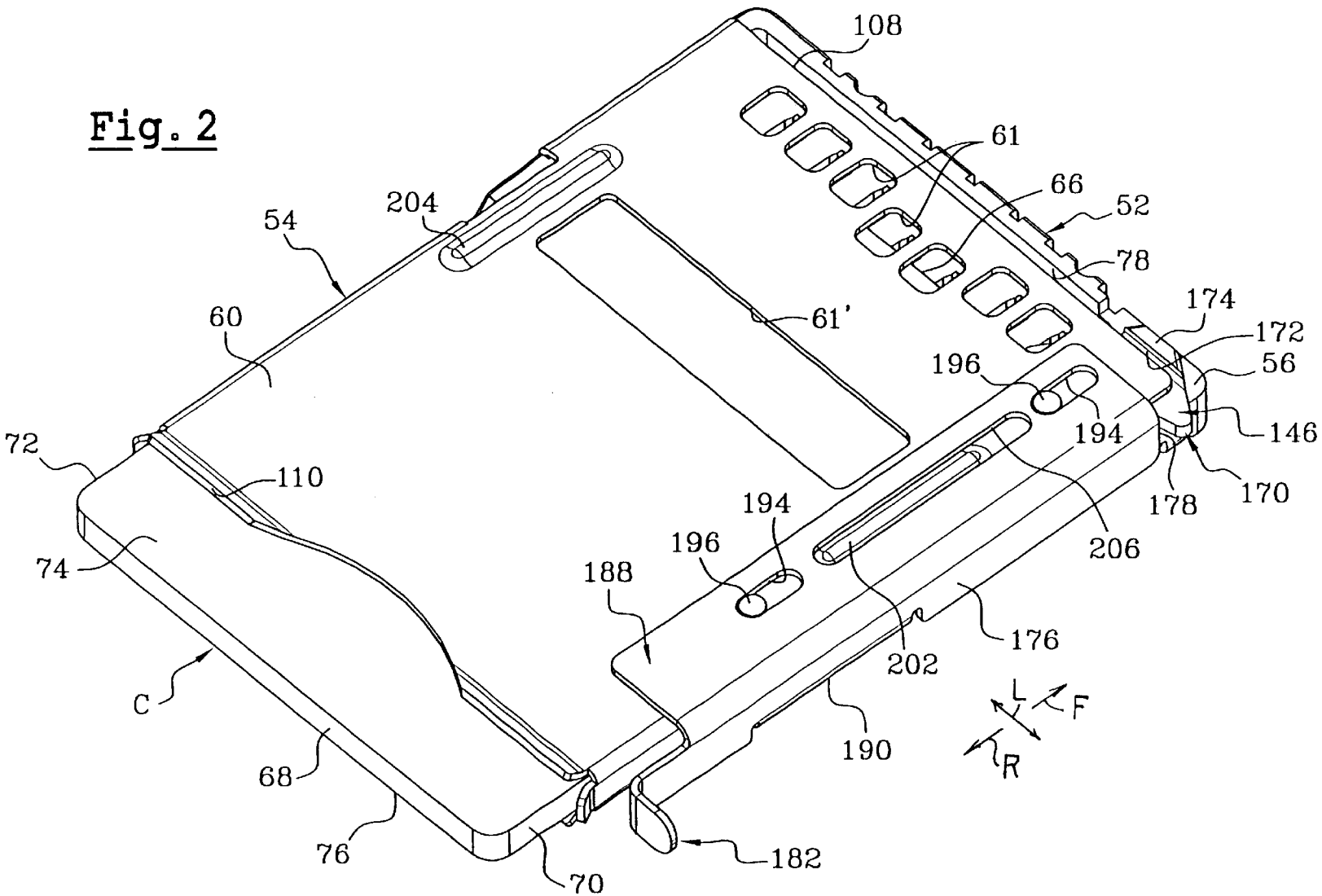
FIG. 2 is a view similar to that of FIG. 1, in which the connector is shown together with an MMC-type card that is partially inserted, and with the ejection pusher in its forward position to eject the card.
Figure 8:
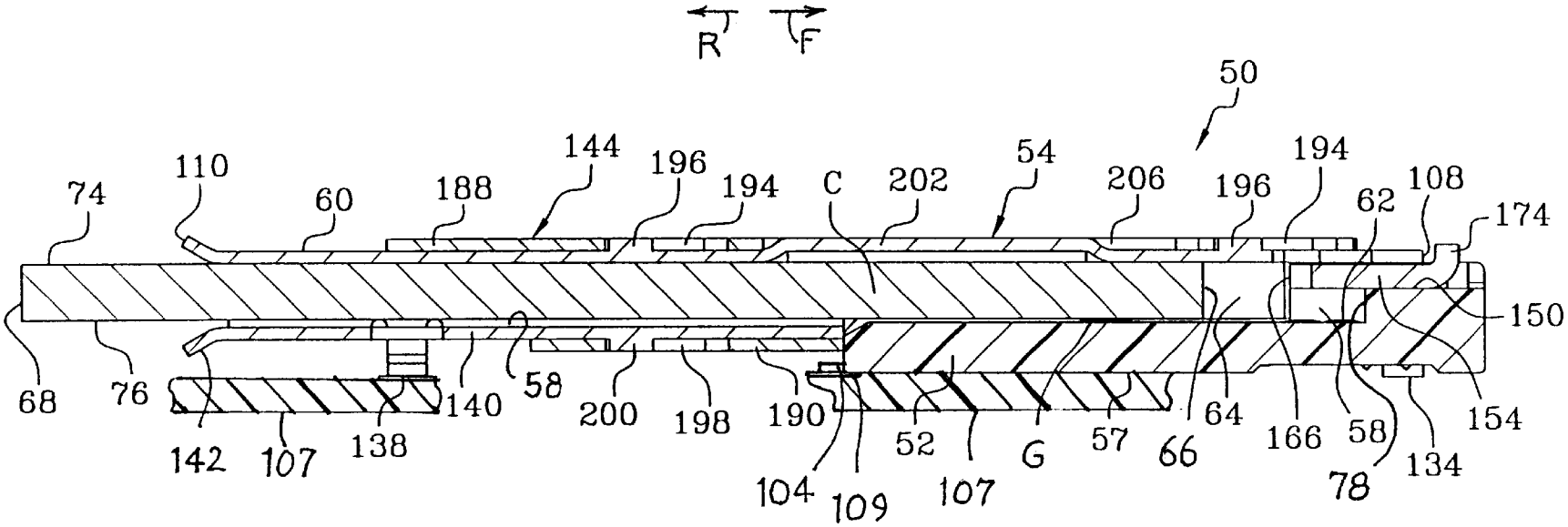
FIG. 8 is a sectional view taken on line 8—8 of FIG. 5, and showing the connector mounted on a circuit board.
Figure 9:
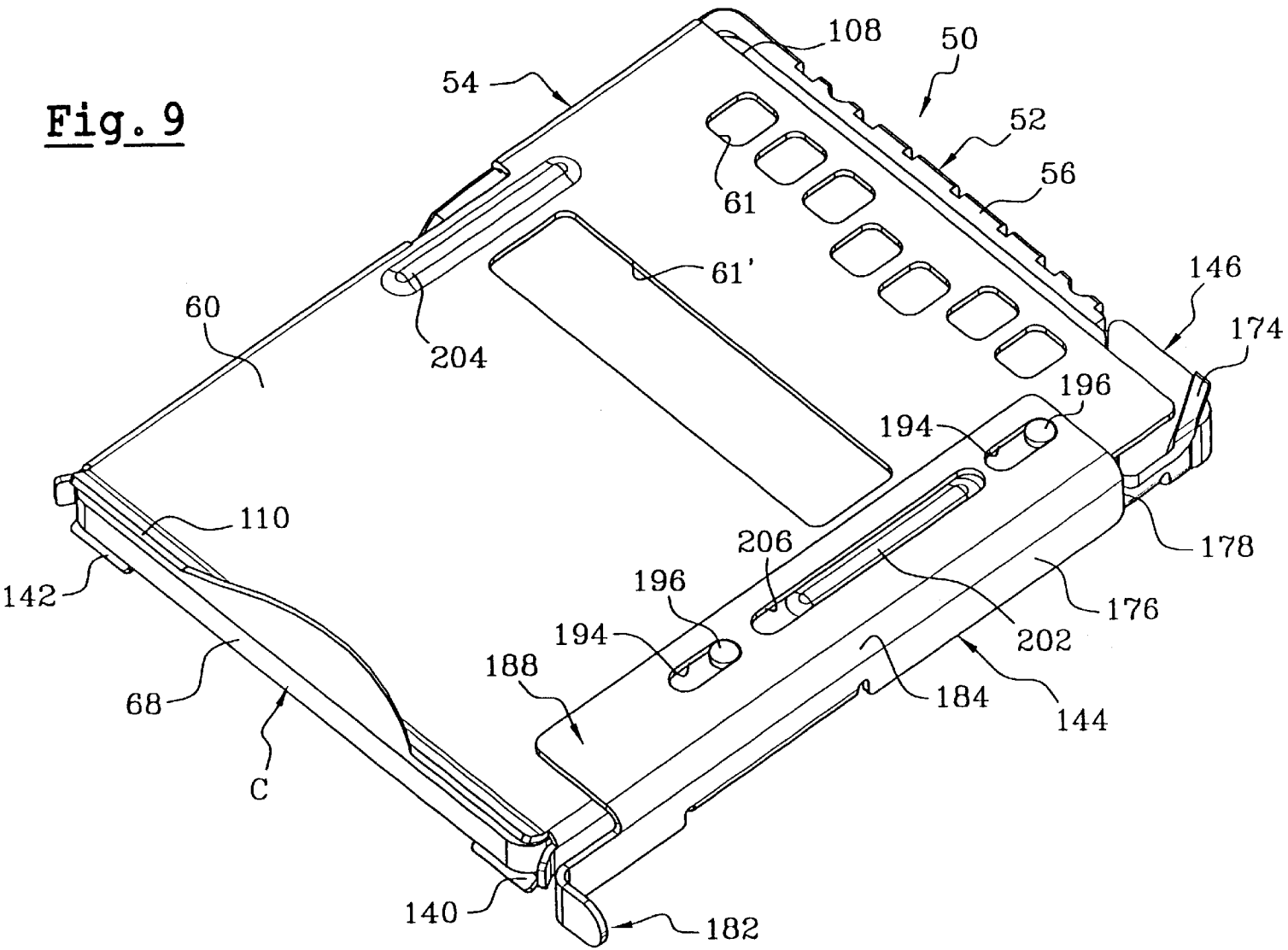
FIG. 9 is a view similar to that of FIG. 2, but with the card shown in its forwardly fully inserted position and the pusher in its rear position.
Figure 10:
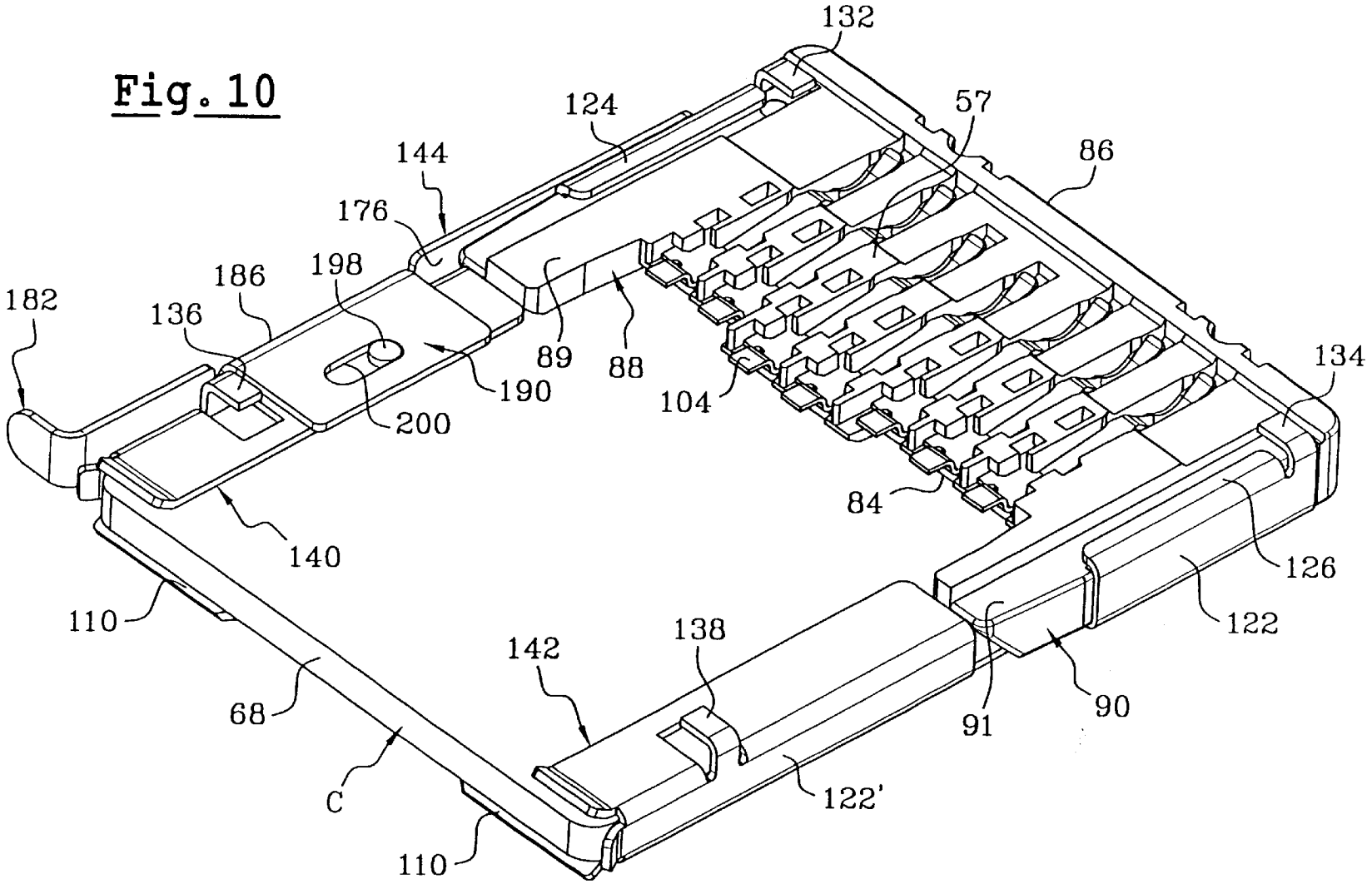
FIG. 10 is a view similar to that of FIG. 3, with the card in its fully inserted position.
Figure 15:
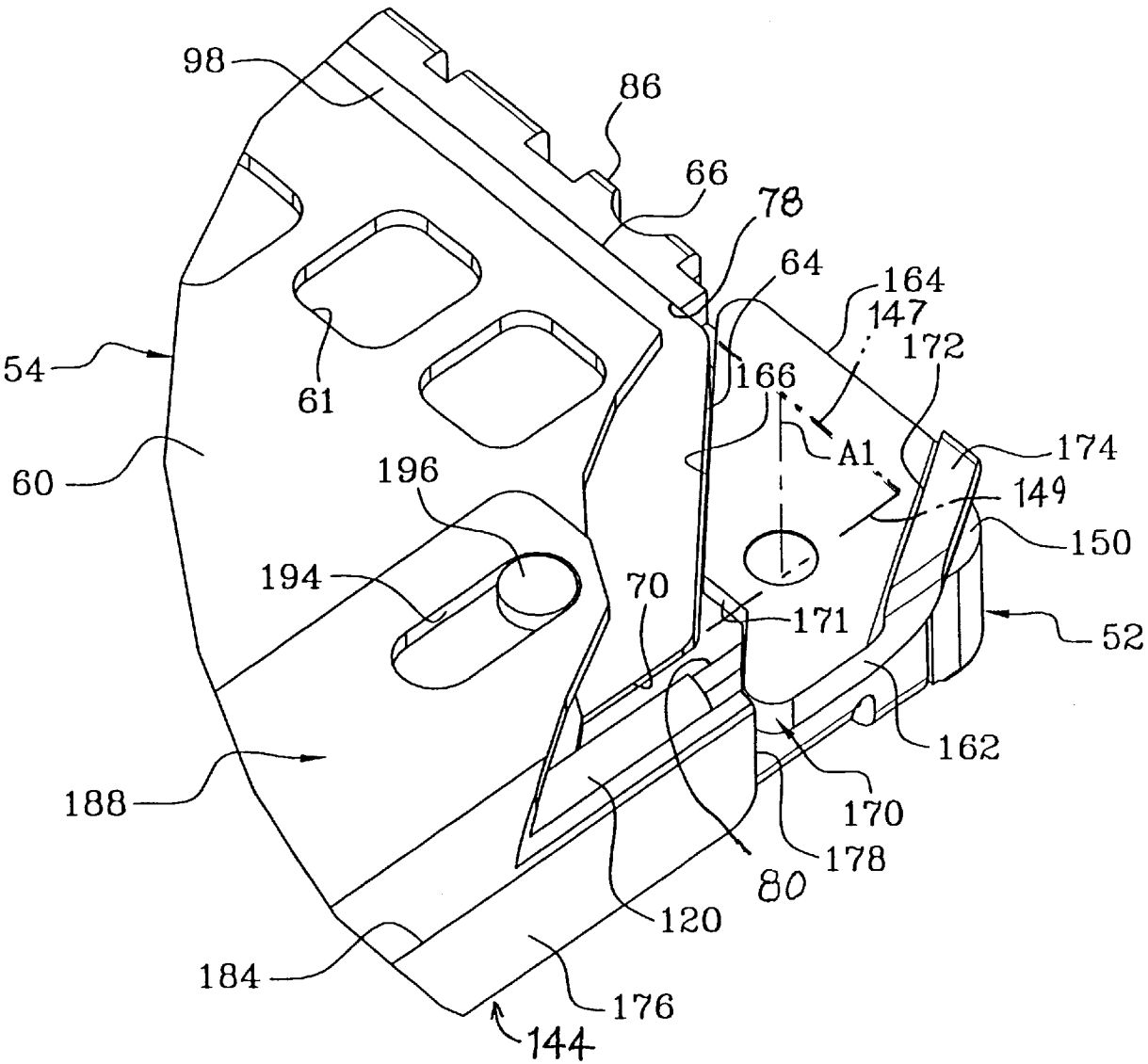
FIG. 15 is a view similar to that of FIG. 4, but with the card in its fully inserted position.
Figure 16:
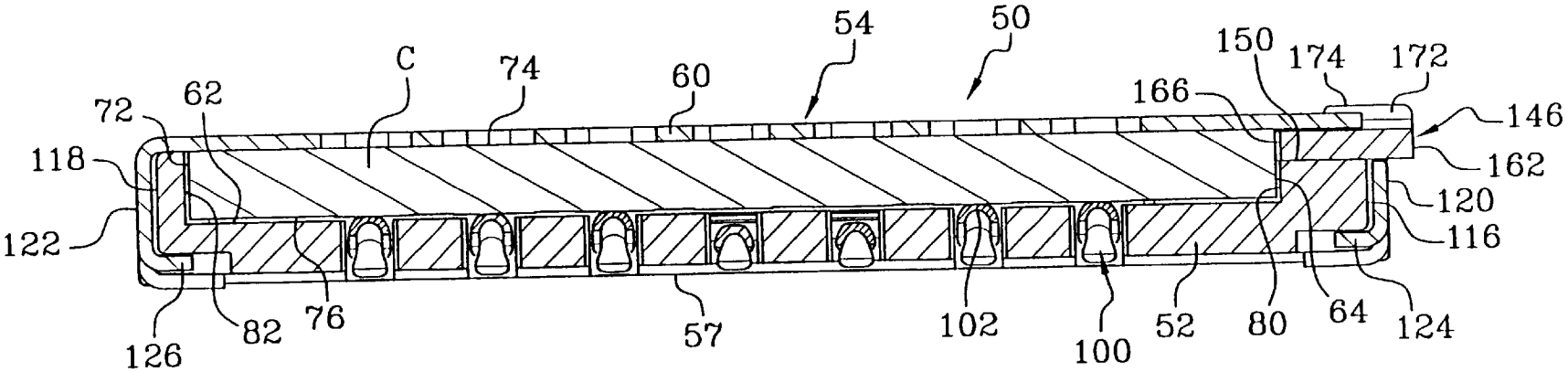
FIG. 16 is a sectional view taken on line 16—16 of FIG. 11.
Figure 17:
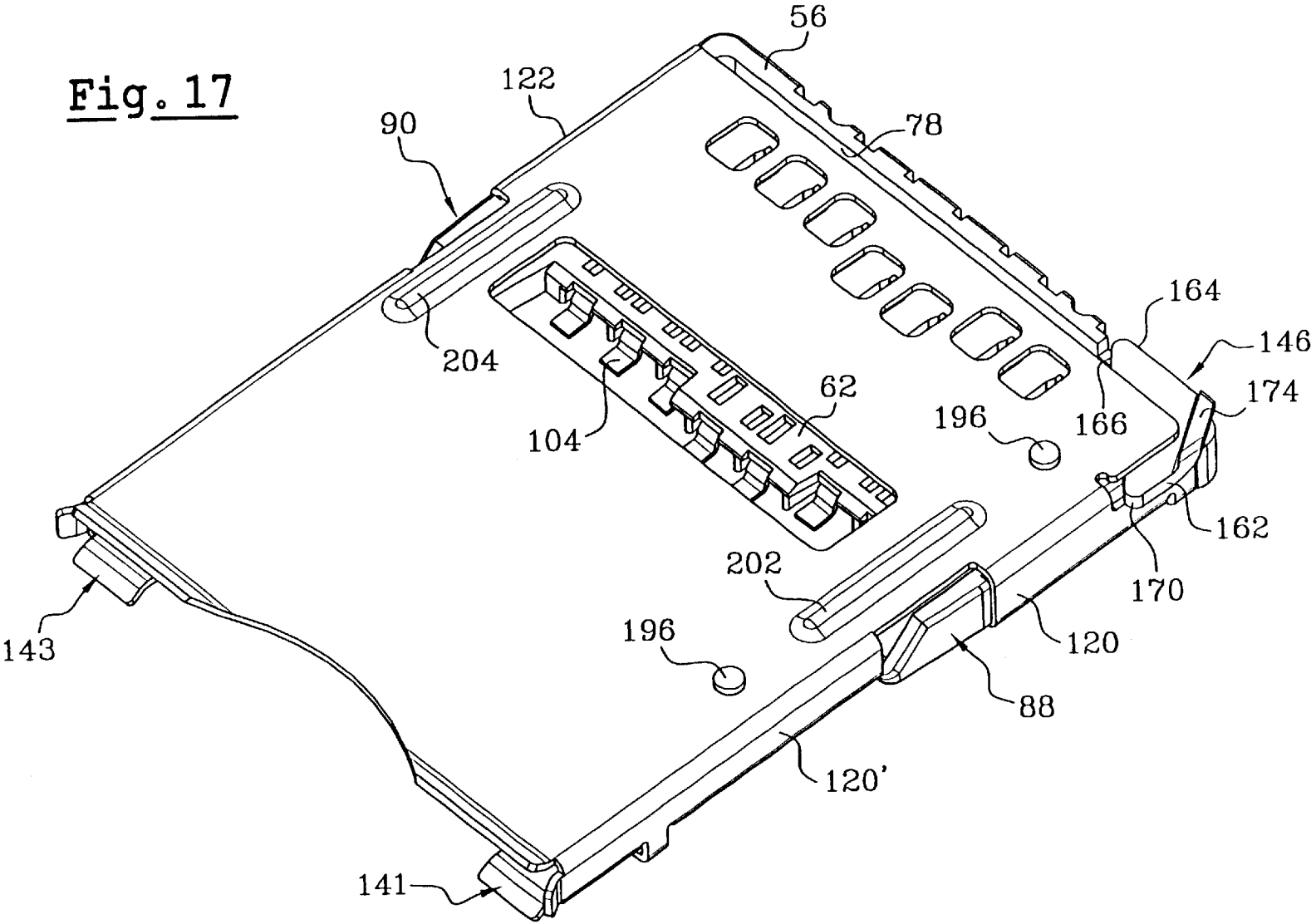
FIG. 17 is a view similar to that of FIG. 1, but without the ejection pusher.
Figure 18:
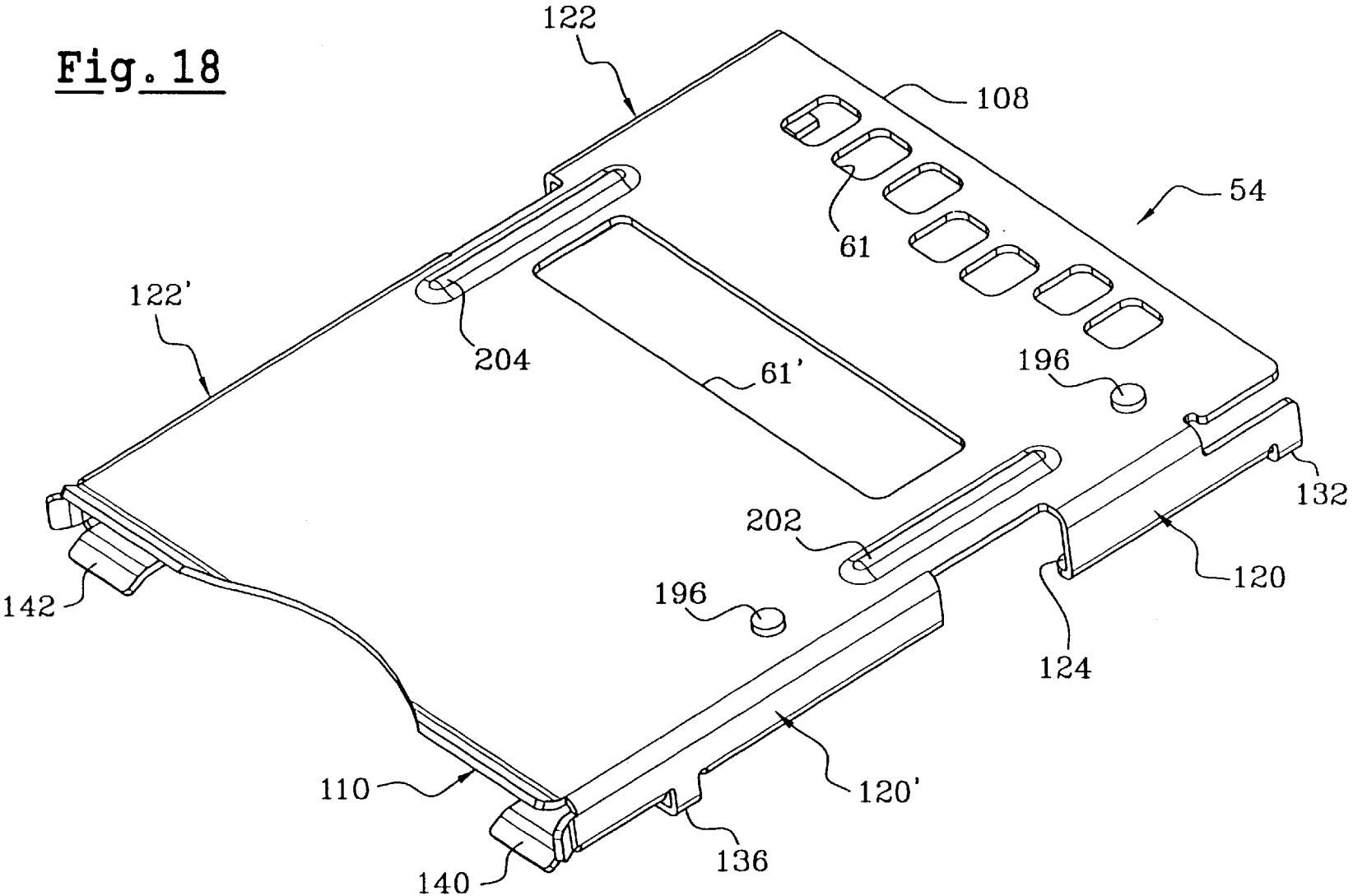
FIG. 18 is a top and rear isometric view of only the metal cover of the connector of FIG. 1.
Figure 19:
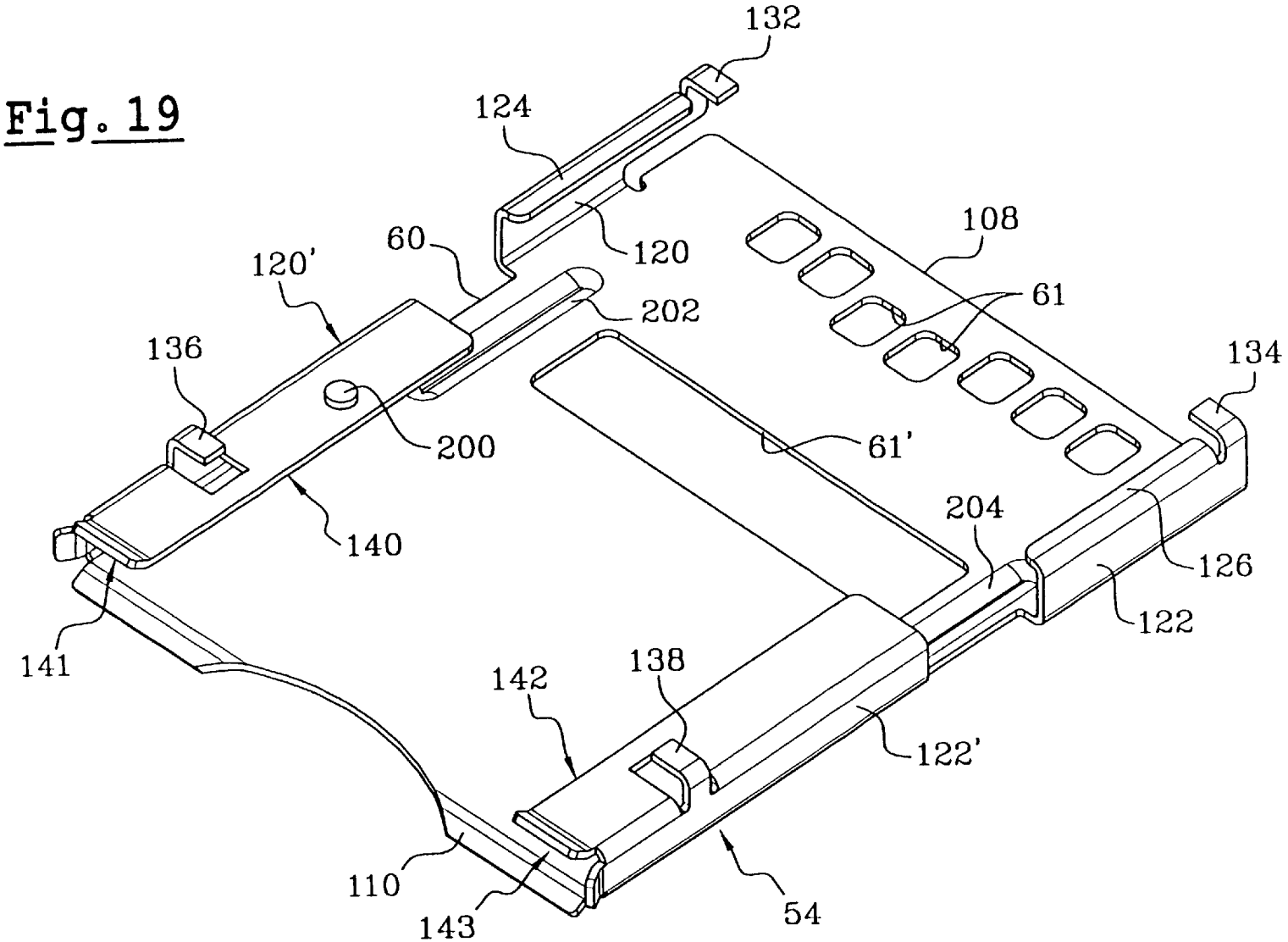
FIG. 19 is a bottom and rear isometric view of the cover of FIG. 18.
Figure 20:
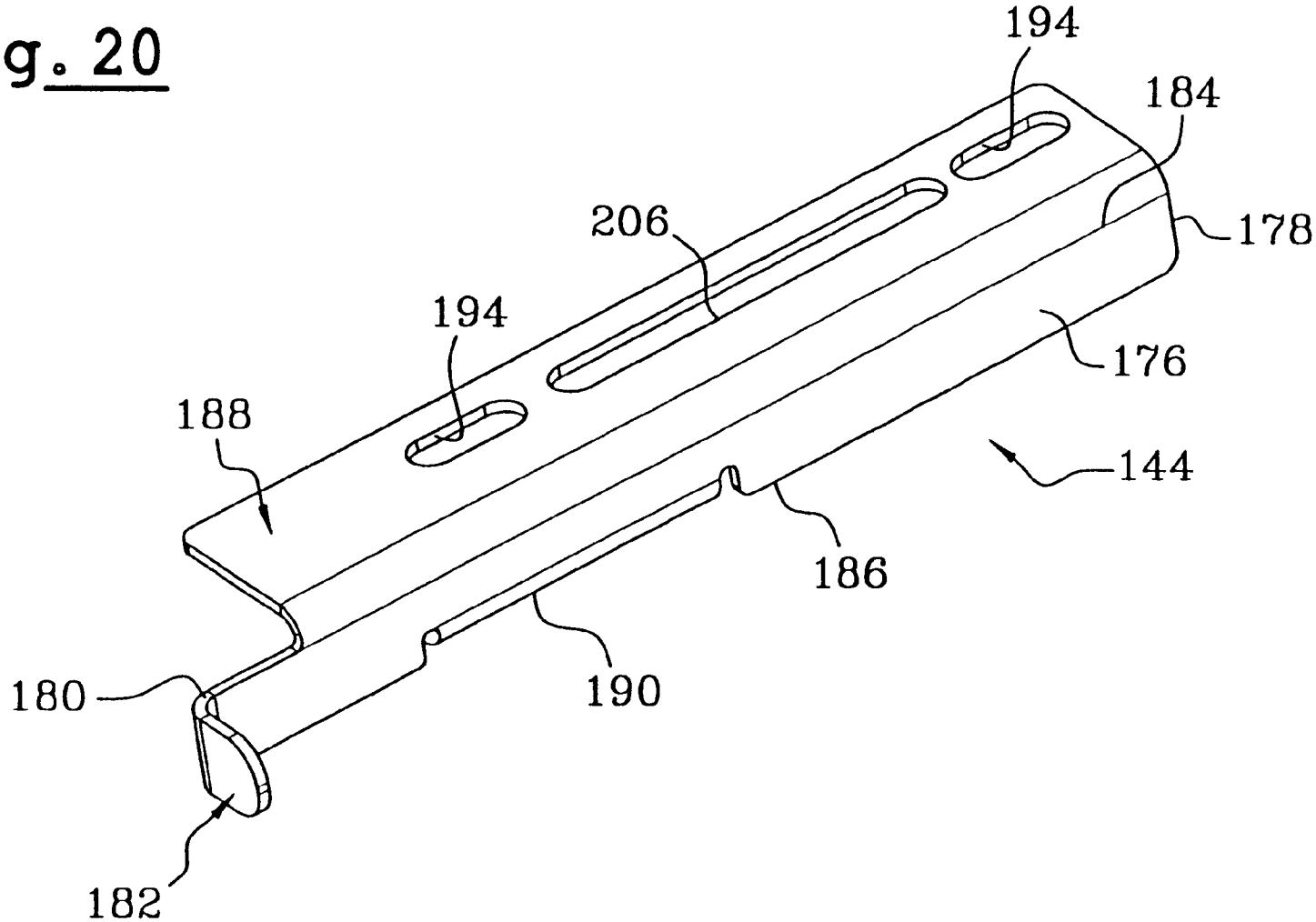
FIG. 20 is a rear and top isometric view of the ejection pusher of FIG. 1.
Figure 21:
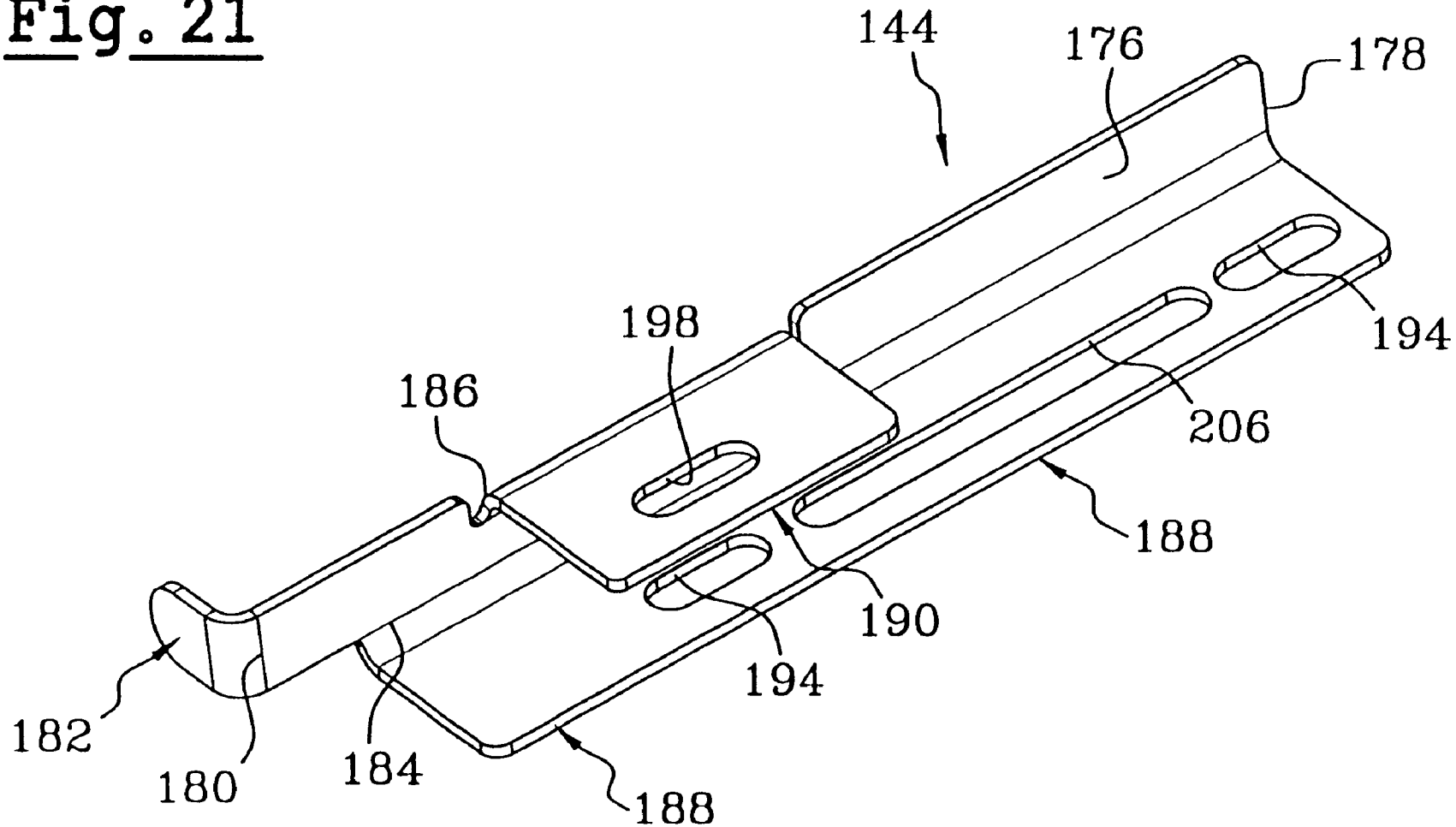
FIG. 21 is a bottom isometric view of the ejection pusher of FIG. 20.

FIG. 8 shows a card C which has been partially inserted in a forward F direction into the cavity 58, but not fully inserted. That is, the front edge 66 of the card does not yet abut a front stop wall 78 of the cavity, and the rear edge 68 of the card projects from the rear end of the cavity. The rear end of the card-receiving cavity lies at the rear end 110 of the cover upper portion. FIG. 2 shows that the card has opposite side edges 70, 72 that are spaced apart in a lateral L direction. FIG. 15 shows that the card has a cut corner 64 at the intersection of the card front edge 66 and a card side edge 70. The corner 64 forms a polarizing corner that prevents full insertion of the card if the card is turned upside down or if the rear end of the card is inserted first into the cavity.

Figure 22:
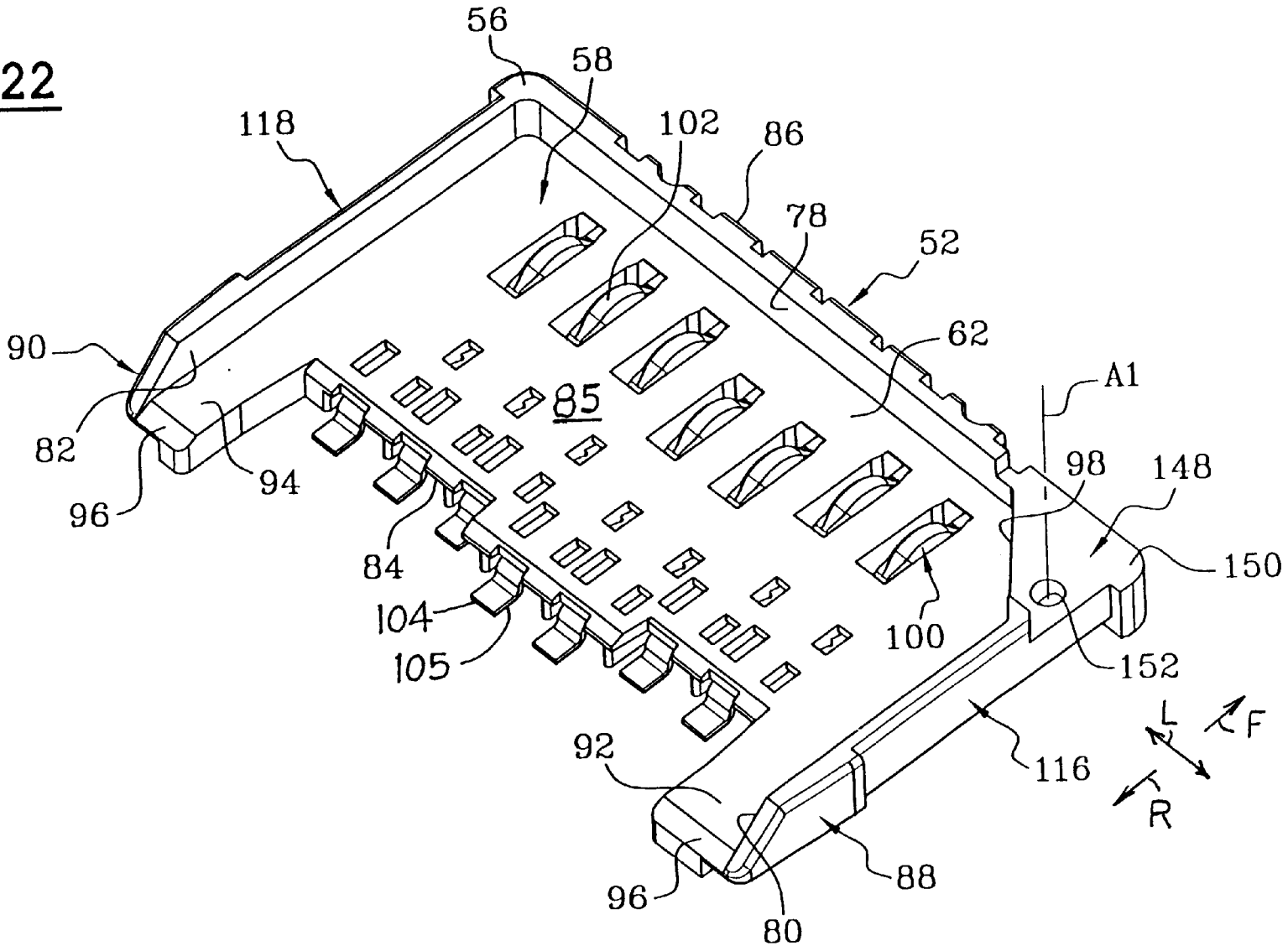
FIG. 22 is a top and rear isometric view of the insulative support with contacts mounted therein, of the connector of FIG. 1.

FIG. 22 shows that the support has a top face 56 extending along the front wall 86 and side walls 116, 118 of the support. FIG. 22 also shows a row of contacts 100 mounted on the insulative support 52. The contacts have pad-engaging ends 102 that project slightly above the upwardly-facing cavity wall, or upper wall 62, to engage the pads of a fully inserted card. The card-engaging upper wall 62, which will lie close to a card but not actually engage it, lies below the level of the top wall 56 of the support. The contacts have tails 104 that lie at a rearward edge 84 of a main portion 85 of the upper face 62, whose lateral L width equals the length of the row of contact ends 102. The tails 104 have tabs 105 for soldering to a circuit board.

FIG. 8 shows a circuit board 107 with electrically conductive traces 109, with the contact tails 104 soldered to selected ones of the traces.

Figure 3:
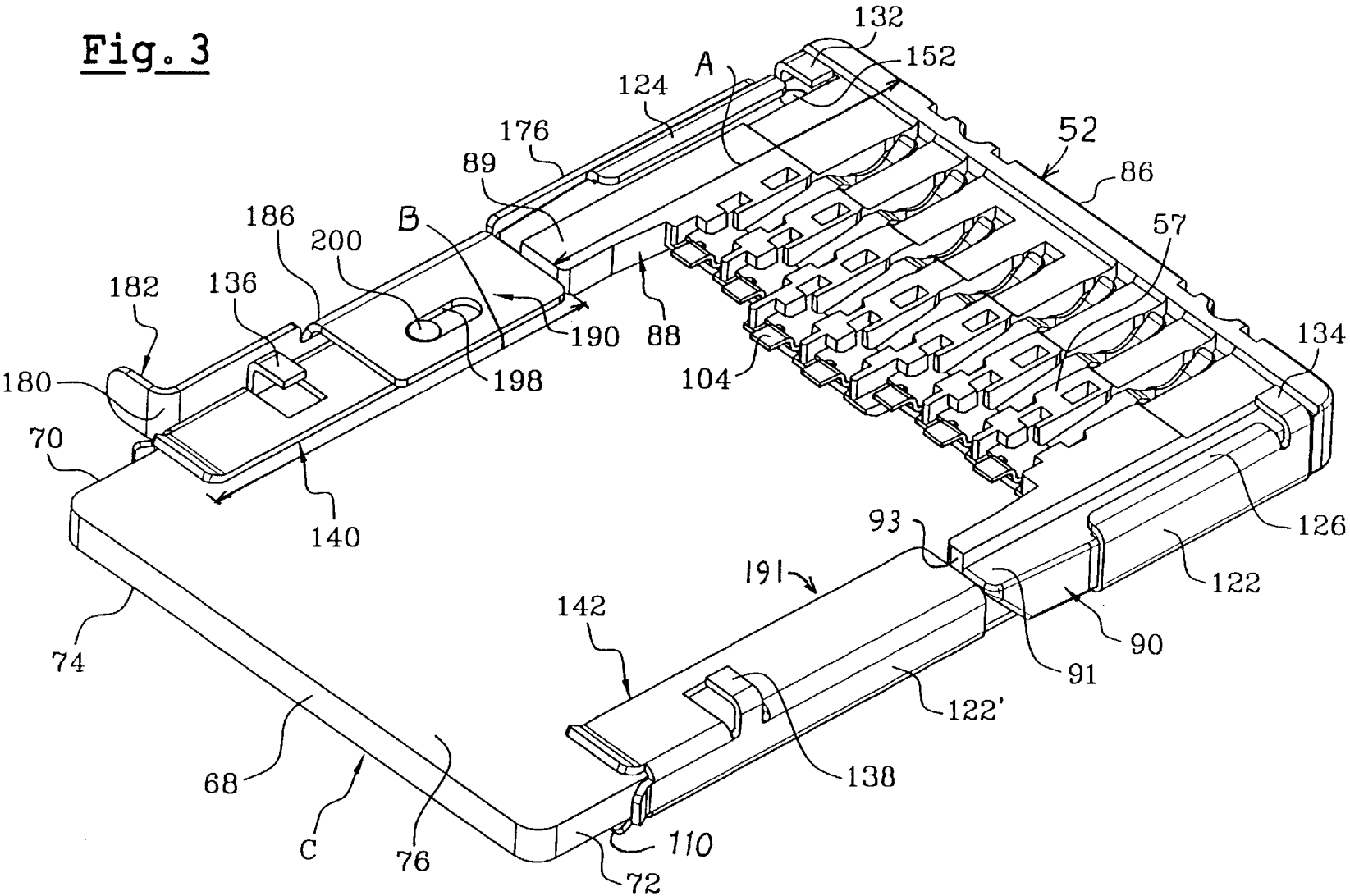
FIG. 3 is a bottom isometric view of the connector of FIG. 2.

FIG. 3, which is an upside-down view, shows that the sheet metal cover has a lower portion 191 that includes a front section with front flanges 124, 126 that directly engage the bottom of the insulative support, and a rear section with rear flanges 140, 142 that lie rearward of the support. The rear flanges are raised above the level of the front flanges, to form opposite sides of the bottom of the rear section, or rear half of the card-receiving cavity. At least about half of the longitudinal M length of the cavity (more than 25%) extends between the support rear end at 93 and the rear end 110 of the cover upper portion, and between the support main portion rear end 84 and the cover upper portion rear end 110. Along the rear section of the cavity, the upper and lower walls of the cavity are formed at the opposite sides between the lower flanges 140, 142 and the cover upper portion. It is noted that each flange includes a grounding tab 132, 134, 136, 138 that is soldered to corresponding traces on the circuit board. Sides 122, 122' of the sheet metal connect the upper and lower portions.

Figures 11, 12, 13:
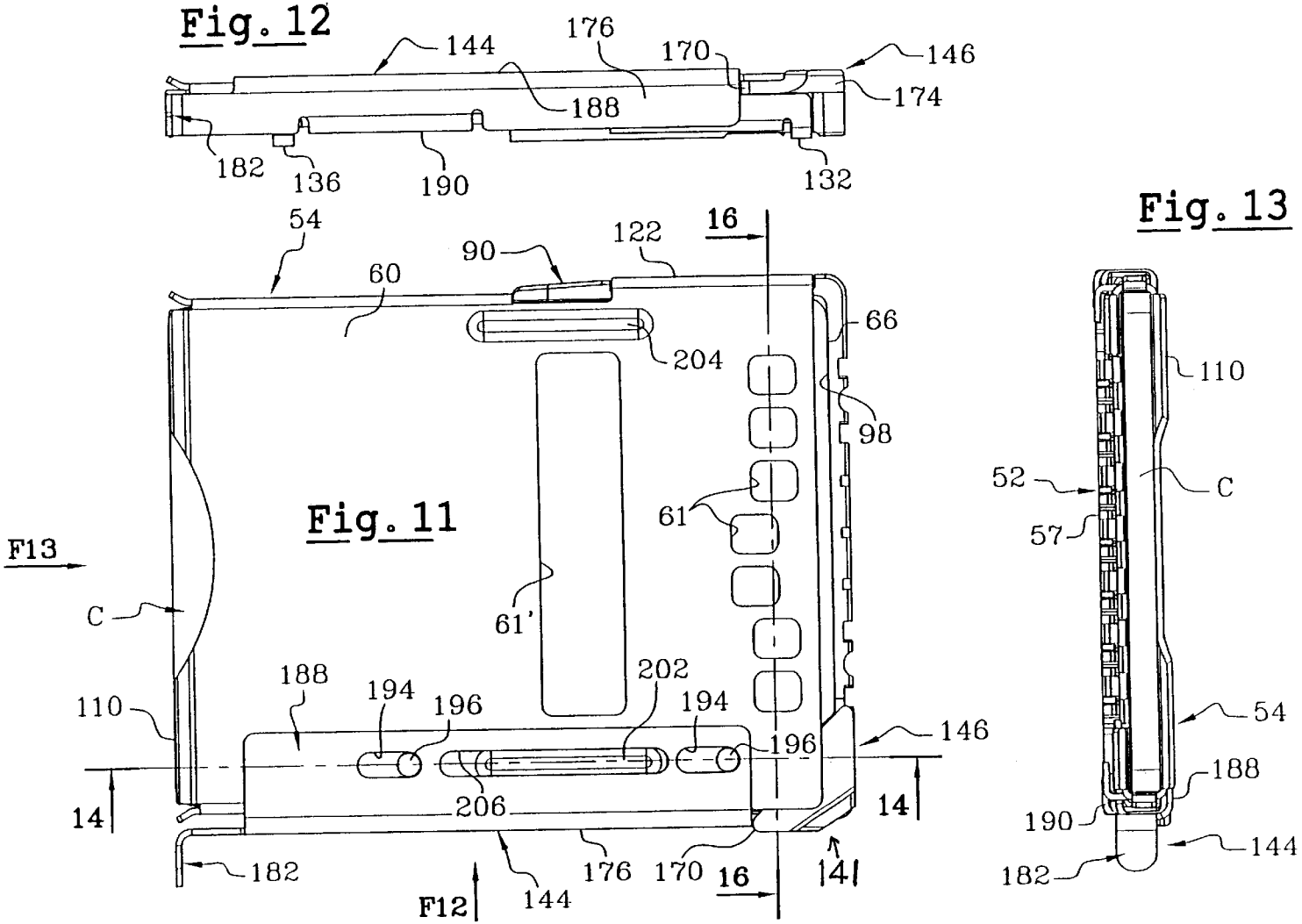
FIG. 11 is a view similar to that of FIG. 5, but with the card in its fully inserted position.
FIG. 12 is a view similar to that of FIG. 6, but with the card in its fully inserted position.
FIG. 13 is a view similar to that of FIG. 7, but with the card in its fully inserted position.
Figure 14:
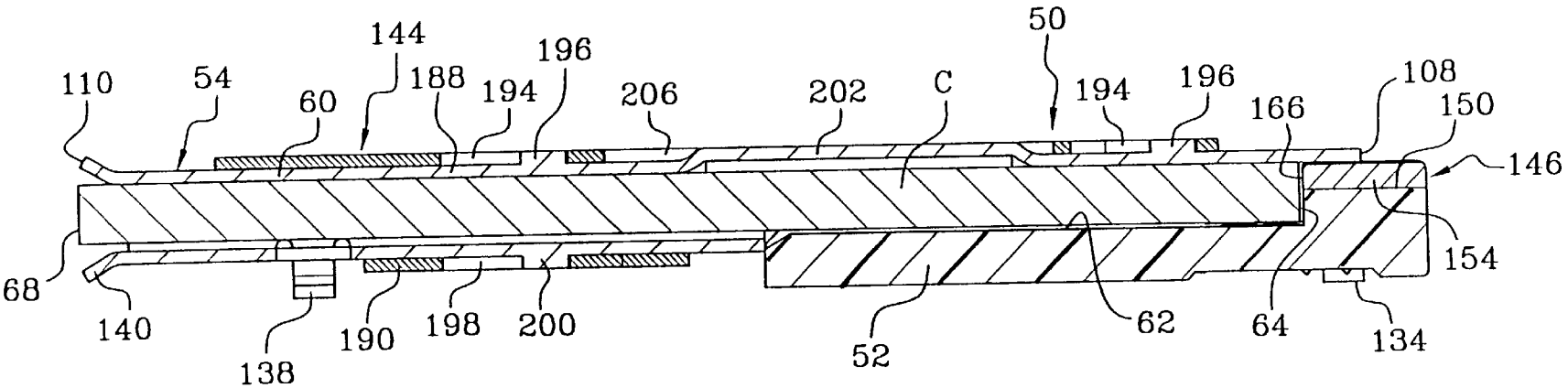
FIG. 14 is a view taken on line 14—14 of FIG. 11, and which is similar to that of FIG. 8 but with the card in its fully inserted position.

FIG. 11 shows the card C in its fully inserted position. Although a person might be able to grasp the rear edge portion of the card to pull it out, this can be difficult because of the small area available to be grasped. To help in card removal, applicant provides a card ejecting mechanism 141 that enables rearward movement of a fully forwardly inserted card by a plurality of millimeters, to make it easier to grasp and pull out the card. The mechanism includes a pusher 144 and a lever 146. As shown in FIG. 1, the pusher 144 is formed of sheet metal with a long upper flange 188 that lies on top of the cover upper portions 60, and with a shorter lower flange 190 that lies below the cover lower portion, so the sheet metal pusher straddles, or lies astride one side of the cover. The upper portion of the cover has a pair of fingers 196 deformed upperwardly therein, which are received in slots 194 in the upper flange 188 of the pusher, to confine the pusher to solely longitudinal M movement, that is, to movement in forward F and rearward R directions. A manually moveable tab 182 that can be moved by a person's finger, can move the pusher forwardly to eject the card.

Figure 4:
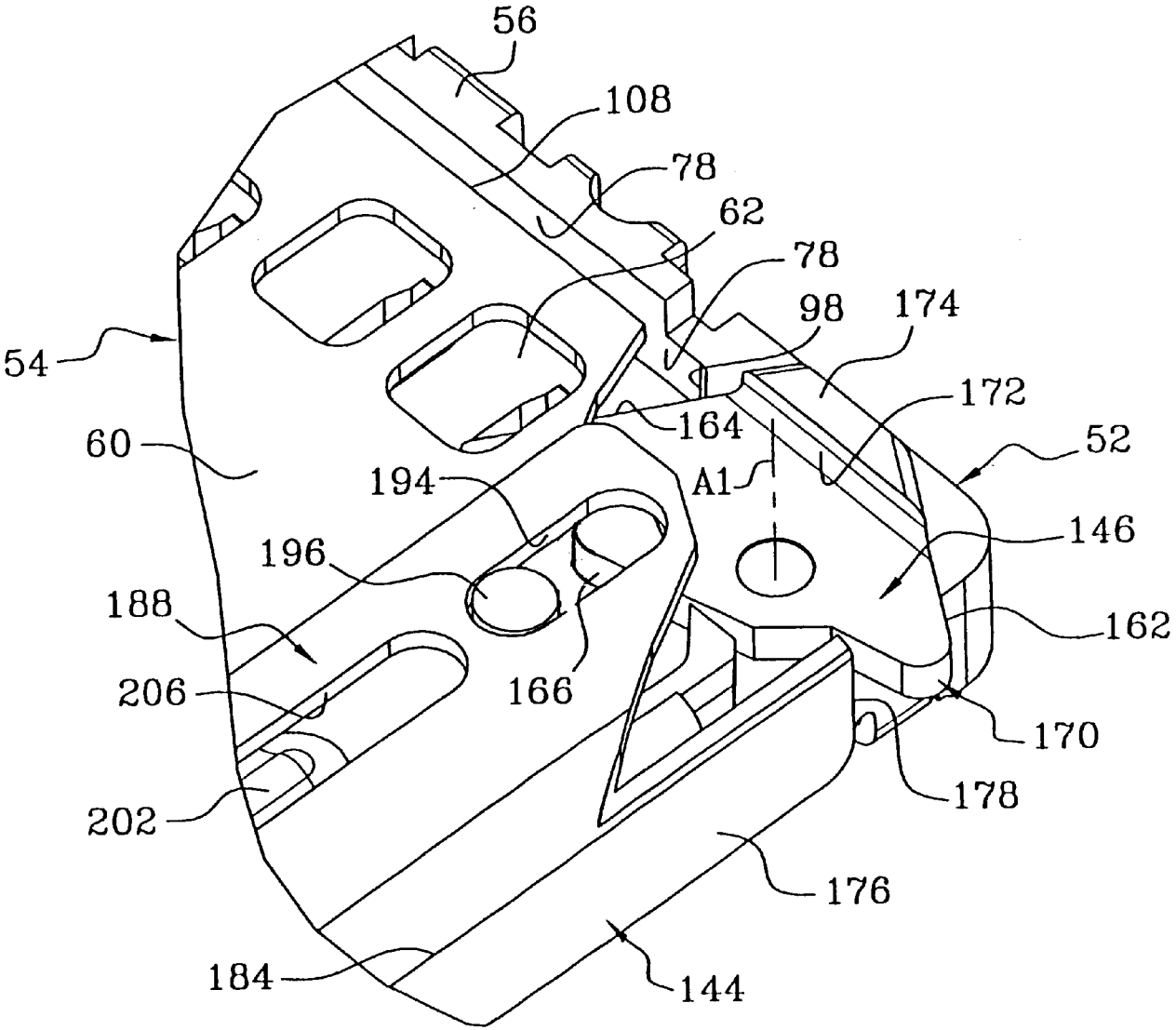
FIG. 4 is an enlarged view of a portion of FIG. 2, with part of the pusher and part of the upper cover portion being cut away.
Figure 7:
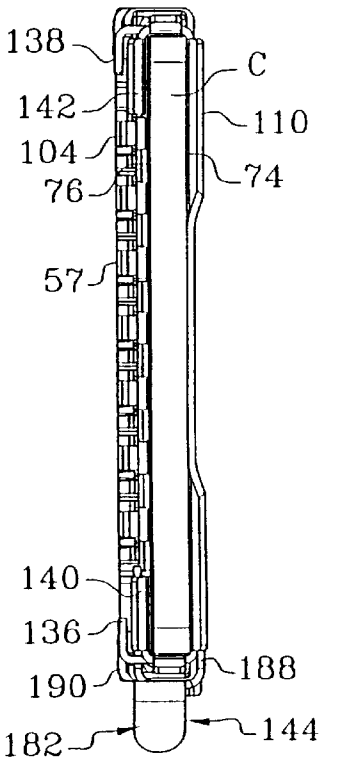
FIG. 7 is a rear end view taken along arrow F7 of FIG. 5.

FIG. 15 shows that the ejection lever 146 is pivotally connected to the insulative support 52 at a vertical axis A1. When the pusher 144 is moved forwardly, its front end edge 178 presses against one end 170 of the lever to pivot it. Another end or edge 166 of the lever pushes against the polarizing corner 64 of the fully inserted card to push the card rearwardly. FIG. 4 shows the pusher 144 in its fully forward position, with the pushing edge 166 of the lever having moved rearwardly to push the card rearwardly.

Figure 6:
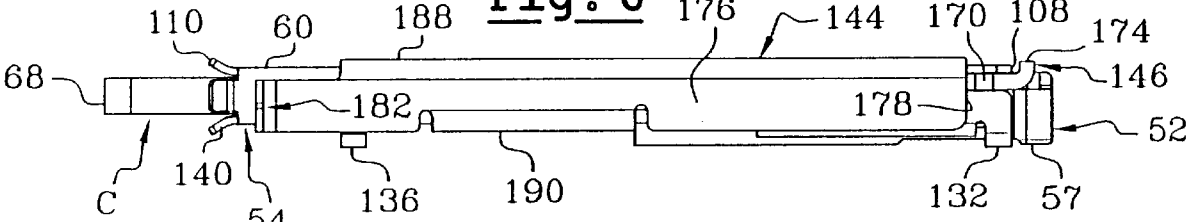
FIG. 6 is a side elevation view taken along arrow F6 of FIG. 5.
Figure 5:
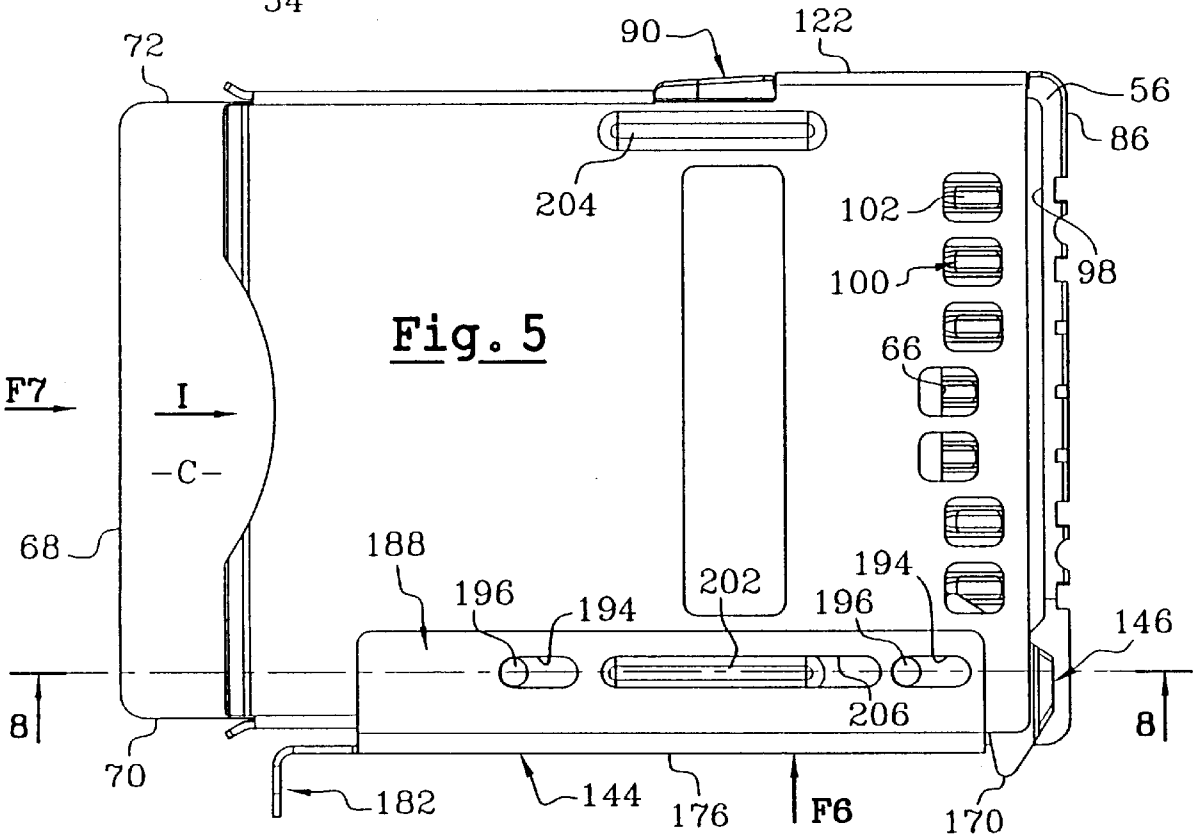
FIG. 5 is plan view of the connector of FIG. 2, with the card in the same position.

FIG. 15 shows that when the card is fully forwardly inserted, the card front edge 66 substantially abuts a front edge 78 of the cavity. The axis A1 of the ejection lever lies forward of the cavity front edge 78 and the front edge 66 of the fully inserted card. This results in the ejection lever adding very little if any to the length of the connector, forward of the card front edge 66. The pivot axis A1 preferably lies close to the card side edge 70 and within the side edge, to minimize the sideward extension of the connector beyond the side edges such as 70 of the card and the side edges such as 80 of the support. Much of the ejection lever lies within imaginary extensions 147, 149 of the card front and side edges 66, 70 that would form the corner of a rectangular card if the card polarizing cutout at 64 were not present. When the pusher is in its extreme forward position, shown in FIG. 4, a vertical face 172 of a lever projection 174, which projects above the rest of the lever, abuts a front edge 108 of the sheet metal cover upper portion. It is noted that if the pusher is in its forward position shown in FIG. 6, when a card is fully inserted in the cavity, that the front edge of the card will pivot the lever and cause the lever to push the pusher 144 rearwardly to its initial position.

FIG. 22 shows that the insulative support 52 has a pair of extensions 88, 90 that extend rearwardly beyond the rear edge 84 of the main portion 85 of the support. The extensions provide additional guiding of the smart card as it approaches its fully inserted position, by providing extensions at the horizontal face sides 92, 94 and the vertical side edges 80, 82 of the cavity. Chamfers 96 help in guidance. As shown in FIG. 3, the lower cover portion rear flanges 140, 142 are raised above the level of the front flanges 124, 126. This allows the rear flanges to form the bottom opposite sides of the cavity rear half, into which the card is guided before it slides over the insulative support. The higher level of the rear flanges 140, 142 also facilitates the creation of leadins shown in FIG. 1 at 143, 145 that initially guide the front edge of the card into the cavity.

The leadins shown in FIG. 1 at 143, 145 include tabs at 110 on the sheet metal cover upper portion 60 and tabs 140, 142 on the sheet metal cover lower portion. The upper tabs at 110 extend at rearward upward inclines, while the lower tabs 140, 142 extend at rearward-downward inclines. FIG. 8 shows that the lower tabs such as 142 lie above the circuit board 107 because the lower rear flange 140 lies at a level above the bottom of the insulative support 52. FIG. 3 shows that the insulative support 52 extends longitudinally by a distance A that is about the same as the longitudinal distance B that the cover extends rearward of the insulative support. This leaves a free area under the fully inserted card. It is possible to provide traces on the upper face of a circuit board in this area. The long lower flanges also facilitate mounting of the pusher.

Figure 23:
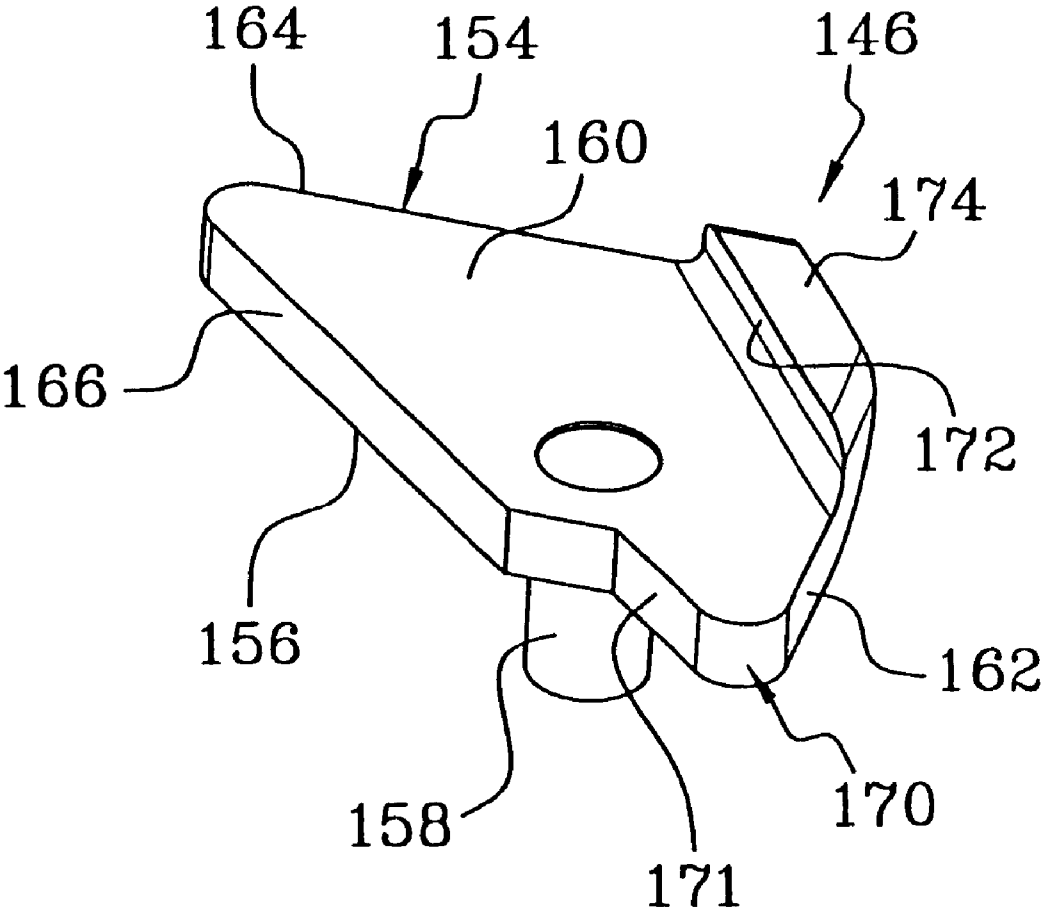
FIG. 23 is a rear isometric view of the ejection lever of the connector of FIG. 1.
Figure 24:
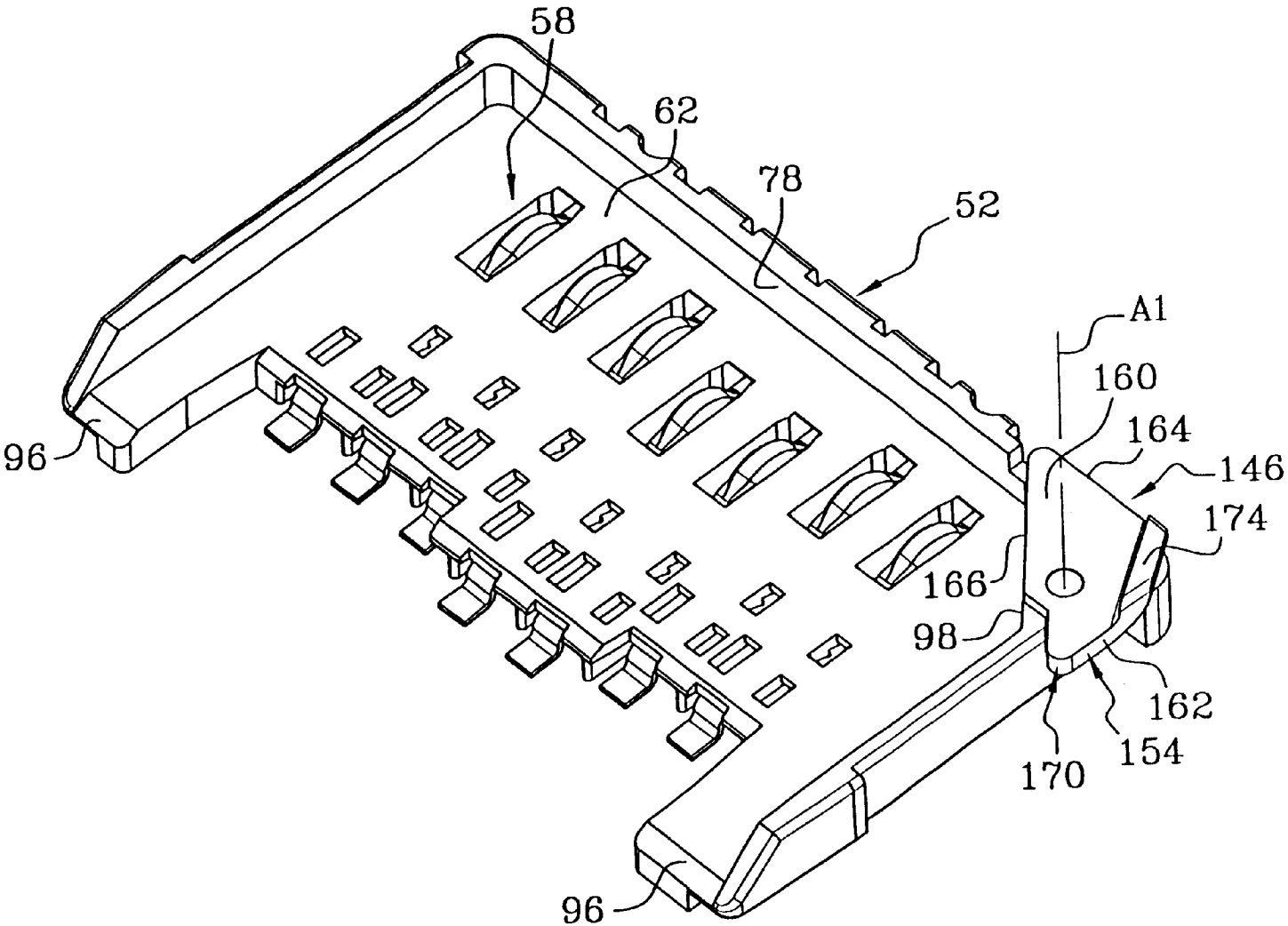
FIG. 24 is an isometric view of the insulative support of FIG. 22, with the ejection lever mounted on the insulative support.

While the insulative support 52 is formed of molded plastic, the cover is formed of bent sheet metal, and the pusher is formed of bent sheet metal, the lever 146 is preferably formed of machined metal. FIG. 23 shows that the lever is formed with a hole, and that a stud 158 is press fit into the hole to pivotally mount the lever on the support. The lever takes considerable wear, especially as the front edge of the pusher pushes against an edge 171 of the lever to pivot it. As shown in FIG. 22, the lever lies in a recess 148 whose bottom wall 150 lies above the support upper face 62. As a result, a fully inserted card will have its polarizing corner abut a vertical face 98 of the platform if it does not abut the lever or the stop surface 78.

FIG. 1 shows that the upper cover portion 60 has a set of holes 61. The holes allow the connector to be tested by probes that project through the holes 61 and that engage the card-engaging ends of the contacts. The upper portion 60 also has a laterally elongated slot 61' that lies over the tails 104 of the contacts. This allows inspection of soldered joints connecting the tails to traces on the circuit board, and can allow soldering by infrared beams or probes projected down through the slot.

Figure 25:
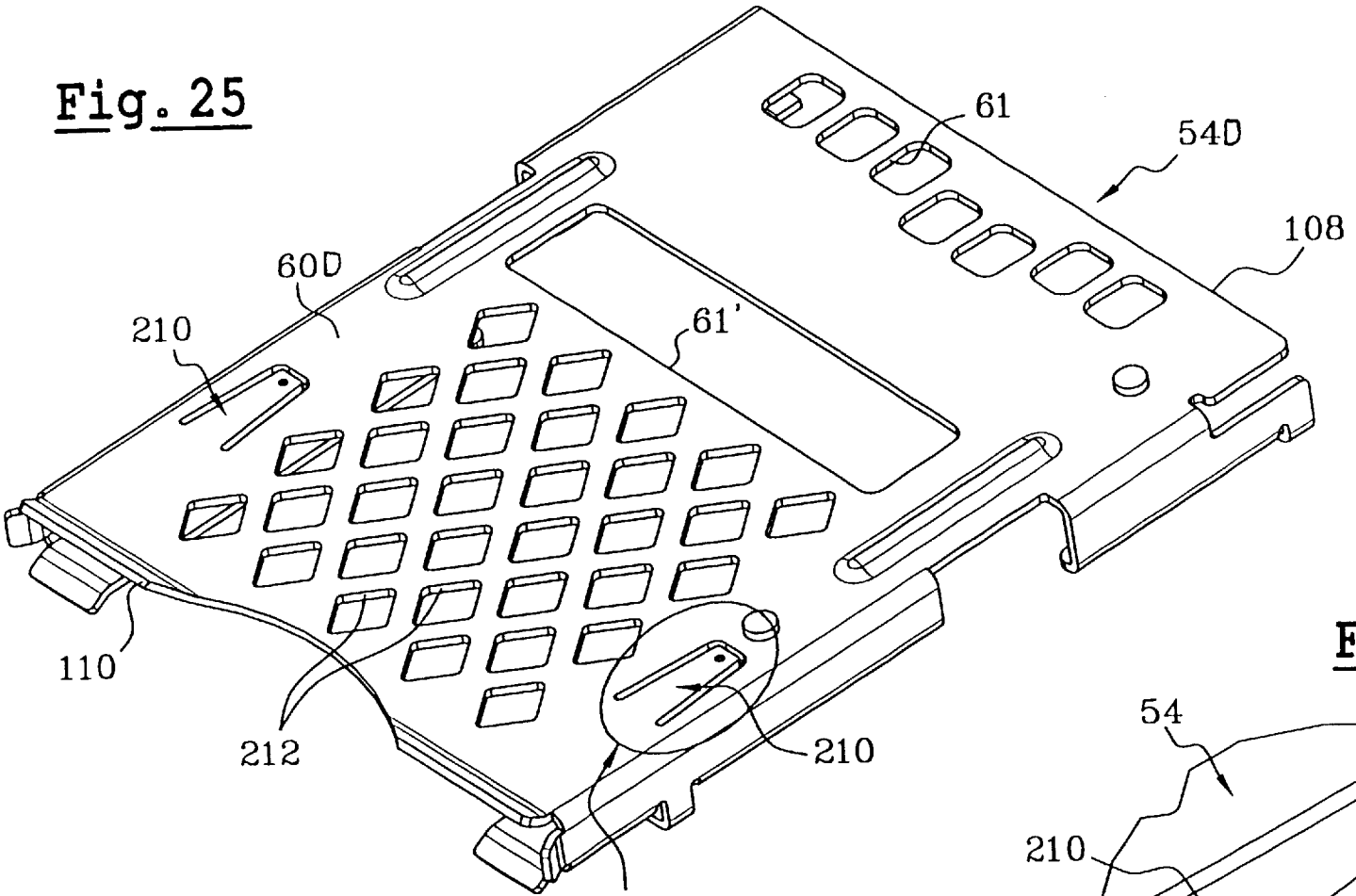
FIG. 25 is a rear and top isometric view of a cover of another embodiment of the invention with multiple holes in the cover upper portion, with FIG. 25 being somewhat similar to FIG. 18.
Figure 26:
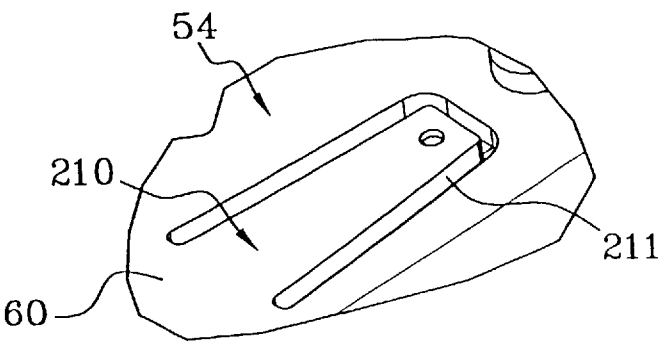
FIG. 26 is an enlarged view of area D26 of FIG. 25.

FIG. 25 illustrates a sheet metal cover 54D with braking means in the form of blades 210 that prevent a card from falling out of the connector, either when the card is fully inserted or when it is ejected by several millimeters. The blades are cut from the upper sheet metal cover portion by slits. As shown in FIG. 26, each blade has a free front end 211. The front end presses against edge portions of an upper face of the card. It is noted that the rear half of the upper cover portion 60D, rearward of the slot 61', has numerous apertures, the apertures 212 illustrated being of diamond shape. This design makes its easier to solder thin components mounted on the circuit board and lying beneath the cover. The apertures also reduce the mass of the connector, which is desirable, especially when the connector is mounted in a portable device such as a portable telephone. The stiffness of the cover and its ability to block EMI (electromagnetic interference) are not significantly reduced for moderate frequencies.

Figure 27:
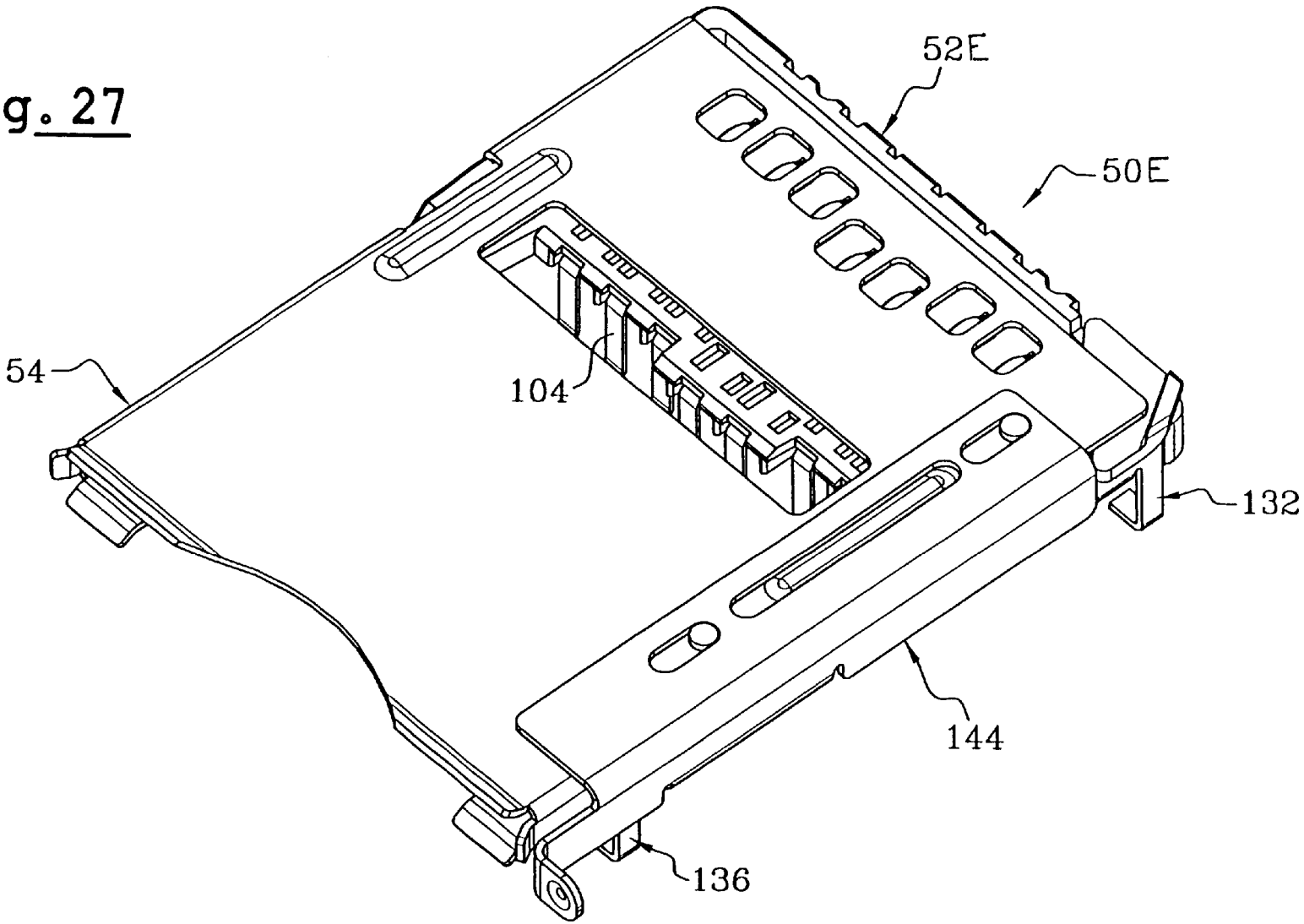
FIG. 27 is a rear and top isometric view of a connector of another embodiment of the invention where the contacts having tall tails, and which is somewhat similar to that of the connector of FIG. 1.
Figure 28:
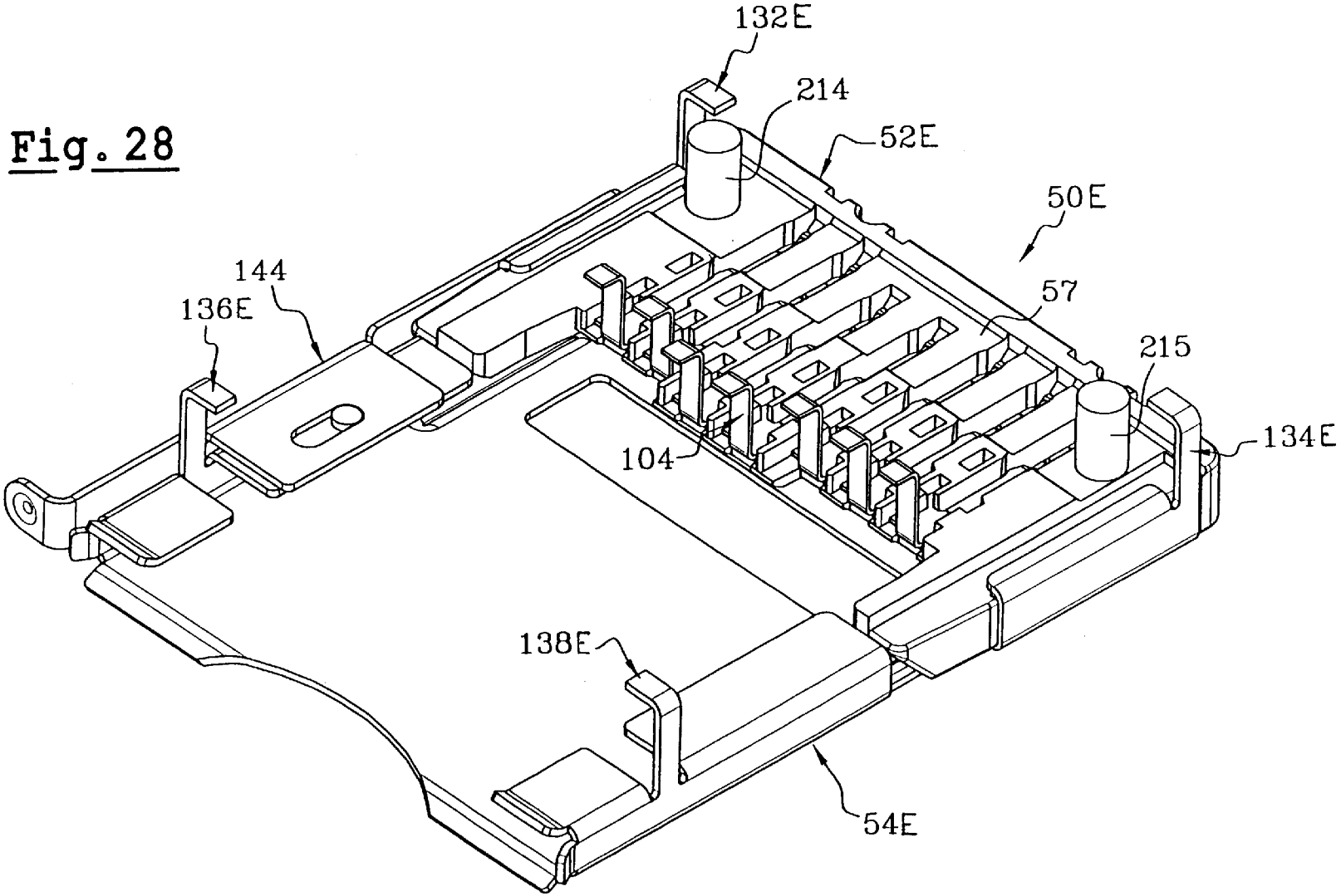
FIG. 28 is a bottom isometric view of the connector of FIG. 27.
Figure 29:
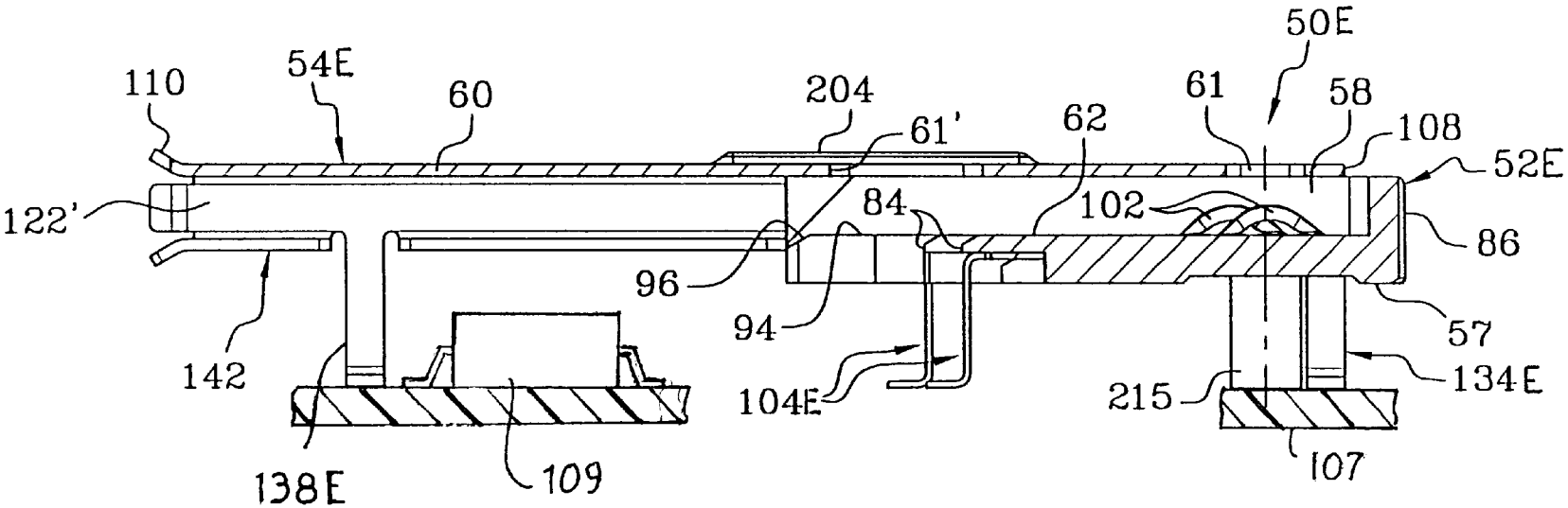
FIG. 29 is a sectional view taken through a vertical mid-plane of the connector of FIGS. 27 and 28, showing the connector mounted on a circuit board.

FIGS. 27–29 illustrate a connector 50E with most of the connector raised considerably above the circuit board. FIG. 29 shows that the insulative support 52E has a stud 215 that raises most of the support by a considerable distance above the circuit board 107. Contact tails 104E of the contacts are similarly elongated, as are grounding tabs such as 134E and 138E of the cover 54E. FIG. 29 shows a circuit component 109 mounted on the circuit board beneath the rear half of the cover upper portion. FIG. 28 shows an additional stud 214 and additional grounding tabs 132E and 136E that support the cover high above the circuit board.

Figure 30:
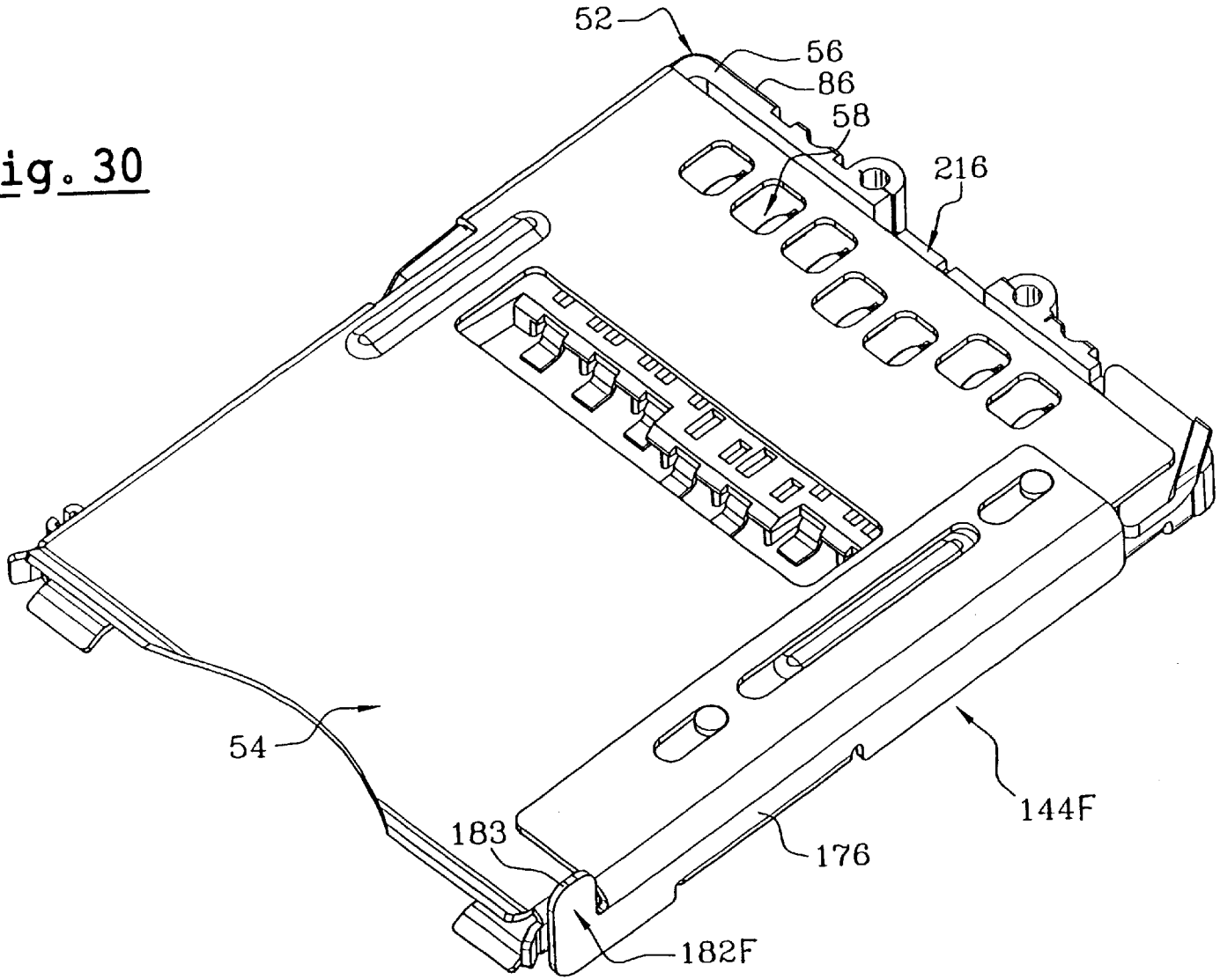
FIG. 30 is a rear and top isometric view of a connector of another embodiment of the invention, wherein the tab of the ejection pusher extends upwardly instead of sidewardly.

FIG. 30 shows a connector wherein the pusher 144F has a tab 182F that can be manually pushed, and that extends upwardly instead of sidewardly. The tab has a free end 183 that extends above the rest of the pusher.

FIGS. 31–46 illustrate two connectors that are mounted in a vertical stack that includes a lower connector 50A, and on upper connectors or connector device 50B. A stack of at least two connectors can be useful to enable each connector to receive and connect to a different type of smart card (a card with contact pads on one face). For example, MMM-type and MICROSIM cards. In some applications, it is desirable to be able to connect to two cards of the same type simultaneously. It is desirable that apparatus for connection to multiple cards simultaneously occupy a minimum amount of space on a circuit board.

Figure 31:
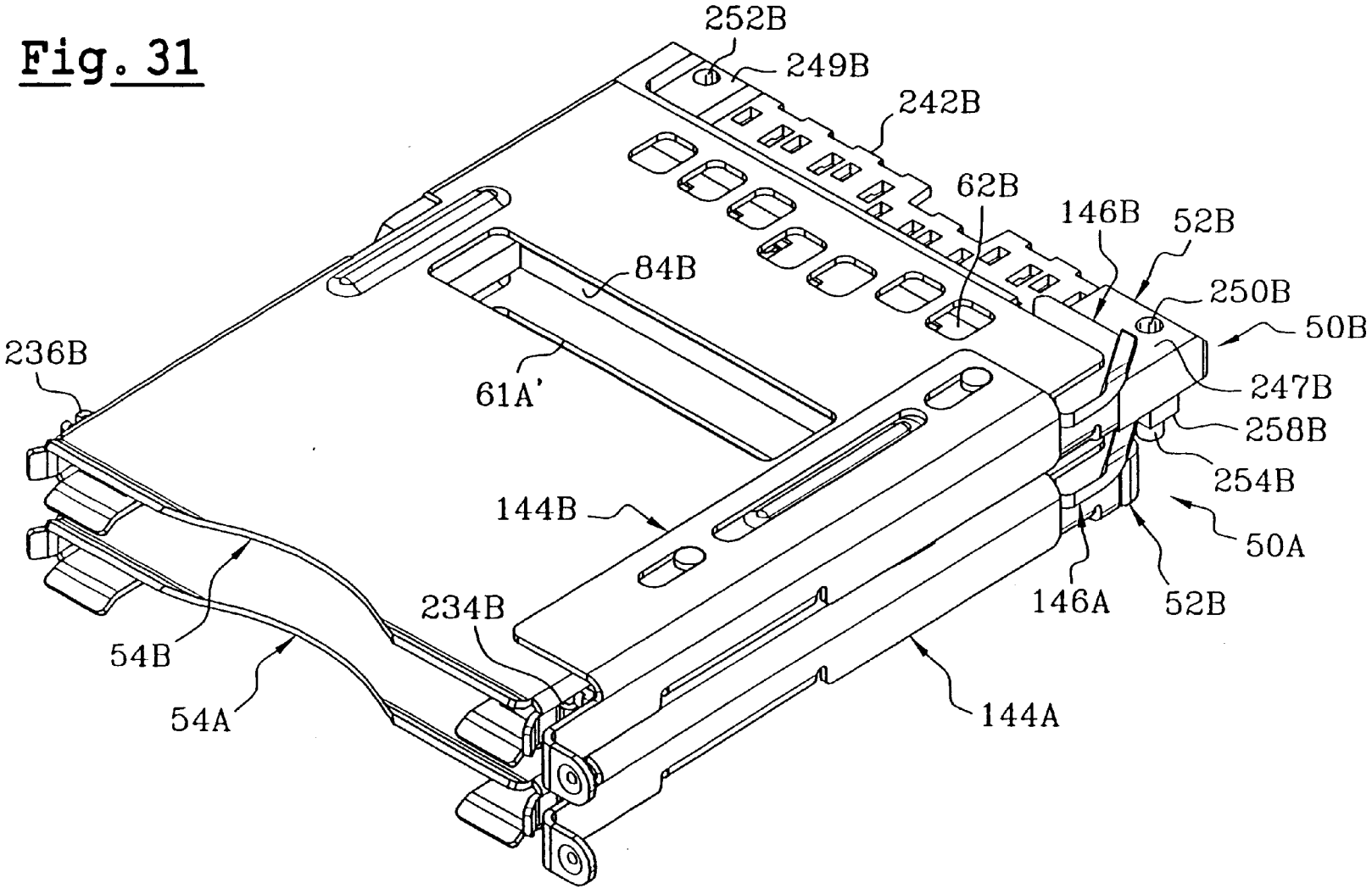
FIG. 31 is a rear isometric view of a stack of two connectors, constructed in accordance with another embodiment of the invention.
Figure 35:
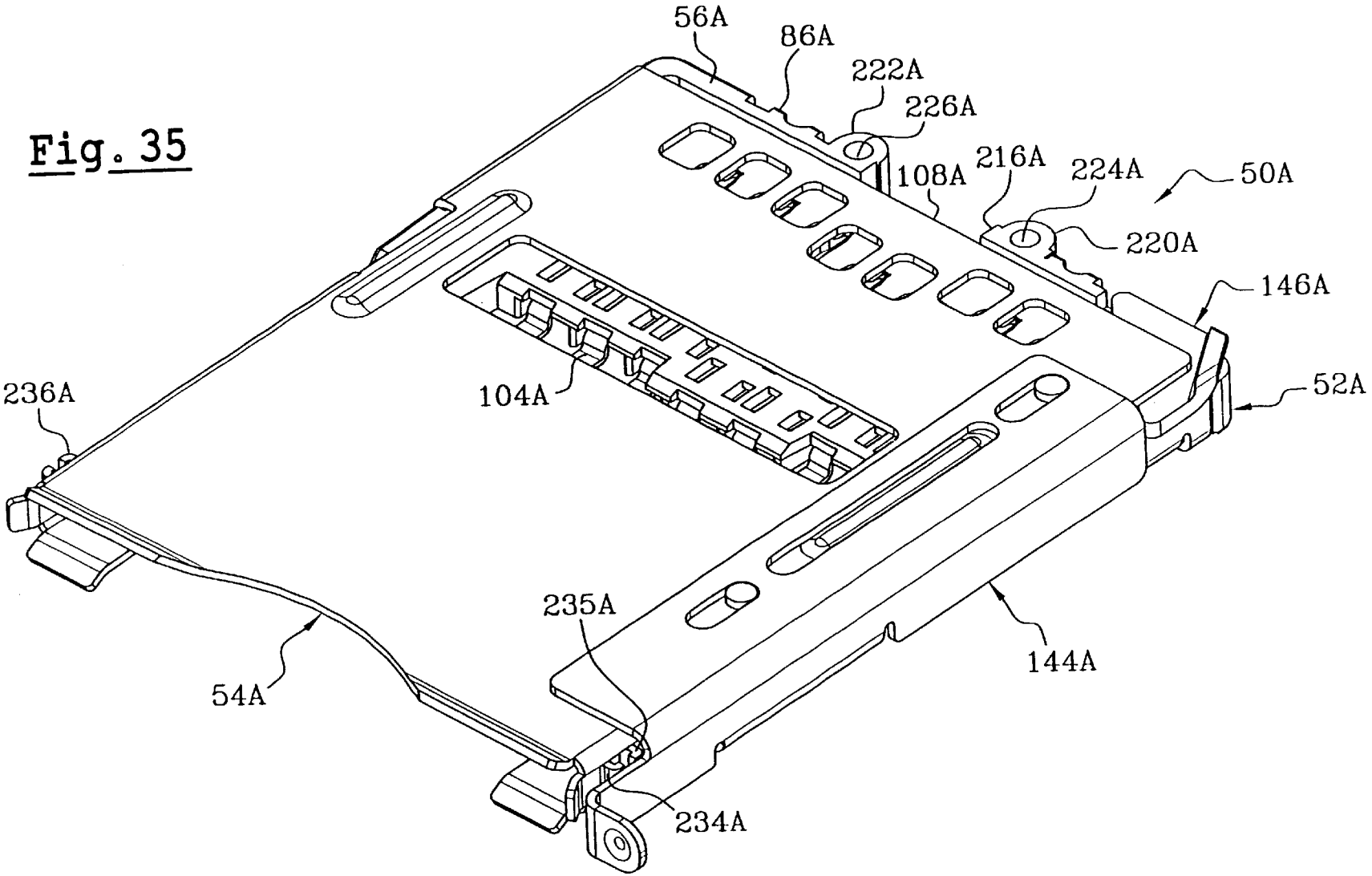
FIG. 35 is a rear and top isometric view of the lowermost connector of the stack of FIG. 31.
Figures 41, 42, 43, 44:
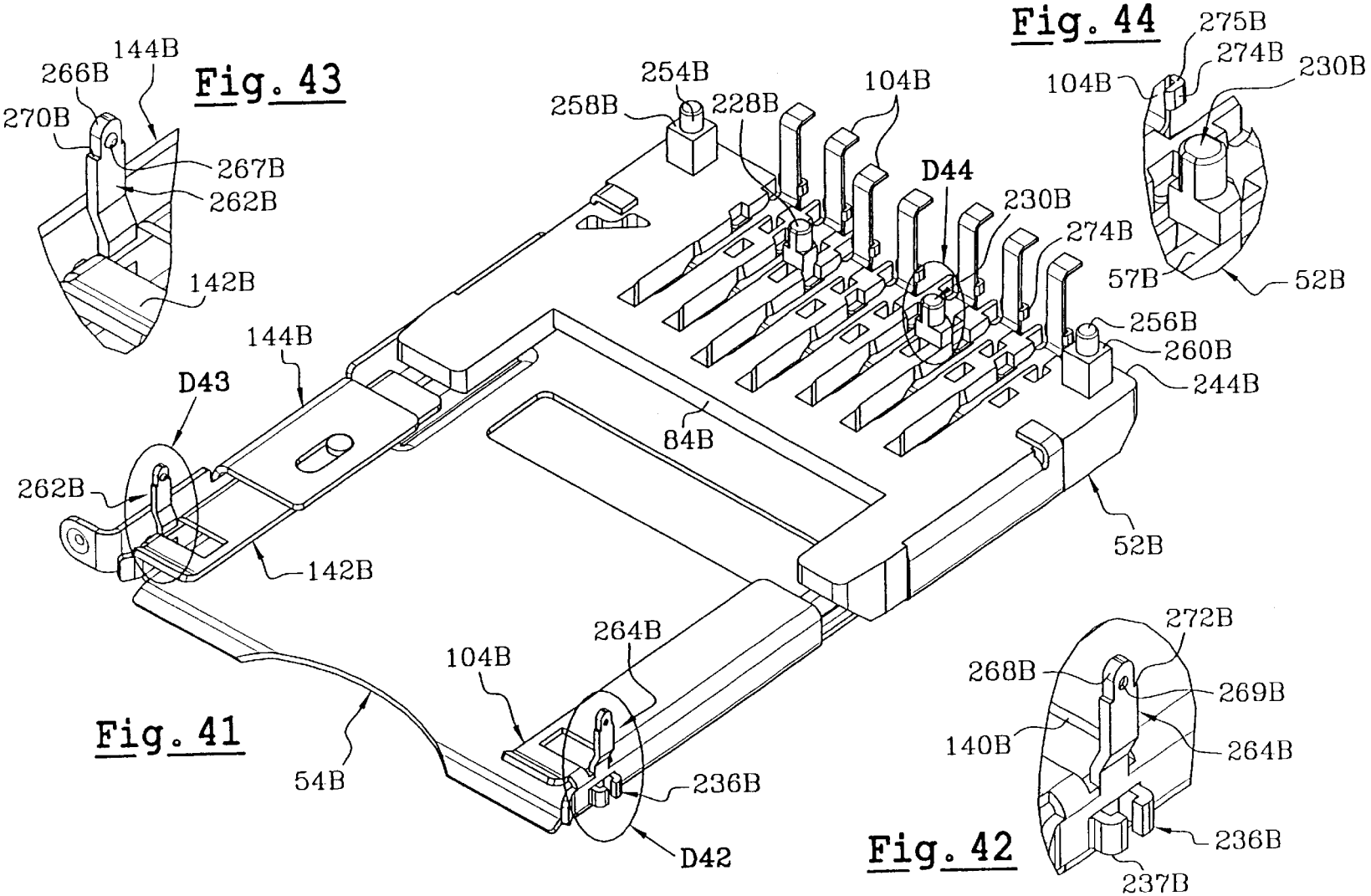
FIG. 41 is a bottom and rear isometric view of the upper connector shown in FIG. 40.
FIG. 42 is an enlarged view of area D42 of FIG. 21.
FIG. 43 is an enlarged view of area D43 of FIG. 41.
FIG. 44 is an enlarged view of area D44 of FIG. 41.

In the stack shown in FIG. 31, the lower connector 50A is of about the same construction as connectors described in previous figures, except for modifications that allow the upper connector 50B to be stacked on it. FIG. 35 shows that the lower connector 52A has mounts 220A, 222A that project forward of the front face 86A of the insulative support. The top faces of the mounts are even with the top face 56A of the support. Each mount has a vertically-extending hole 224A, 226A. As shown in FIG. 41, the support 52B of the upper connector has positioning studs 228B, 230B that fit into the holes (224A, 226A in FIG. 35) in the mounts of the lower connector.

Figure 38:
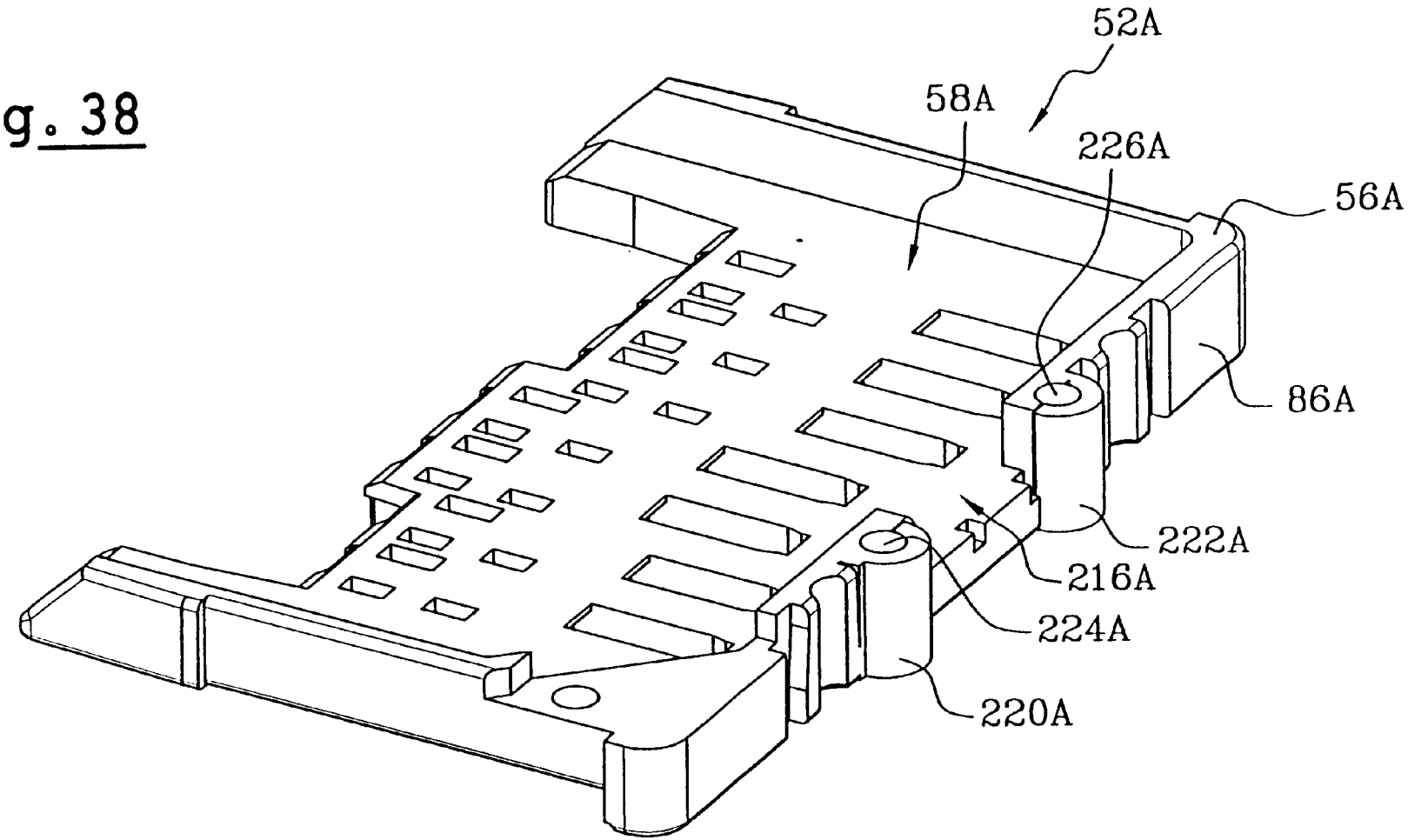
FIG. 38 is a front and top isometric view of the insulative support, without contacts, of the lowermost connector shown in FIG. 35.
Figure 39:
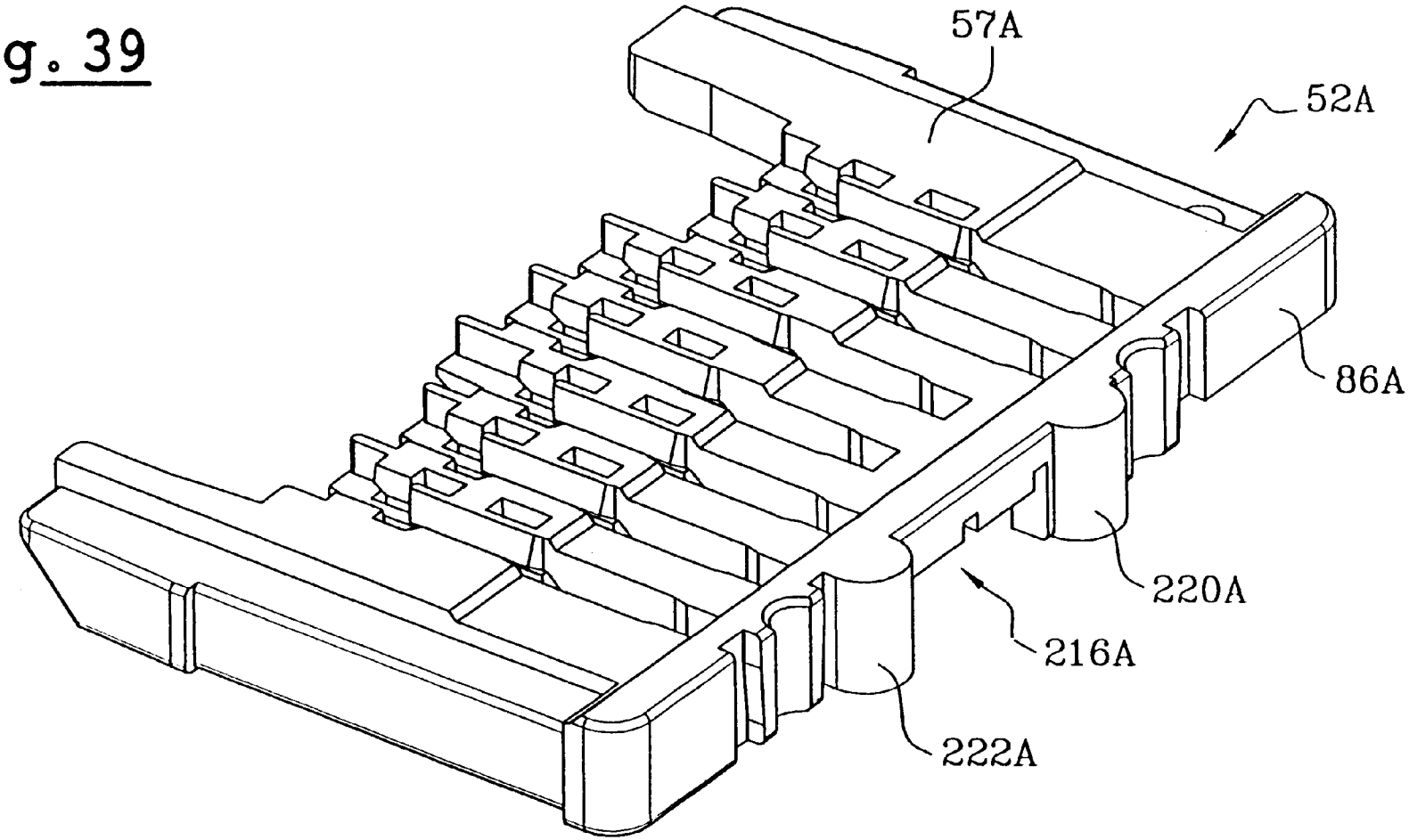
FIG. 39 is a bottom and front isometric view of the support of FIG. 38.
Figure 40:
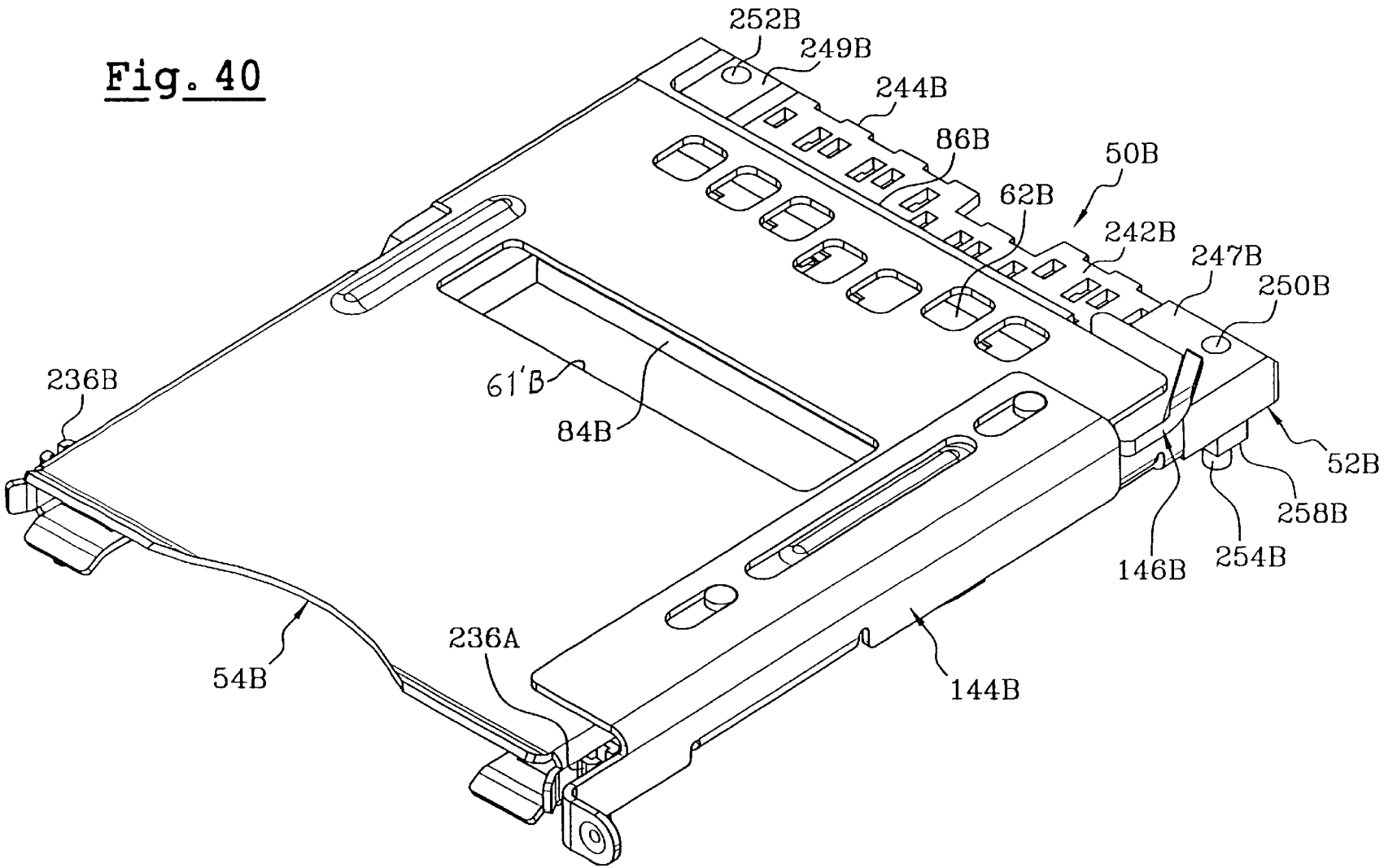
FIG. 40 is a rear and top isometric of the upper connector of the stack of FIG. 31.

As shown in FIG. 38, the forward extension of the lower connector 52A resulting from the mounts 220A, 222A is only slight. As a result, the lower connector support 52A can be used alone in cases where only a single connector is to be mounted on a circuit board.

The upper connector (FIG. 40) has a slot 61'B that lies directly over the slot 61'A (FIG. 31) in the lower connector. This allows direct viewing of solder connections of the lower connector tails, and possible soldering, through the aligned slots of the two connectors.

Figures 32, 33:
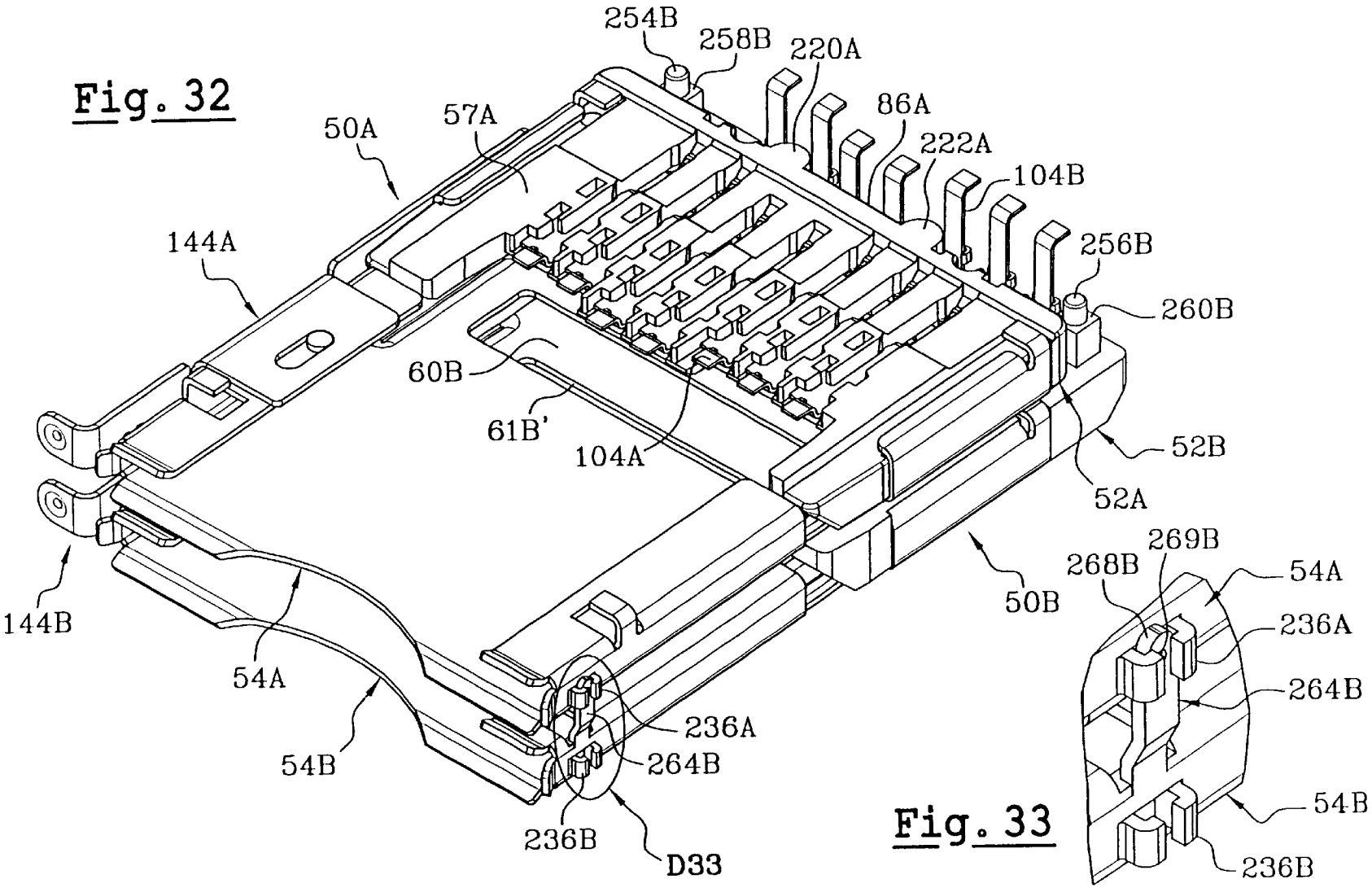
FIG. 32 is a bottom rear isometric view of the stack of FIG. 31.
FIG. 33 is an enlarged view of area D33 of FIG. 32.
Figure 34:
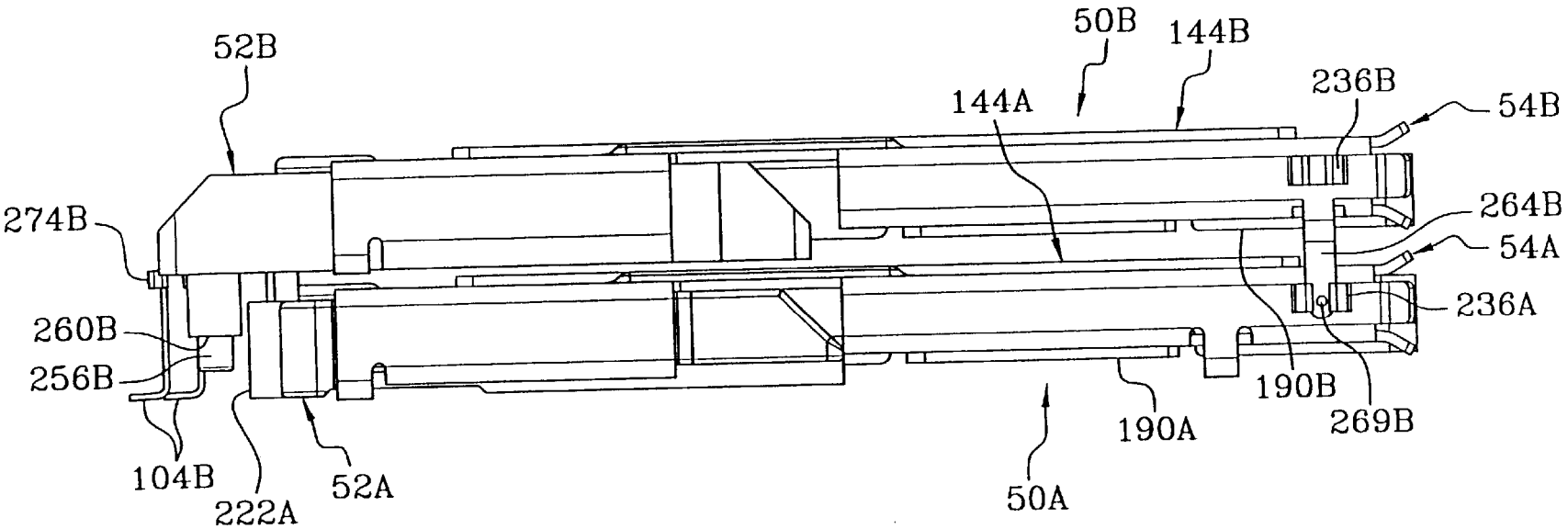
FIG. 34 is a side elevation view of the stack of FIG. 31.
Figures 36, 37:
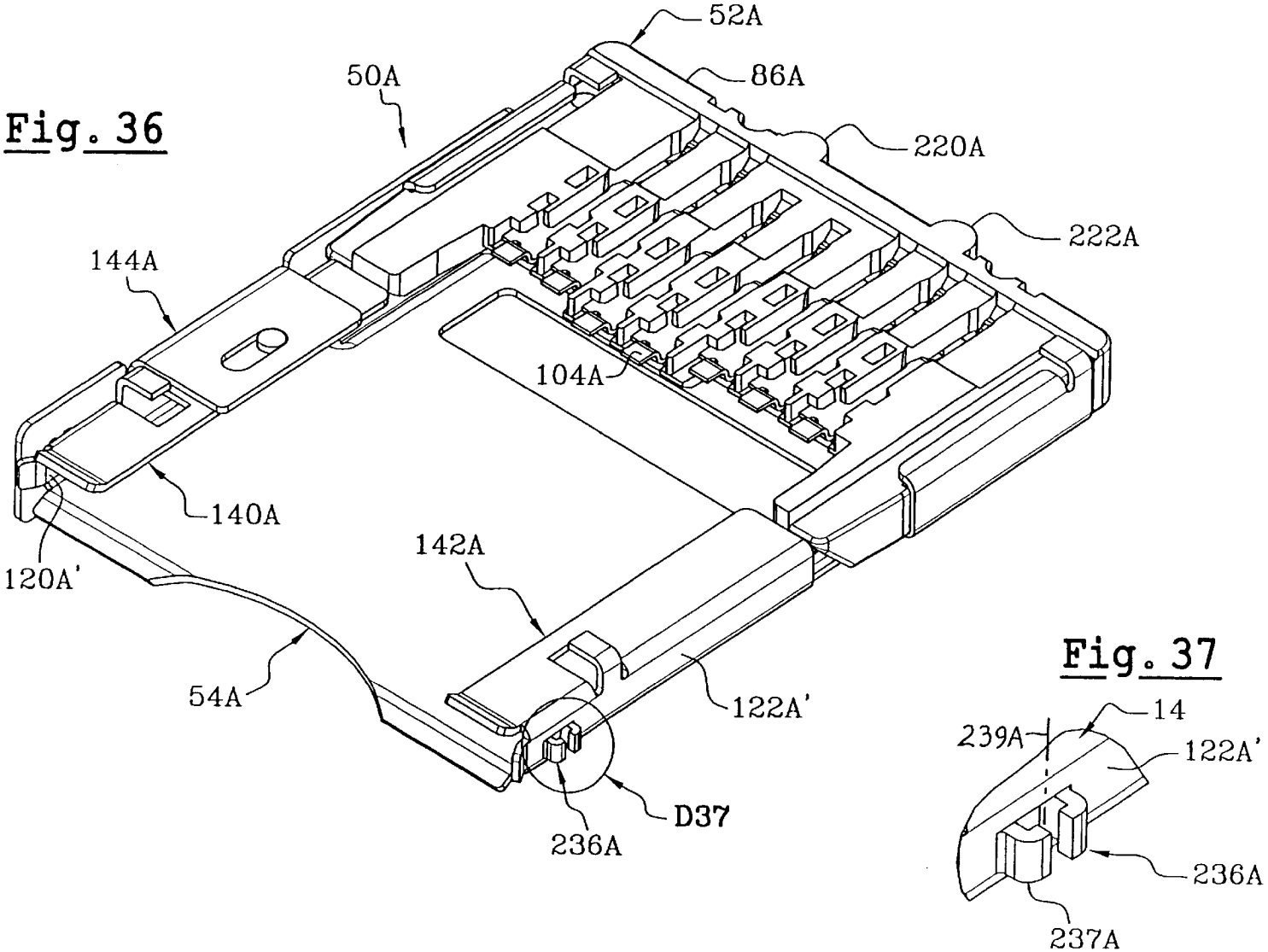
FIG. 36 is a bottom and rear isometric view of the connector FIG. 35.
FIG. 37 is an enlarged view of area D37 of FIG. 36.

FIG. 35 shows that the sheet metal cover has its sides deformed to form loops 234A, 236A at opposite sides of the rear end of the cover. As shown in FIG. 37, each loop such as 236A extends about a vertical axis 239A, and is designed to receive a prong of the upper connector. FIG. 41, which is an upside-down view, shows that the upper connector sheet metal cover forms a pair of prongs 262B, 264B. FIG. 33 shows a prong 264B of the upper connector inserted through a loop 236A of the lower connector. This assures that the rear ends of the two connectors will be aligned, the front ends being aligned by studs of the upper support that project into mount holes of the lower support. It is noted that the upper connector has loops such as 236B, which can be used to receive a prong of a still higher connector where the stack includes at least three connectors. The loops and prongs do not interfere with the ejection pusher of each connector.

The lateral dimension of each loop is such that the loops do not appreciably increase the lateral width of the cover. As a result, the cover of the lowest connector can be used even when only a single connector is required.

The prongs such as 264B (FIG. 42) not only align the connector ends, but also provide electrical grounding connections between the upper and lower sheet metal covers. Each prong such as 264B has a projection 269B at its end, beyond a shoulder 272B. The projection on one connector can abut sheet metal at the middle of the loop at the other connector to serve as a stop that limits vertical insertion of the prong. The stop also helps prevent vibration.

Figure 45:
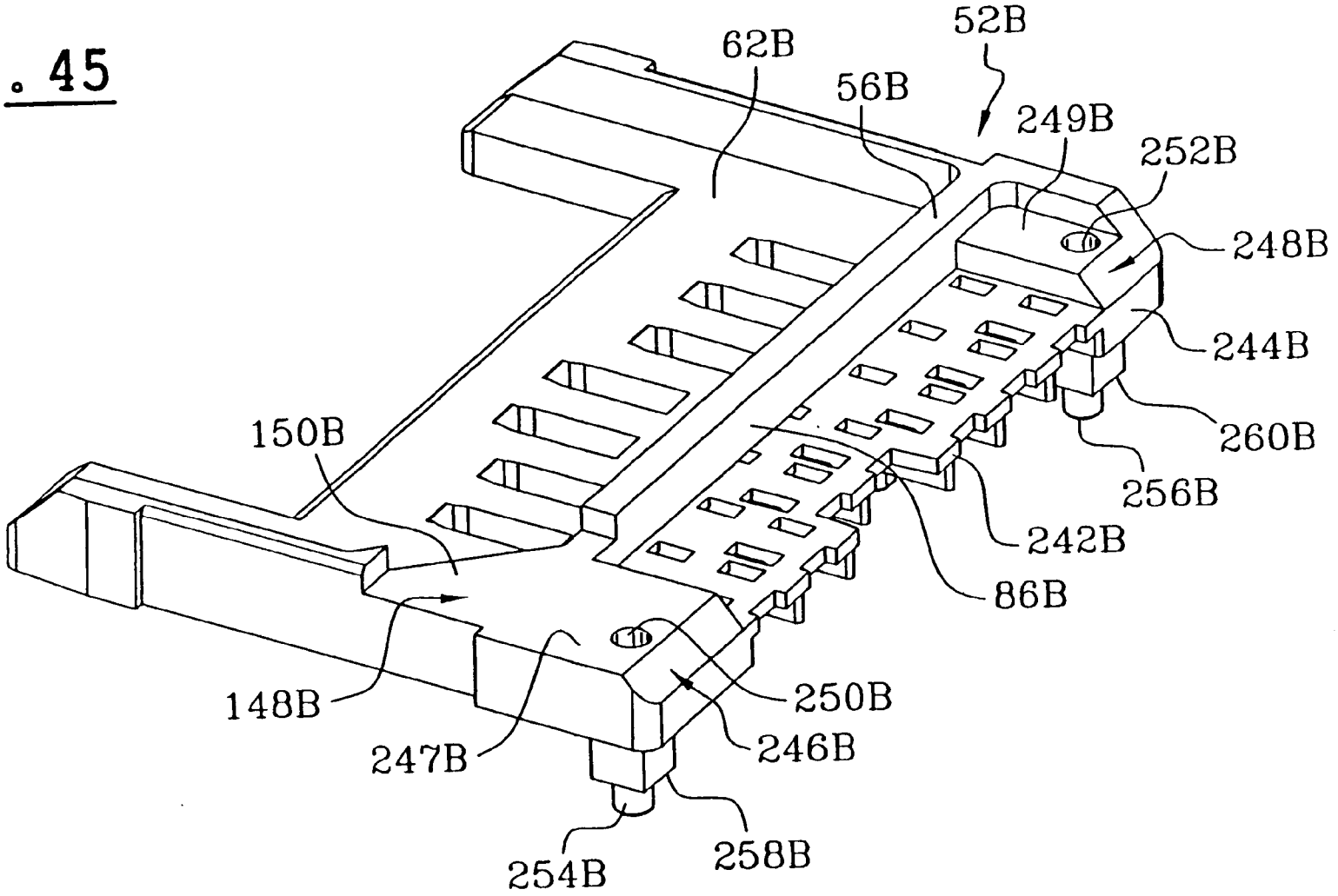
FIG. 45 is a top and front isometric view of the insulator of the upper connector of FIG. 41.

FIG. 45 shows that the support 52B of the upper connector has a plate-shaped front extension 242B whose surface is at the same level as the upper face 62B that forms the bottom of a cavity of the upper connector. FIG. 41 shows that the contacts of the upper connector have tails 104B that are not only tall, but that extend downwardly from the front edge of the upper support 52B. The tails have tabs at their lower ends which extend forward to about the front surface (244B in FIG. 45) of the upper support. This minimizes the forward extension of the connector.

Figure 46:
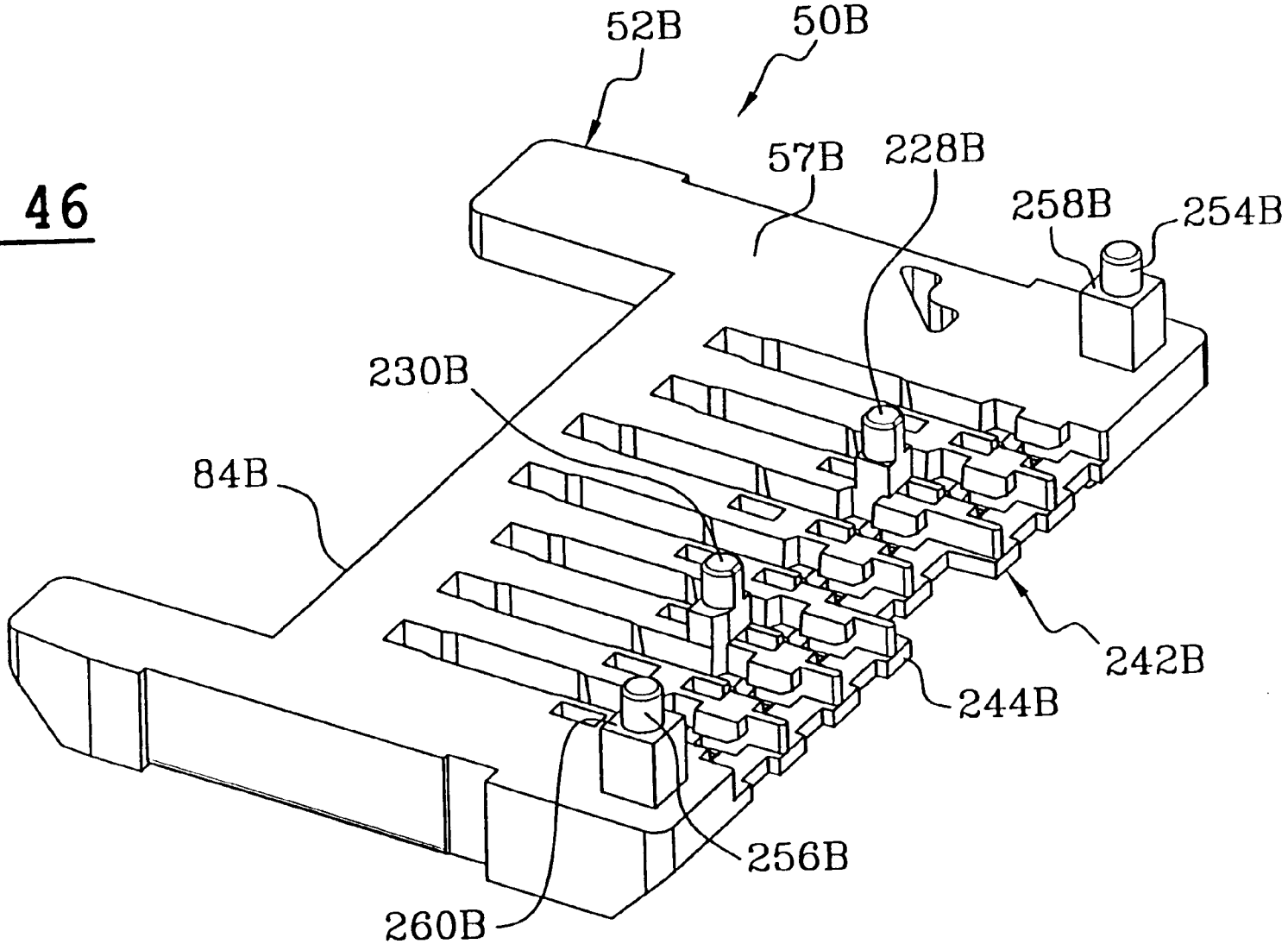
FIG. 46 is a bottom and front isometric view of the support of the FIG. 45.

FIG. 45 shows that the insulative support 52B of the upper connector has thickened opposite sides 246B, 248B that have upper faces 247B, 249B. A recess 148B holds an ejection lever. FIG. 46 shows that the support 52B of the upper connector has a pair of vertically-extending studs 228B, 230B that are intended to project into holes 224A, 226A (FIG. 38) in the mounts of the lower connector. The studs are constructed to have a slight interference fit with the holes that they are inserted into.

FIG. 41 shows that the support of the upper connector has another pair of studs 254B, 256B that are aligned with holes 250B, 252B (FIG. 45) to allow two supports of the type used in the upper connector to be stacked. Each stud (FIG. 46) has shoulders 258B, 260B to limit the insertion.

Figure 47:
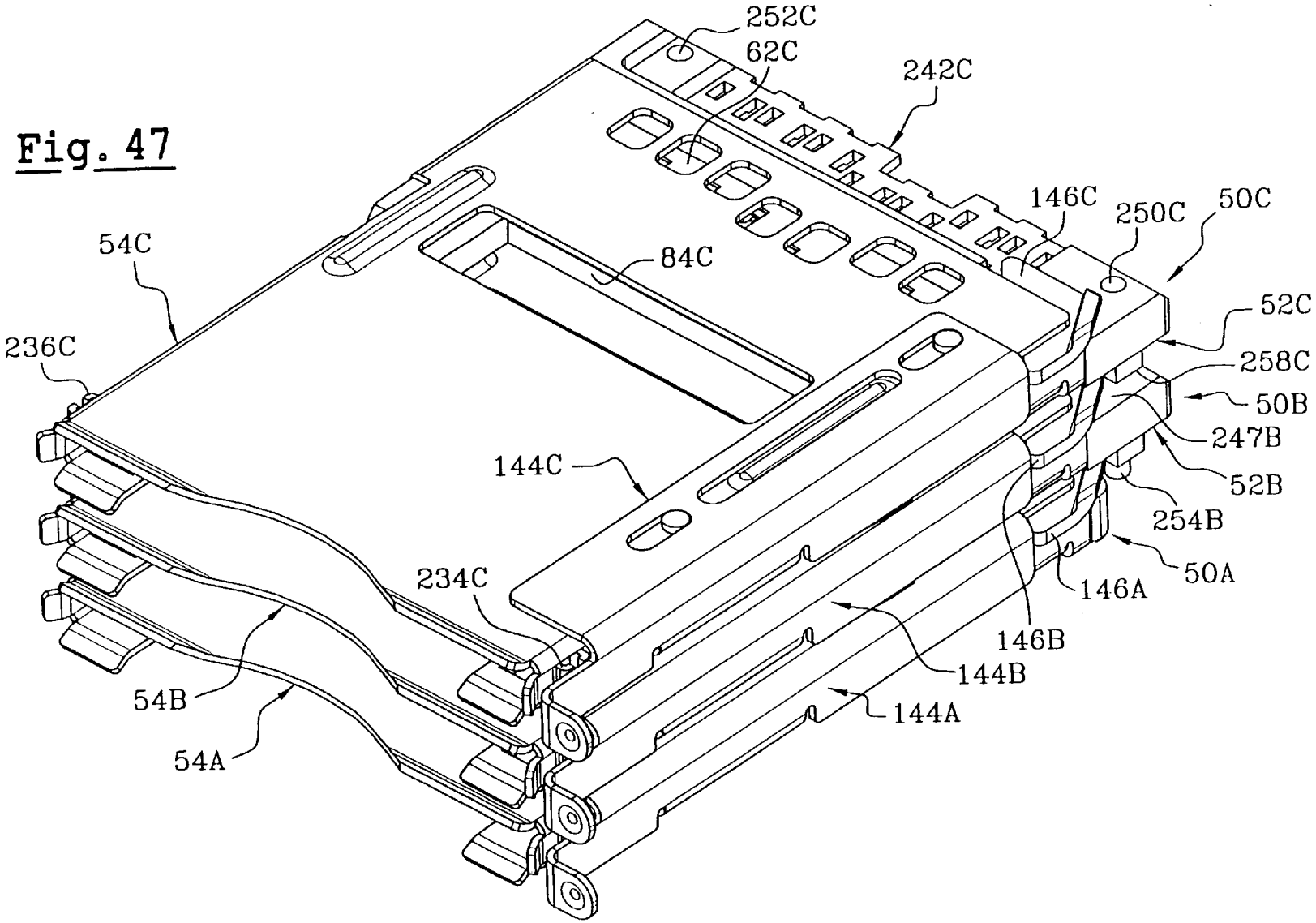
FIG. 47 is a rear and top isometric of a stack of three connectors, wherein corresponding contacts of the three connectors are connected together.
Figures 48, 49:
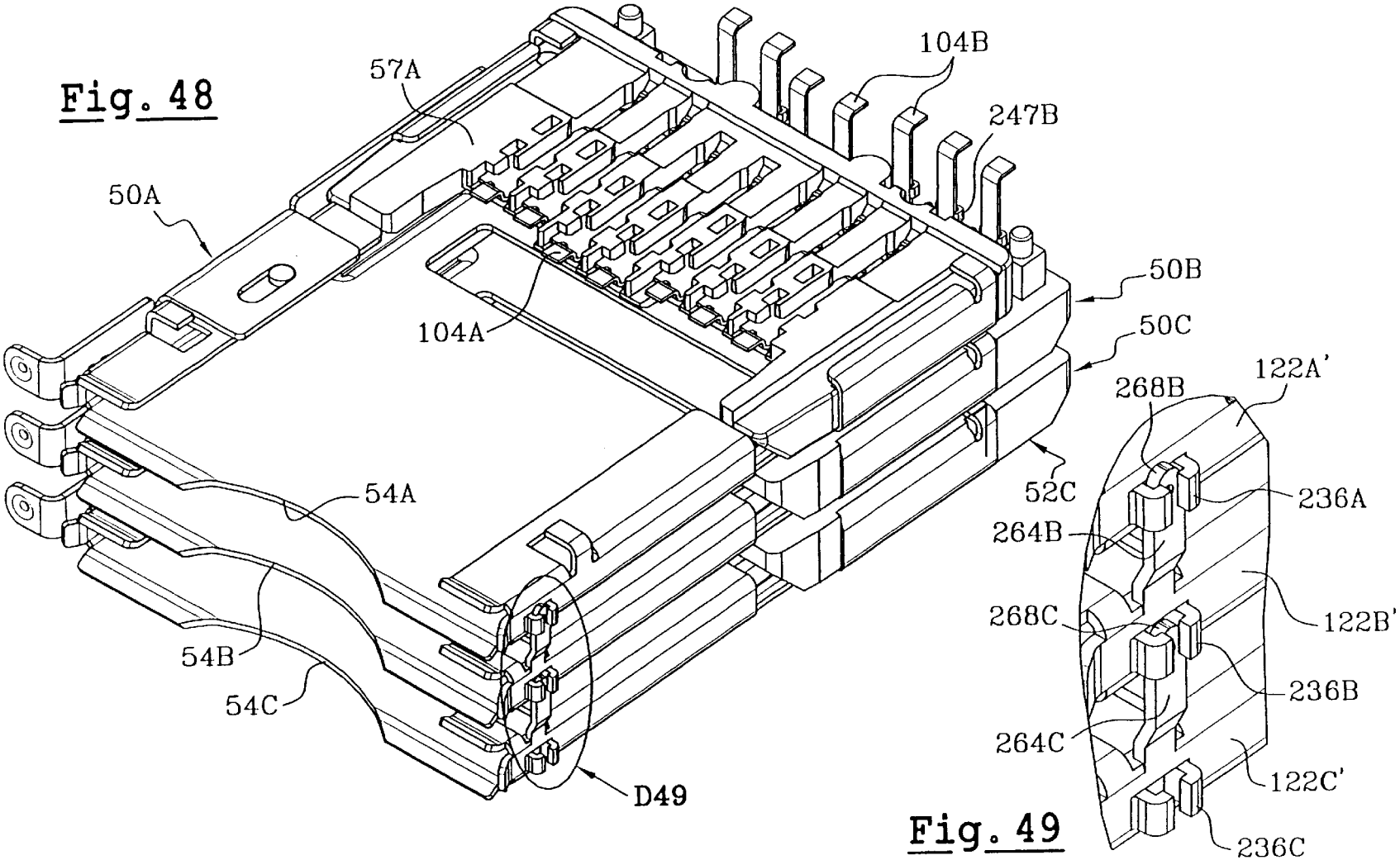
FIG. 48 is a bottom and rear isometric view of the stack of three connectors of FIG. 47.
FIG. 49 is an enlarged view of area D49 of FIG. 48.
Figure 50:
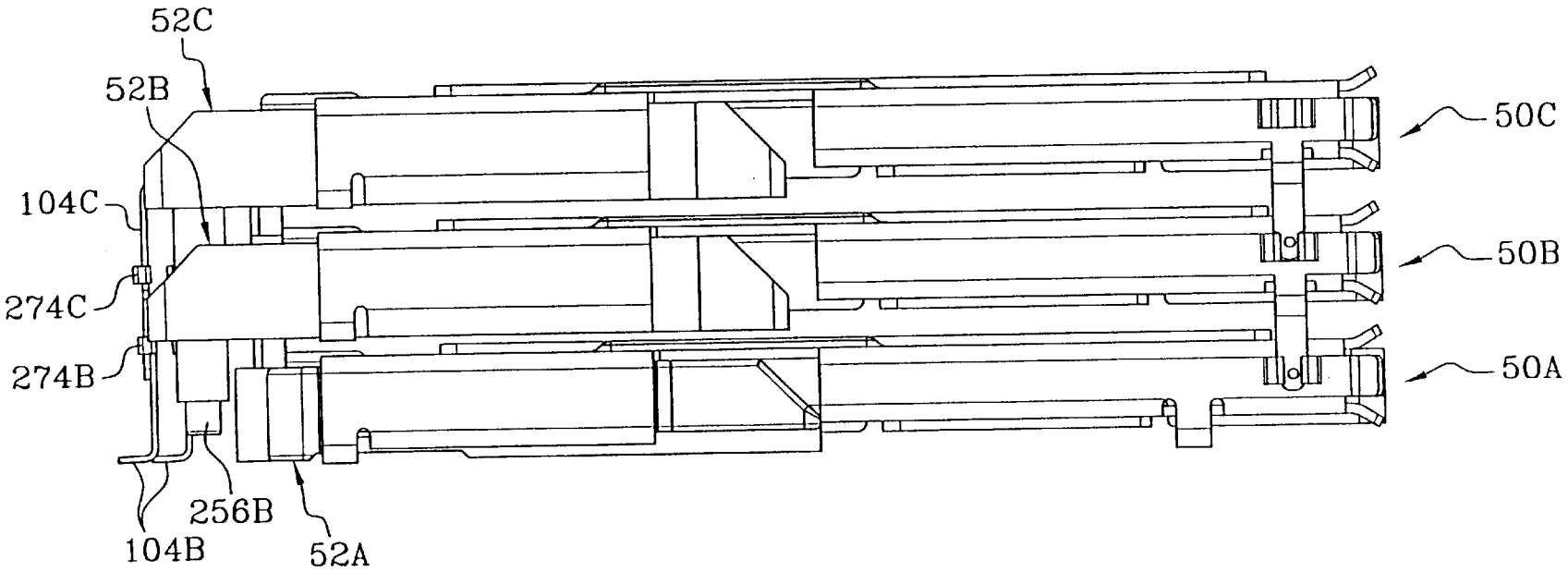
FIG. 50 is a side elevation view of the stack of three connectors of FIG. 47.

FIGS. 47–52 show a stack of three connectors. FIG. 47 shows the three connectors 50A, 50B, 50C with connector 50C being topmost. The other two connectors 50A and 50B are substantially identical to the connectors shown in the stack of FIG. 31. In the stack shown in FIG. 51, each tail 104C of the uppermost connector 50C is connected to a corresponding tail of each of the other two connectors 50A, 50B. In MultiMediaCard System Specification Version 2.11 Official Release @ June, 1999 MMCA, an architecture is described which requires all the conducting pads of the same row on several MMC cards to be connected together. Also, the architecture requires data to be exchanged with each of the cards in a "BUS" arrangement controlled by a BUS master circuit for MMC cards. The arrangement of FIG. 51 connects each corresponding contact of the three connectors without requiring a separate BUS.

Figures 51, 52:
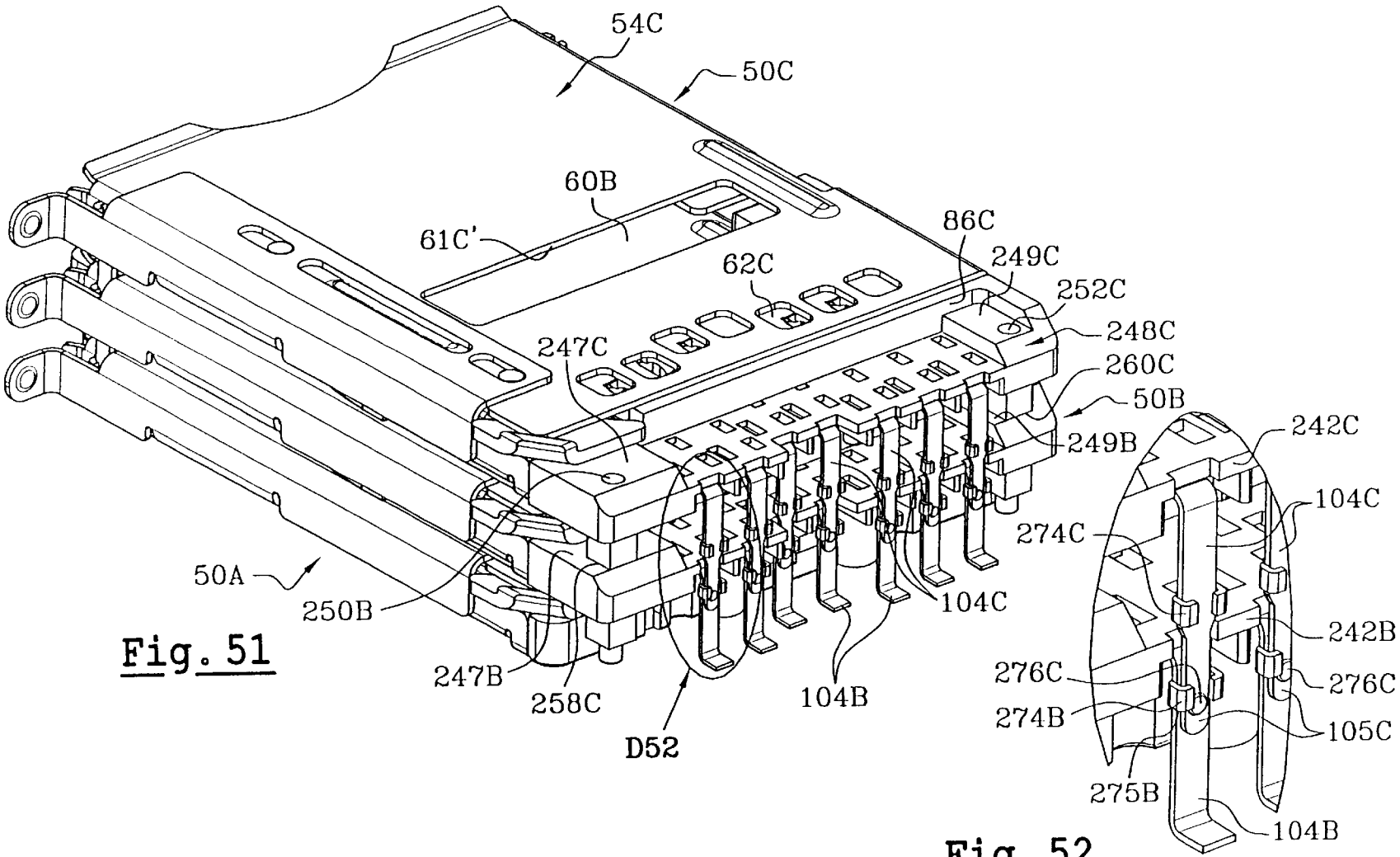
FIG. 51 is a front and top isometric view of the stack of three connectors of FIG. 47.
FIG. 52 is an enlarged view of area D52 of FIG. 51.
Figure 54:
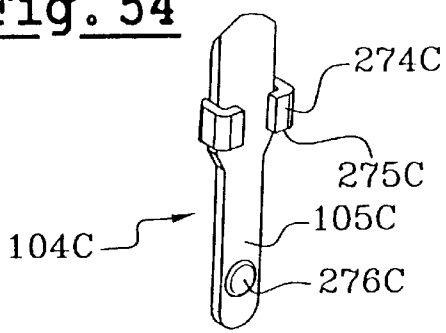
FIG. 54 is an enlarged view of area D54 of FIG. 53.
Figure 53:
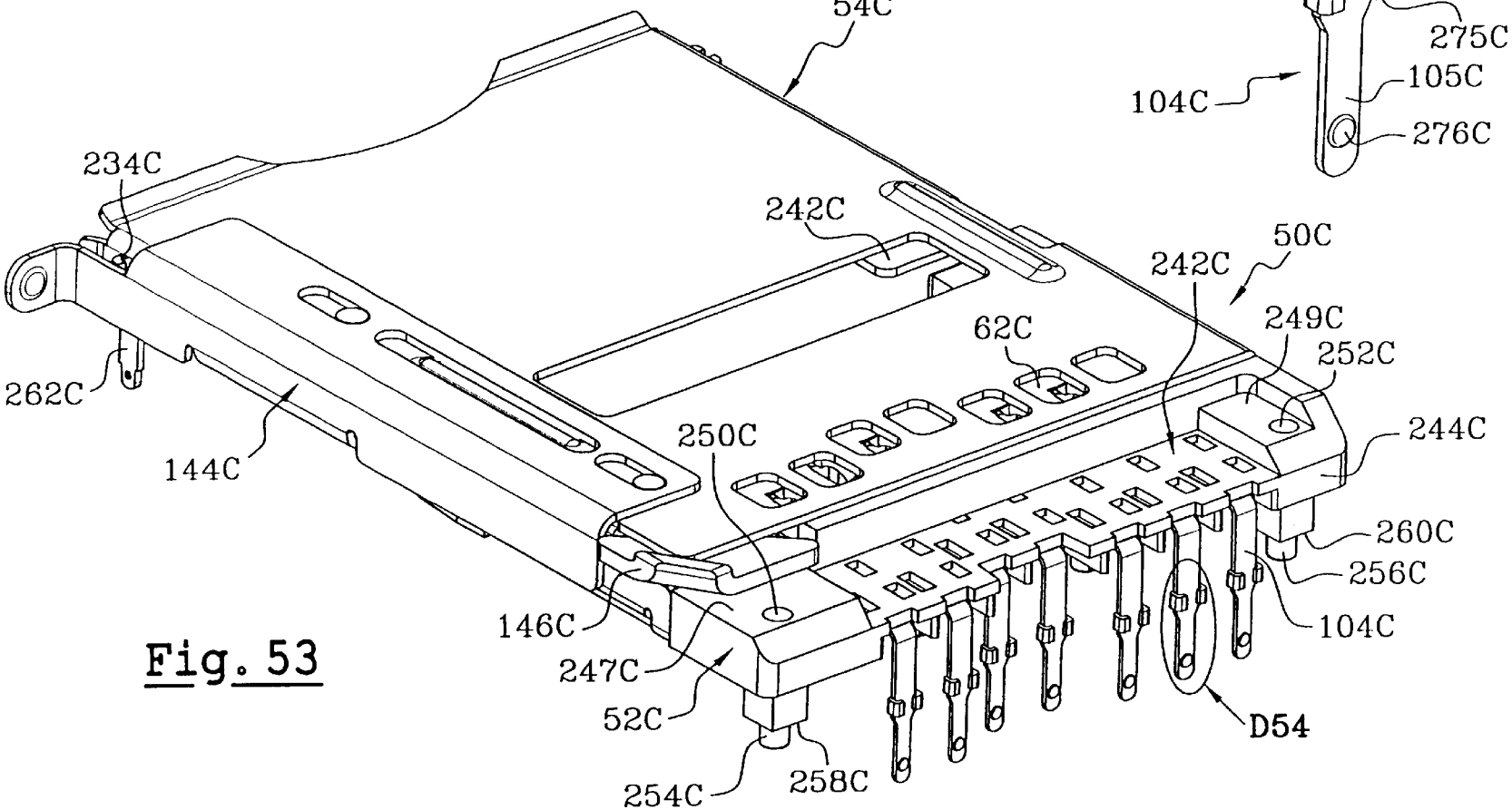
FIG. 53 is a front and top isometric view of the uppermost connector of the stack of FIG. 47.
Figure 55:
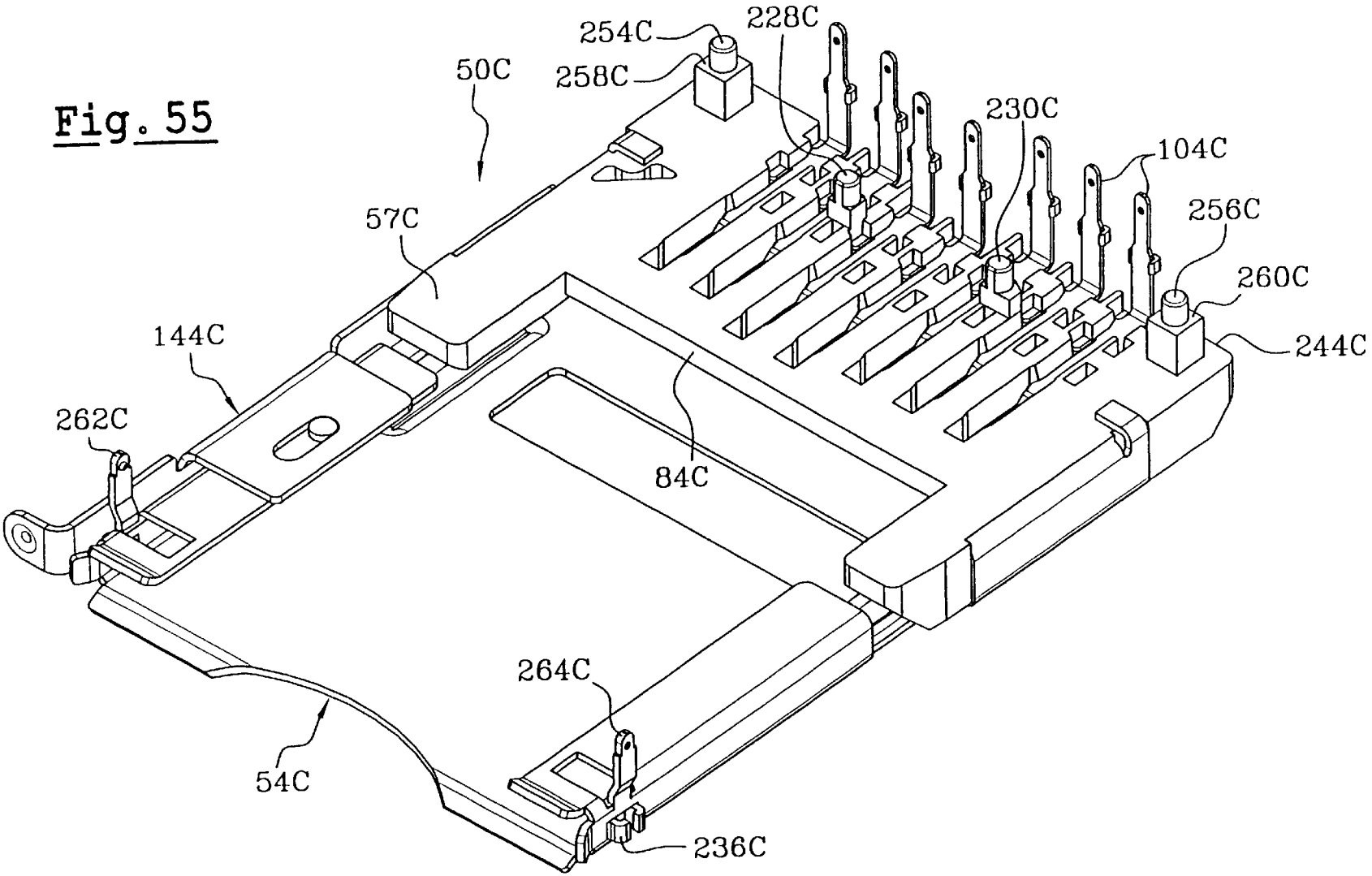
FIG. 55 is a rear and bottom isometric view of the connector of FIG. 53.

FIG. 52 shows that the tails 104C of the upper connector have lower free ends 105C, and that the tails 104B of the middle connector are formed with loops 274B into which the upper tail lower ends 105C are inserted. The middle contact tails 105B extend down to the circuit board and are soldered thereto. It is noted that the upper tails 104C have loops 274C formed therein, which can be useful in the event that a fourth connector is mounted on the third one. The lower face 275B of each loop 274B forms a stop face for a protruding boss 276B formed on the lower end of the uppermost or third connector.

Figure 56:
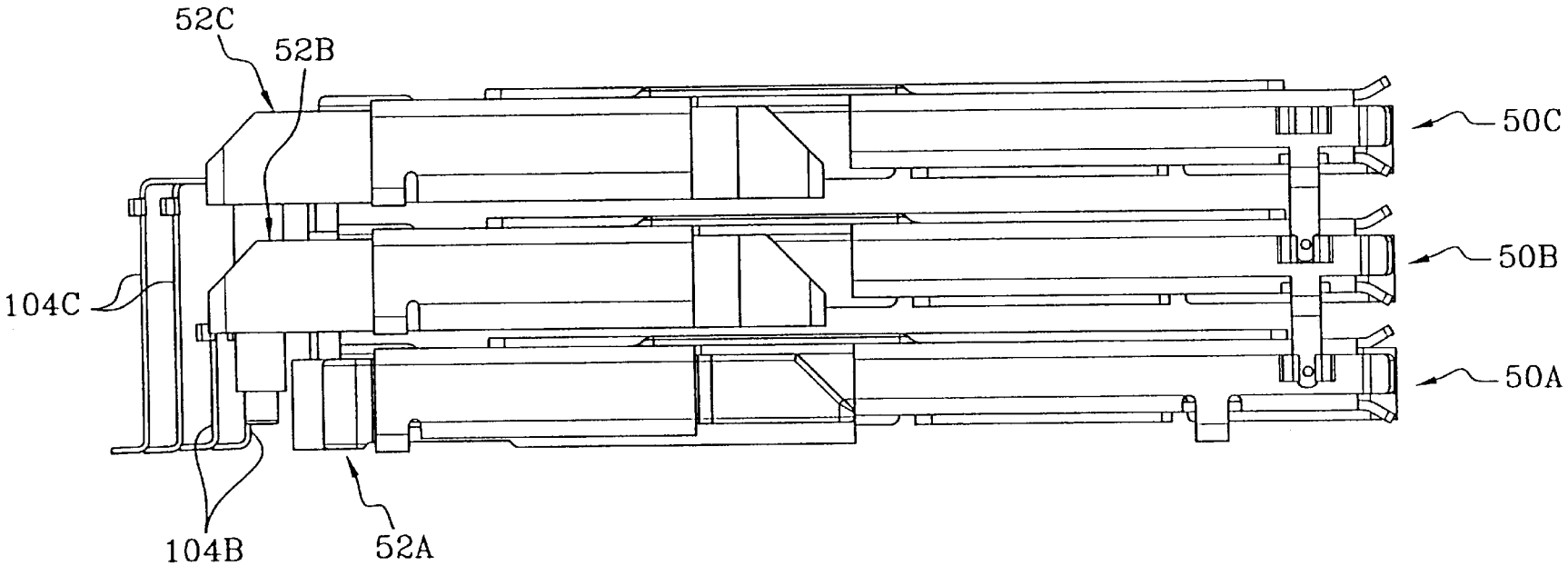
FIG. 56 is a side elevation view of a stack of three connectors of another embodiment of the invention, wherein the contacts of the connectors are connected to different circuit board traces.
Figures 57, 58:
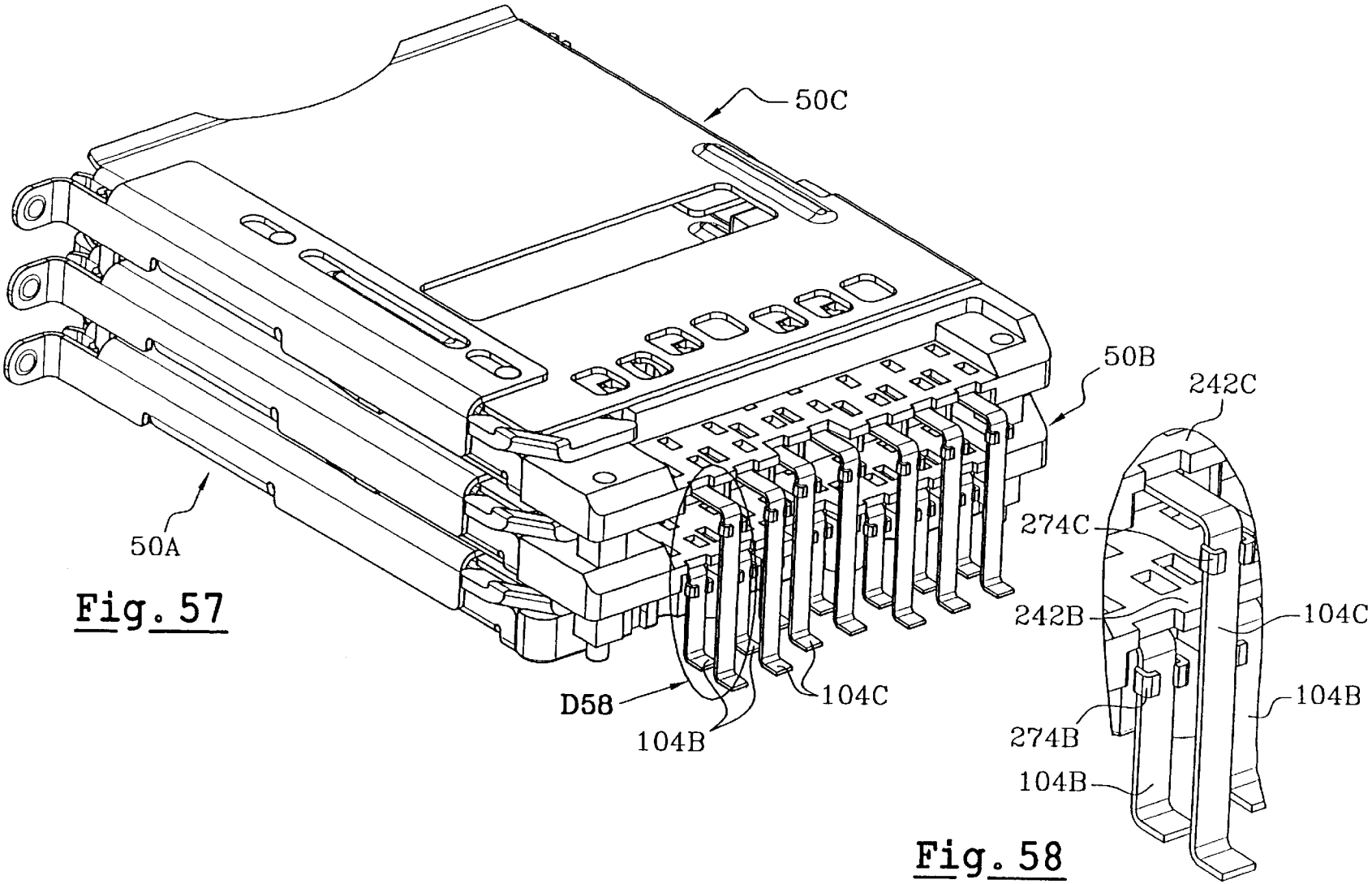
FIG. 57 is a front and top isometric view of the stack of FIG. 56.
FIG. 58 is and enlarged view of area D58 of FIG. 57.

FIGS. 56–58 show that is possible to form each connector with contacts having independent contact tails. Thus, FIG. 56 shows independent contact tails 104C of the uppermost connector and independent contact tails 104B of the middle connector. The tails of the lowermost connector lie at the rear end of the lowermost insulative support.

Figures 59, 60:
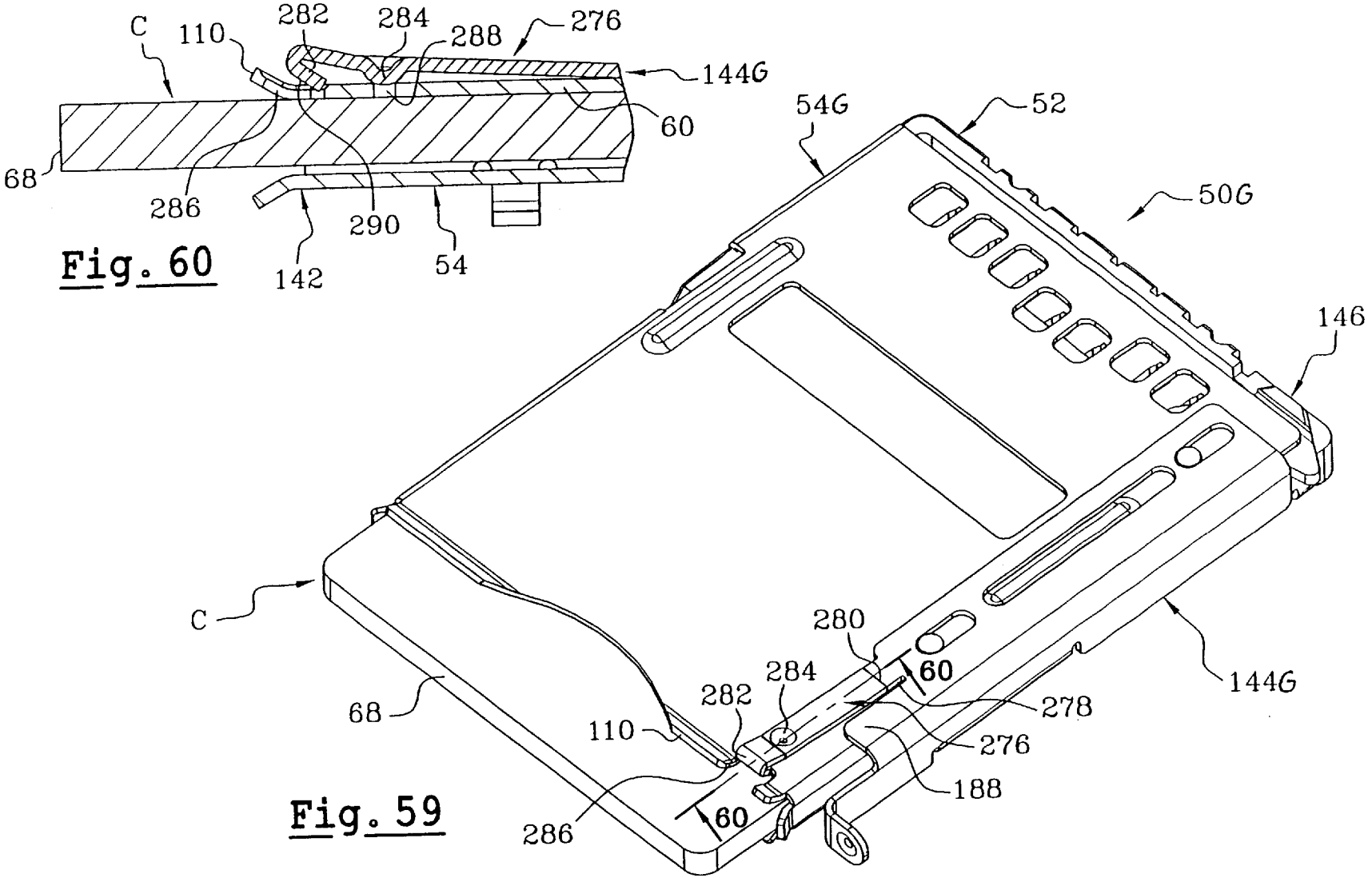
FIG. 59 illustrates a connector of another embodiment of the invention wherein the ejection pusher has a lip for retaining a fully inserted card, and showing a card only partially inserted and the pusher in its forward pushed position.
FIG. 60 is a view taken on line 60—60 of FIG. 59.
Figure 61:
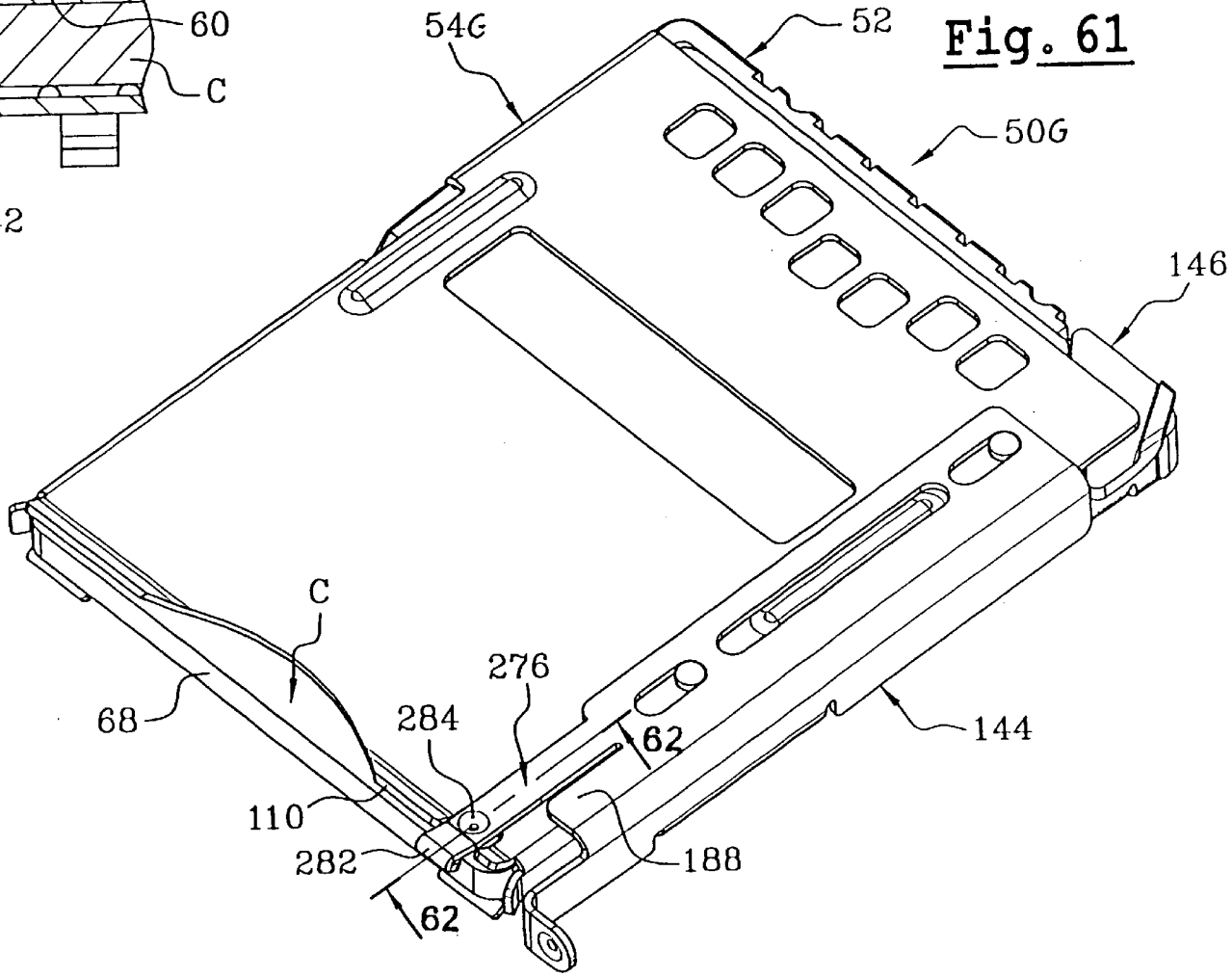
FIG. 61 is view similar to that of FIG. 59, but with the card being fully inserted and the pusher having been moved to its rearward position.
Figure 62:
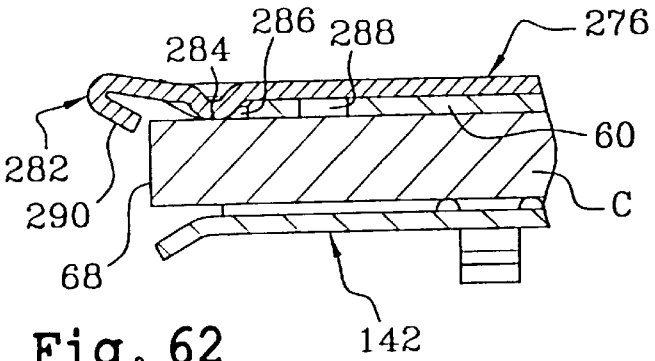
FIG. 62 is a view taken on line 62—62 of FIG. 61.
Figure 63:
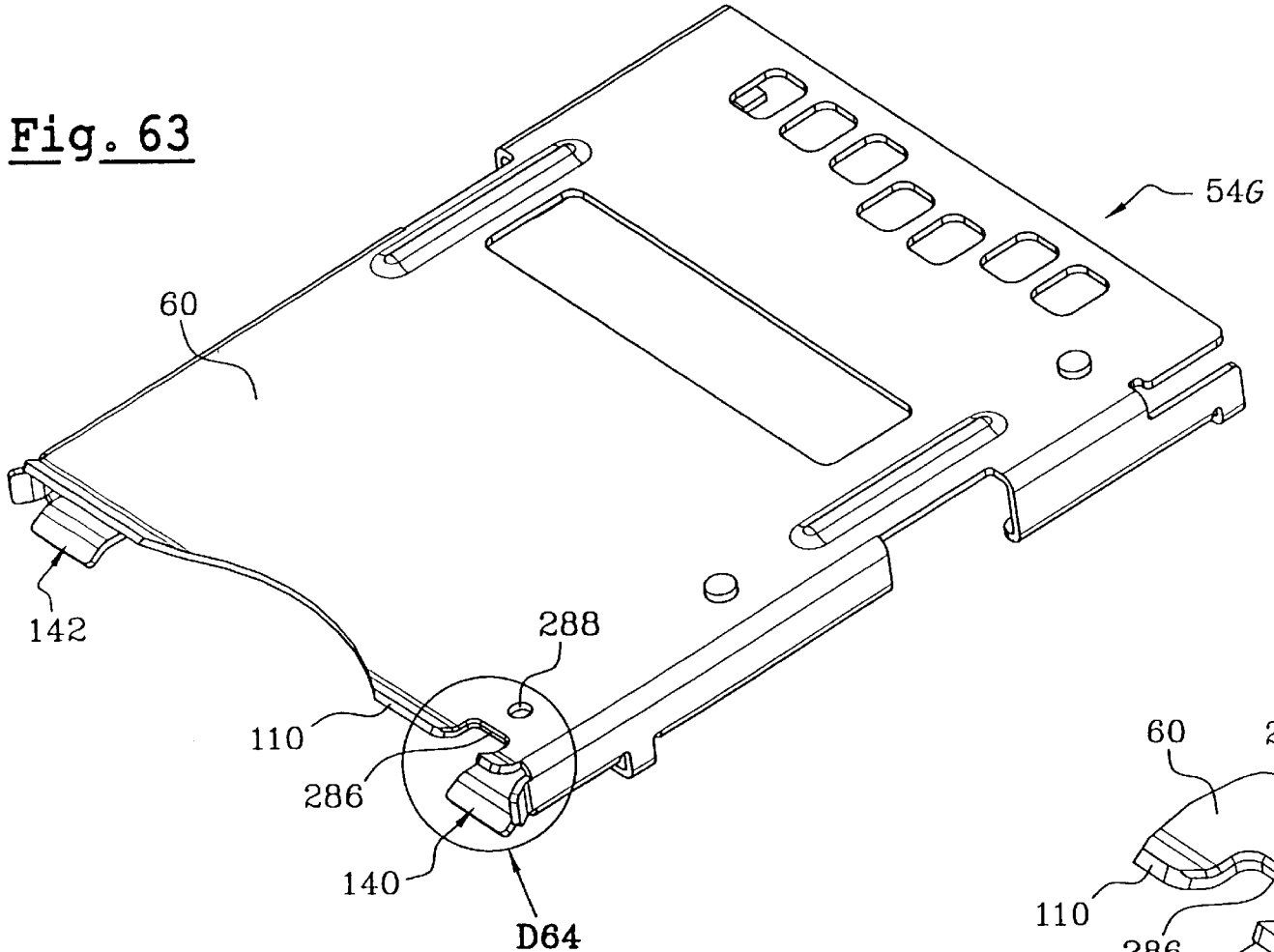
FIG. 63 is a rear and top isometric view showing only the sheet metal cover of the connector of FIGS. 59–62.
Figure 64:
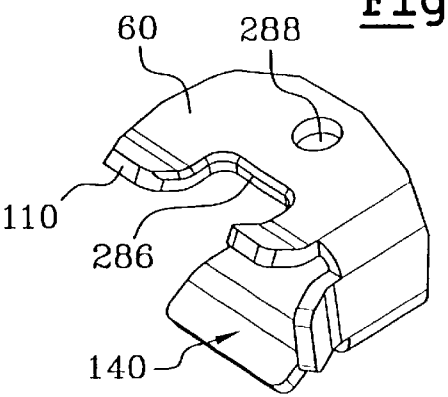
FIG. 64 is an enlarged view of area D64 of FIG. 63.
Figures 65, 66:
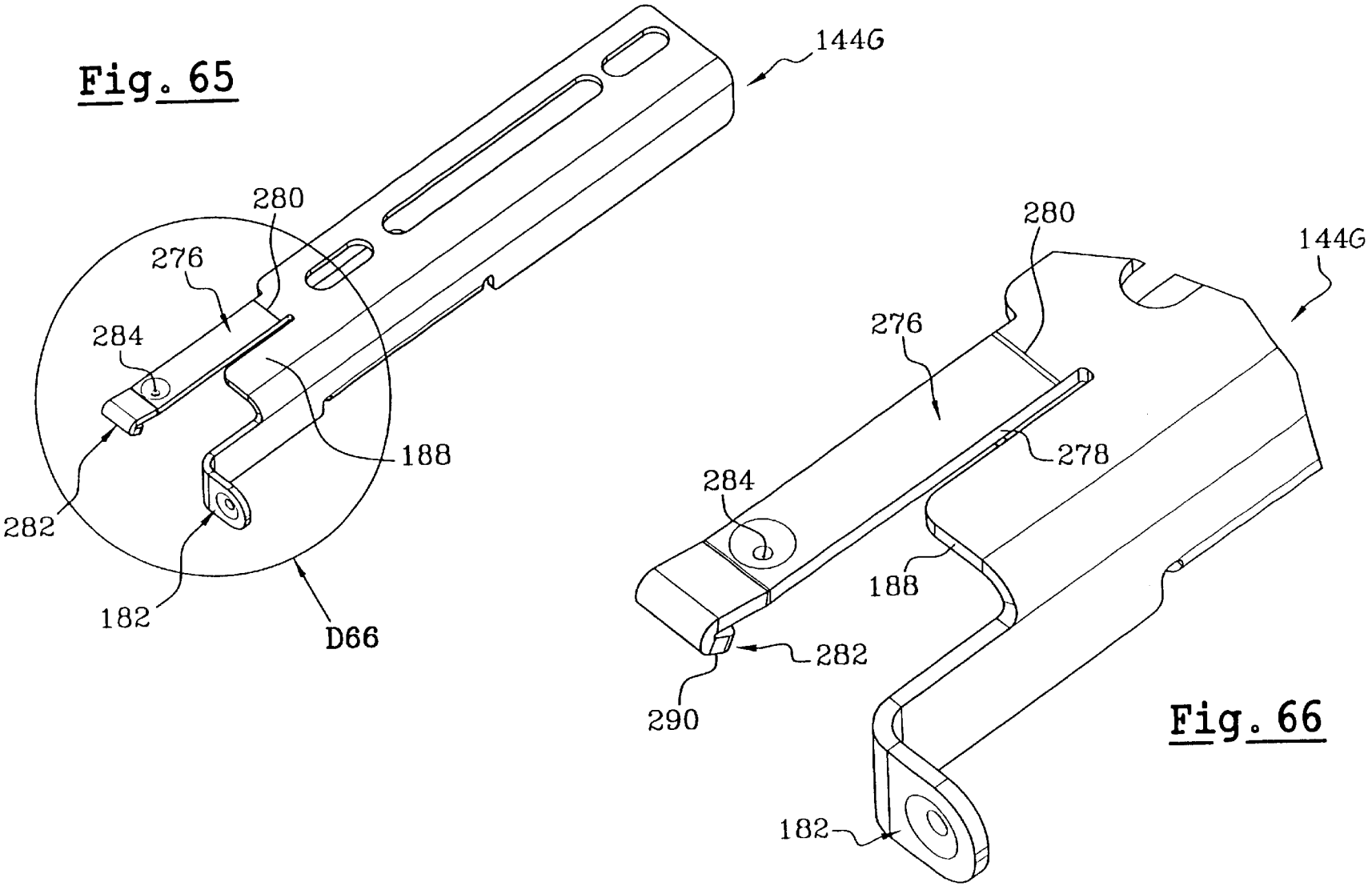
FIG. 65 is a top and rear isometric view of the ejection pusher of the connector of FIGS. 59–64.
FIG. 66 is an enlarged view of area D 66 of FIG. 65.
Figures 67, 68:
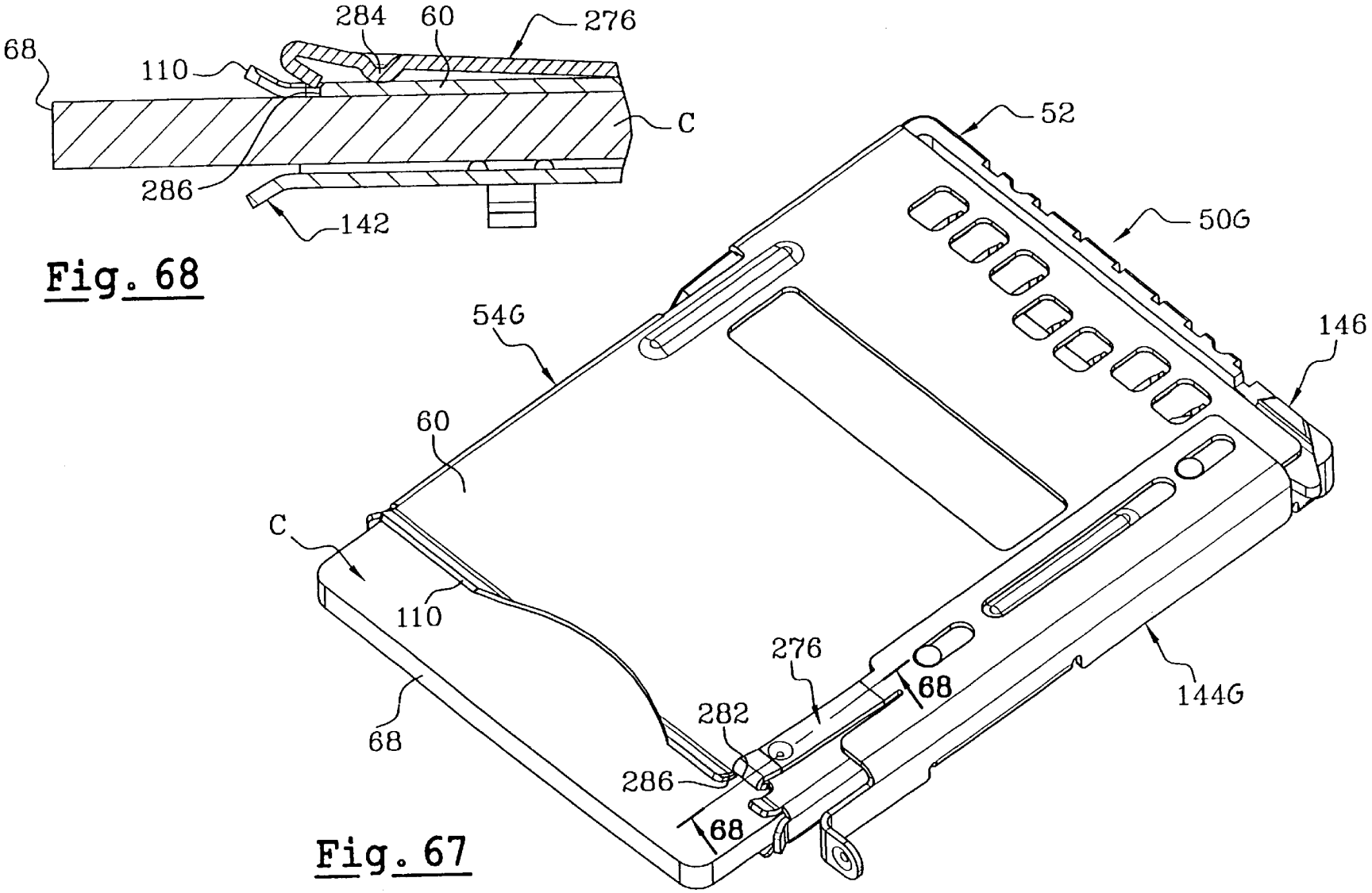
FIG. 67 is a top and rear isometric view of a connector of another embodiment of the invention, wherein the ejection pusher has a lip for retaining a fully inserted card, the card being shown partially inserted and the pusher being shown in its forward position, the card retaining lip being modified from that of FIG. 61.
FIG. 68 is a view taken on line 68—68 of FIG. 67.
Figure 69:
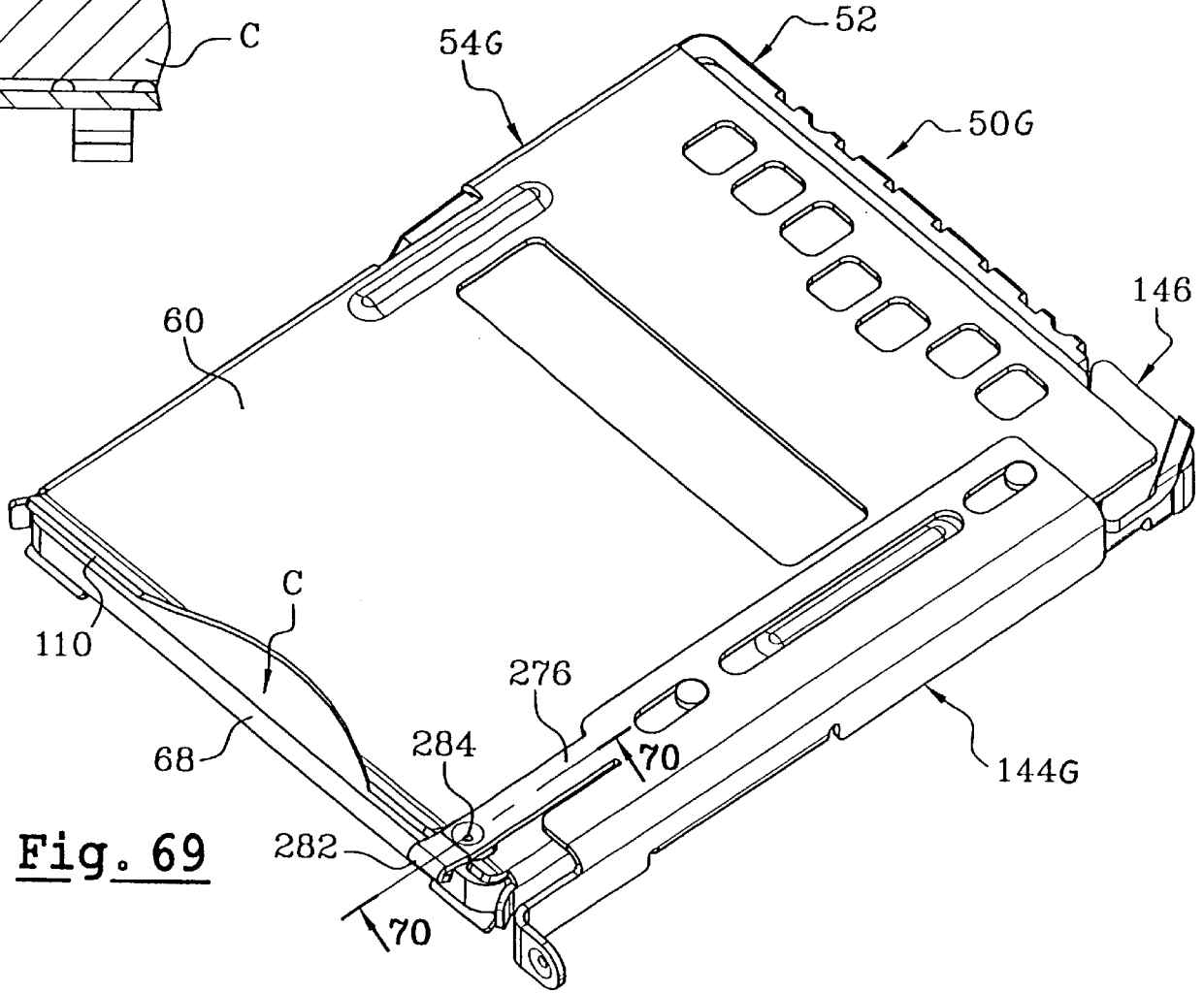
FIG. 69 is a view similar to that of FIG. 67, but with the card being fully inserted and the ejector mechanism lying in its rearward position.
Figure 70:
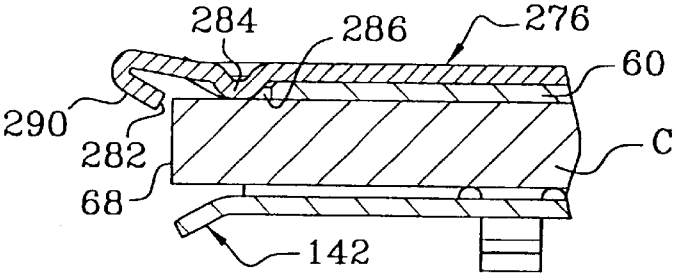
FIG. 70 is view taken on line 70—70 of FIG. 69.
Figure 71:
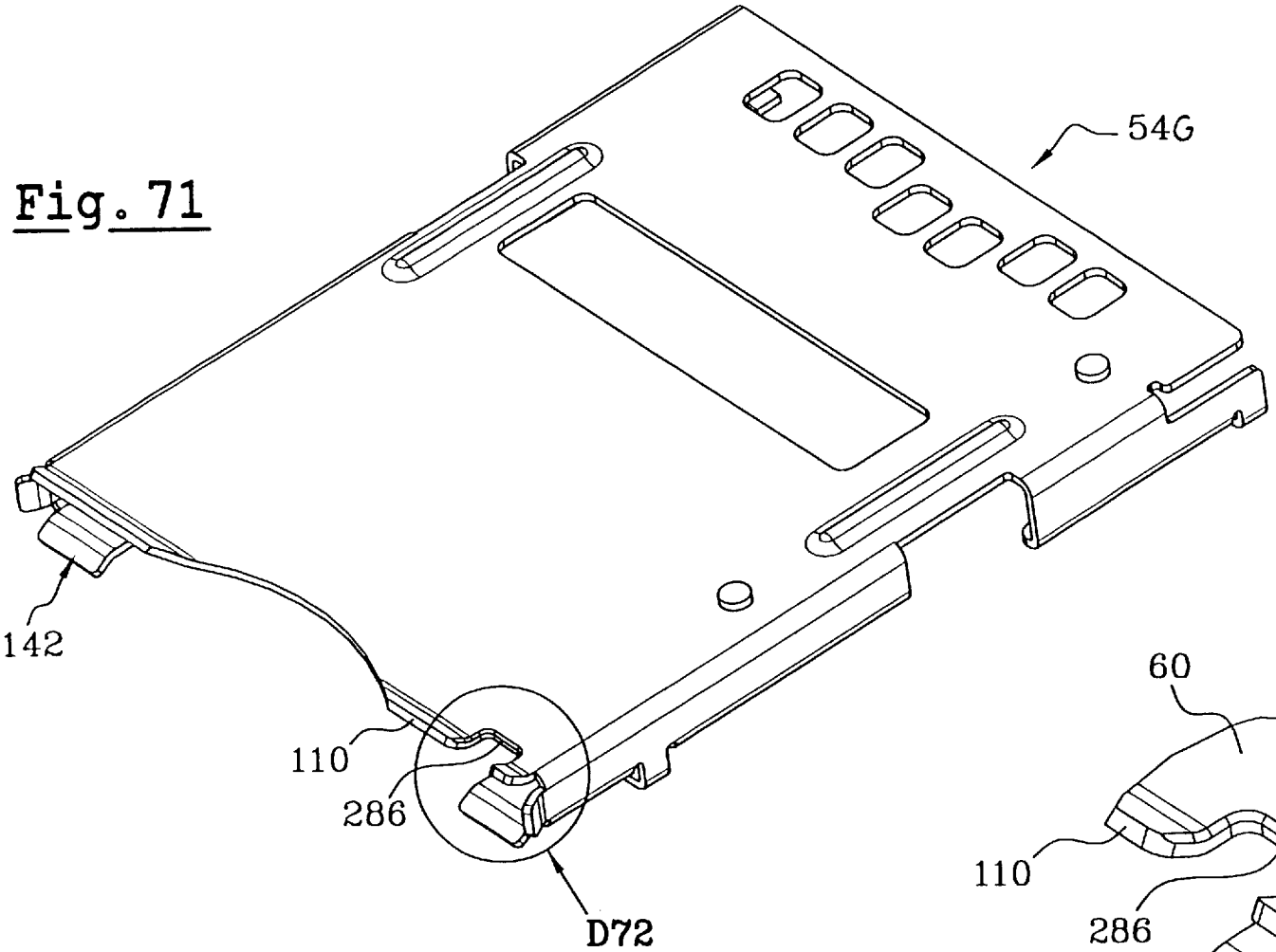
FIG. 71 is a rear and top isometric view of only the cover of the connector of FIGS. 67–69.
Figure 72:
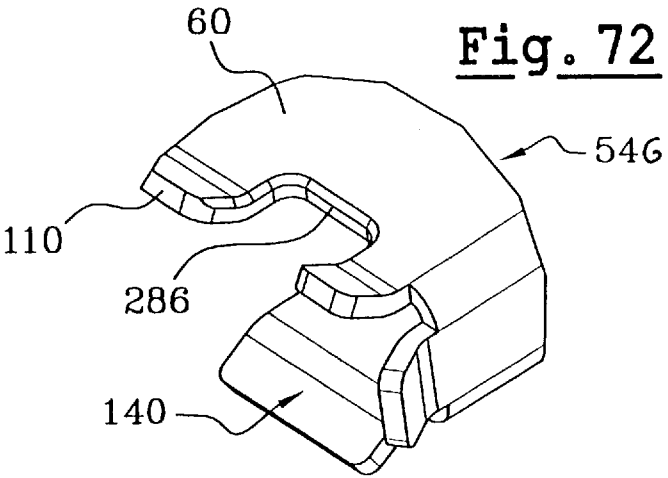
FIG. 72 is an enlarged view of area D72 of FIG. 71.

FIGS. 59–72 show a connector 50G with means for retaining a fully inserted card so it does not accidentally move rearwardly out of the fully inserted position. This is accomplished without modifying the insulative support, but with only modification to the cover 54G and the pusher 144G. FIG. 59 shows a blade 276 formed in sheet metal of the pusher 144G, by a slot 278. The blade has a bend at 280 and has a rear end forming a retention lip 282. As shown in FIG. 62, the lip 282 is a bent over rear end of the blade. Slightly forward of the lip 282, the blade has a downwardly-extending boss 284. When the card is fully inserted and the pusher is in its rearward position, as in FIG. 62, the boss 284 lies on the card and the lip 282 prevents rearward movement of the card. When the pusher is moved forward, the blade also moves forward, as to the position shown in FIG. 60. The boss 284 rides on top of the cover upper face and the lip 282 is raised and does not engage the rear end of the card. Thus, when the pusher is pushed forward, the lip moves up and the card can be ejected. A front hole 288 allows the pusher to be indexed, in that the pusher tends to remain in its forward position when moved there although forward insertion of a card will move the pusher back to its rearward position.

FIGS. 60 and 62 show that the stop lip 282 is shaped with its rear lower face 290 inclined in the manner of an insertion chamfer. Thus, when the lip is in the retain position of FIG. 62, a card can be inserted, the card lifting the lip. FIGS. 67–72 show the connector without a boss-receiving hole.

Figure 73:
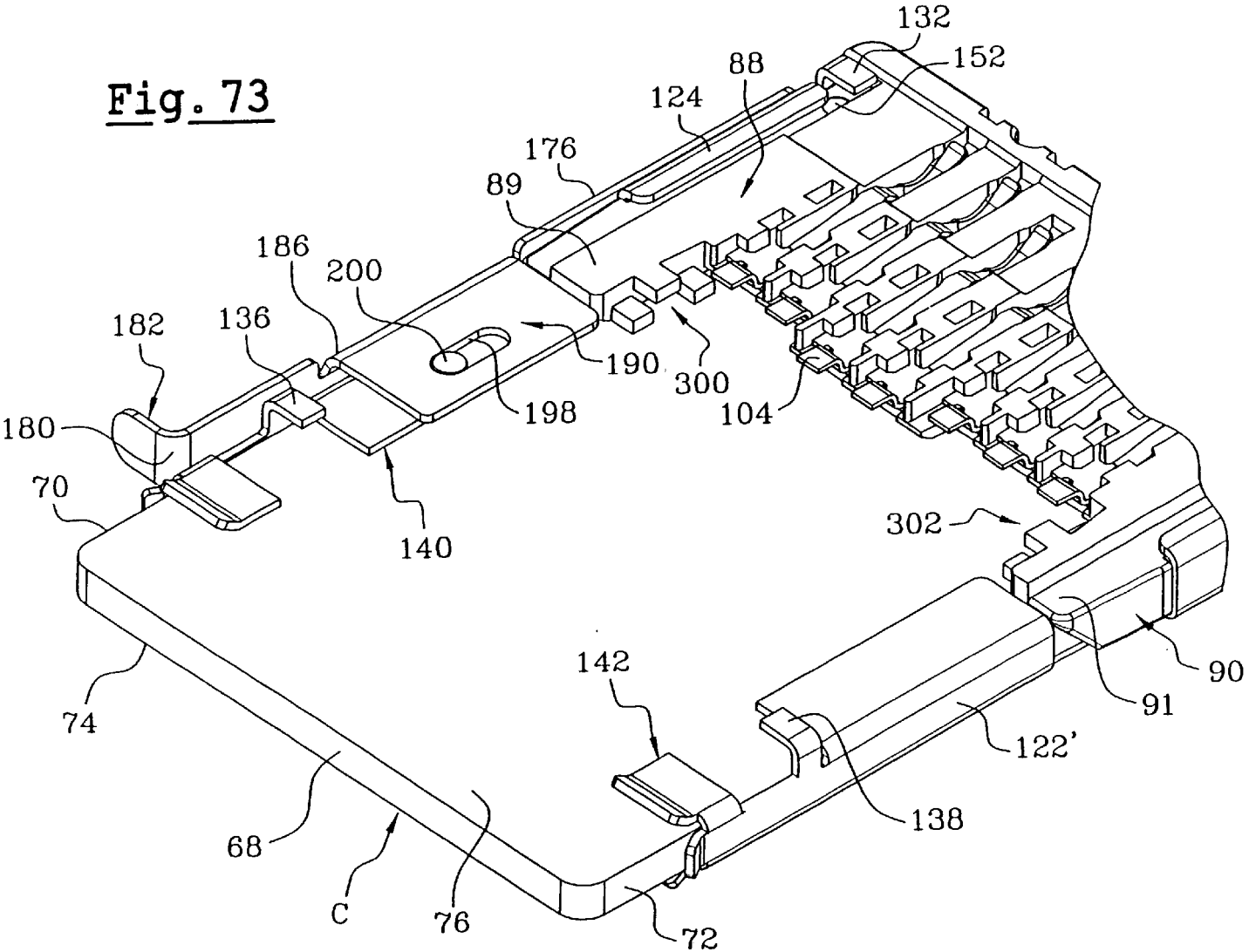
FIG. 73 is a partial bottom and rear isometric view of another embodiment of the invention, which includes a sealing and closure device for closing the front end of the card-receiving cavity when a card is not installed.
Figure 74:
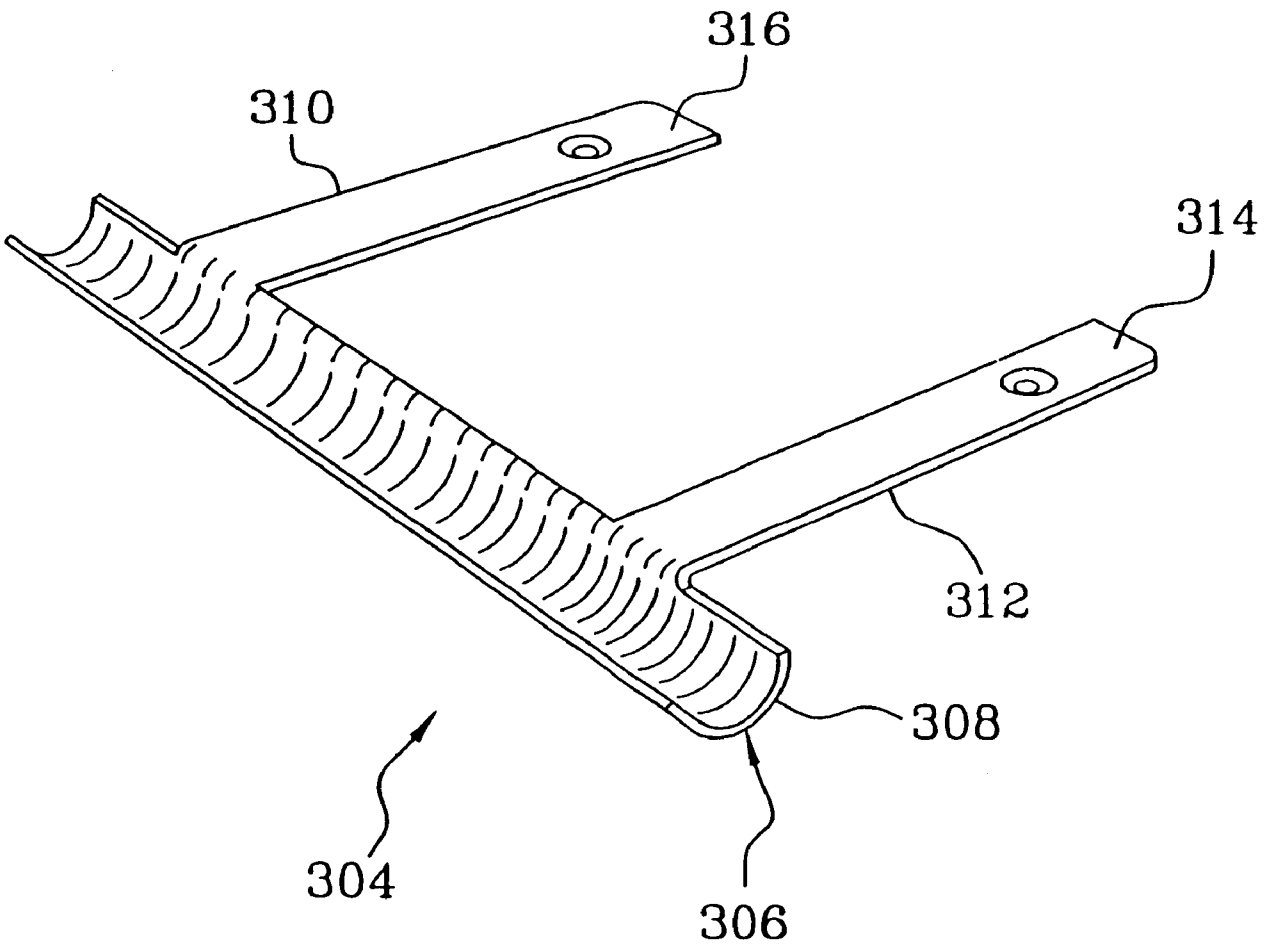
FIG. 74 is a bottom and rear isometric view of the closure device that is mounted on the connector of FIG. 73.
Figure 75:
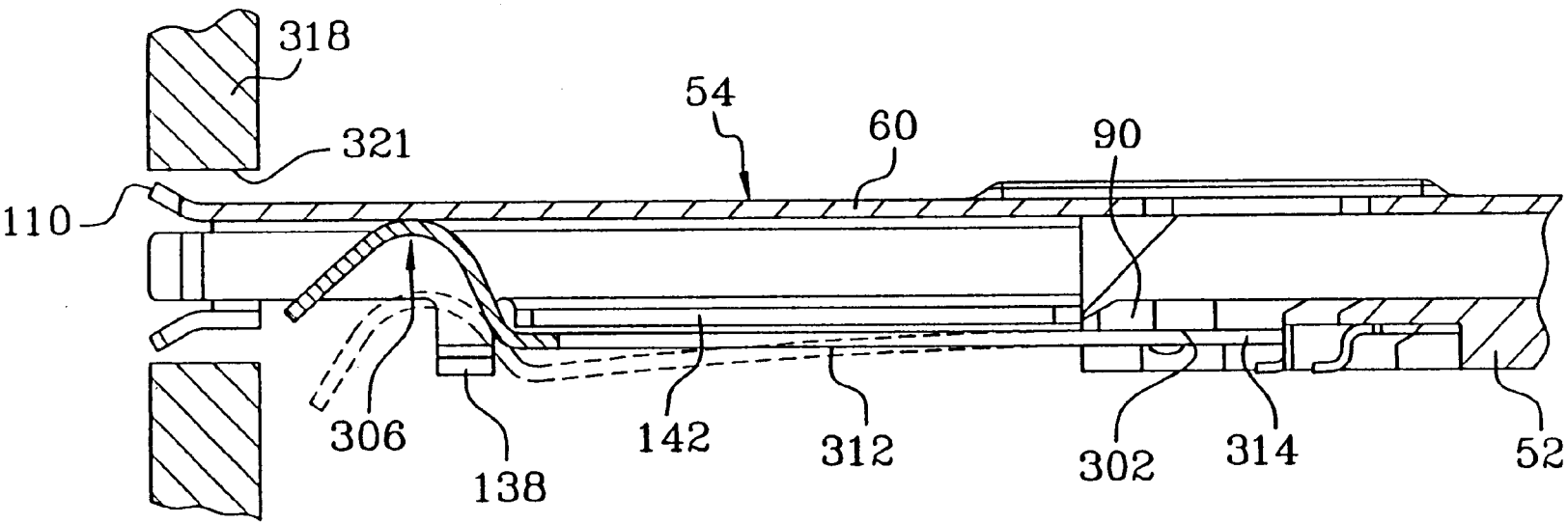
FIG. 75 is a partial side sectional view with the closure device closing the rear end of the card-receiving cavity.

It is often desirable to close the rear end of the card-receiving cavity when a card is not present, to reduce the possibility of insertion of foreign objects into the cavity. FIGS. 73–75 show a connector modified to close the rear end of the cavity, the connector being assumed to be mounted on a circuit board. FIG. 74 shows a closure device 304 in its upside-down position, the closure device having a lip 306 with an upper face 308 which is semi-cylindrically curved. As shown in FIG. 75, the lip 306 lies at the rear end of the card-receiving cavity. However, when a card is inserted, it depresses the lip to allow the card to pass by it. A recess must be provided for receiving the depressed lip.

FIG. 74 shows that the closure device has a pair of arms 310, 312. The arms are inserted into slots 300, 302 (FIG. 73). The closure device can be formed from a piece of sheet metal. FIG. 75 shows that the lip 304 can be depressed by resilient bending of the arms. The lip automatically moves downward during withdrawal of a card. FIG. 75 shows that equipment that holds the connector has a front wall 318 with a slot 321 through which the card can be inserted. A recess is provided under the rear edge of the lip.

Although terms such as "top", "bottom", "upper", etc. have been used to describe the invention as it is illustrated, it should be realized that the connector can be used in any orientation with respect to the Earth.

Thus, the invention provides an electrical connector for use with a smart card, to engage contact pads on the active face of the card. The connector includes an insulative support and a sheet metal cover with an upper portion lying above the support to form a card-holding cavity portion between them. The sheet metal cover has upper and lower portions that extend far rearward of the support, so the rear half of the cavity sides are formed solely by the cover. A card ejecting mechanism includes a pusher that can be pushed forward and a pivotally mounted lever that is pivoted by forward movement of the pusher to push the card rearwardly by a plurality of millimeters. The pusher is slidable solely in forward and rearward directions on the sheet metal cover. The pusher is preferably formed of a piece of sheet metal that straddles upper and lower portions of the sheet metal cover. The lever is pivotally mounted on the support about a vertical axis that lies rearward of the front edge of the card, with most of the lever lying in the polarizing cutout region at one front corner of the card. Upper and lower cover portions have tabs that extend at upward inclines to form leadins, the lower leadin lying above the level of the bottom of the support. The insulative support has a rear end where the contact tails lie, which is far forward of the rear end of the sheet metal, with the upper cover portion having a slot through which solder connections can be observed. A stack of connectors can be provided, with the sheet metal rear portions of the connectors aligned by one connector having projecting prongs at each side of its rear end and the other connector having loops for receiving the prongs. The lowermost connector of the stack has its contact tails at a rear edge of the support while the connector above it has contact tails at the front edge of its support. The upper connector has a slot aligned with the slot in the cover of the lower connector.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector for mounting on an upper face of a circuit board and for use with a smart card which is of generally rectangular shape and which has an active face with a front portion having contact pads thereon, said connector comprising a support of insulating material which has laterally opposite sides and front and rear ends, said support having a support upper face for lying substantially against the front portion of said card active face, said support face having opposite side portions and a main portion lying between said side portions, said main portion of said support face having a lateral width and having front and rear ends (84, 86) that are longitudinally spaced by a predetermined main portion length, and said connector including a plurality of contacts with card-engaging ends lying in a primarily laterally extending row on said support main portion and projecting above said support face, said connector including a sheet metal cover with integral cover upper and lower portions having front sections lying respectively above and below the level of said support face, wherein:

said cover upper portion has a rear section that extends rearward of said support main portion rear end by at least 25% of the length of said support main portion between its ends (84, 86), and said cover rear section forms lower rear flanges that lie under said cover upper portion, said lower rear flanges extend towards each other and lie at about the same level as said support face to guide a forwardly inserted card from a location between said cover upper and lower portion rear sections to a location between said support face and said cover upper portion;

said rear flanges extend longitudinally rearward of said support main portion rear end by a distance that is at least 25% of said length of said support main portion, said lower rear flanges extend toward each other, but with a gap between them that is about as wide as said support main portion, whereby to leave a wide open area on the circuit board;

wherein the contacts have tails lying at the rear end of said support main portion and said cover upper portion has at least one slot aligned with each said tails.

2. The connector described in claim 1 including:

a card ejecting mechanism for moving a fully forwardly inserted card rearwardly so it can be pulled out;

said ejecting mechanism including a pusher that can be manually pushed forward and a pivotally mounted lever that is pivoted by said pusher to push the card rearwardly when the pusher is pushed forward;

said pusher having a pushing edge (178) and said lever having a lever end (170) lying in the path of said pushing edge, said pusher and lever being free of direct pivotal connection to each other.

3. An electrical connector for use with a smart card which is of generally rectangular shape but with a corner of the rectangle having a polarizing cutaway, the smart card having an active face with a front portion having contact pads thereon, said connector comprising a support of insulating material which has laterally opposite sides and front and rear ends, said support having a support face for lying substantially against the front portion of said card active face, and said connector including a plurality of contacts mounted on said support for engaging said contact pads of a forwardly fully inserted card, said connector including:

a sheet metal cover that includes an upper cover portion lying above said support face to form a card-holding cavity between them;

a card ejecting mechanism for moving a fully forwardly inserted card rearwardly so it can be pulled out;

said ejecting mechanism including a pusher that can be manually pushed forward and a pivotally mounted lever that is pivoted by said pusher to push the card rearwardly when the pusher is pushed forward;

said pusher being slideable in forward and rearward directions on said sheet metal cover;

said lever is pivotally mounted about a vertical axis that lies in said polarizing cutaway of a fully inserted card;

wherein said connector is constructed to mount on a circuit board that has an upper face with conductive traces thereon; and wherein:

said support has a rear edge and said upper cover portion extends rearward of said rear edge;

said plurality of contacts have tails that lie at said rear edge and that are soldered to said circuit board traces thereat;

said upper cover portion has a slot lying over said tails, to thereby provide access for soldering.

4. An electrical connector for use with a smart card which is of generally rectangular shape and which has an active face with a front portion having contact pads thereon, said connector comprising a support of insulating material which has laterally opposite sides and front and rear ends, said support having a support upper face for lying substantially against the front portion of said card active face, said support face having opposite side portions and a main portion lying between said side portions, said main portion of said support face having front and rear ends, and said connector including a plurality of contacts with card-engaging ends lying in a primarily laterally extending row on said support main portion and projecting above said support face, said connector including a sheet metal cover with cover upper and lower portions having front sections lying respectively above and below the level of said support face, wherein:

said cover upper portion has a rear section that extends rearward of said support main portion rear end by at least 25% of the length of said support main portion between its ends, and said cover lower portion has a rear section that lies under opposite sides of said cover upper portion rear section, said cover lower portion rear section lying at about the same level as said support face to guide a forwardly inserted card from a location between said cover upper and lower portion rear sections to a location between said support face and said cover upper portion;

a card ejecting mechanism for moving a fully forwardly inserted card rearwardly so it can be pulled out;

said ejecting mechanism including a pusher that can be manually pushed forward and a pivotally mounted lever that is pivoted by said pusher to push the card rearwardly when the pusher is pushed forward;

said pusher being slideable solely in forward and rearward directions on said sheet metal cover;

said sheet metal cover includes a lower portion with a part that lies under said support;

said pusher is formed of a piece of sheet metal that has upper and lower pusher flanges lying astride said upper and lower cover portions.

5. An electrical connector for use with a smart card which is of generally rectangular shape and which has an active face with a front portion having contact pads thereon, said connector comprising a support of insulating material which has laterally opposite sides and front and rear ends, said support having a support face for lying substantially against the front portion of said card active face, and said connector including a plurality of contacts mounted on said support for engaging said contact pads of a forwardly fully inserted card, said connector including:

a sheet metal cover that includes an upper cover portion lying above said support face to form a card-holding cavity between them;

a card ejecting mechanism for moving a fully forwardly inserted card rearwardly so it can be pulled out;

said ejecting mechanism including a pusher that can be manually pushed forward and a pivotally mounted lever that is pivoted by said pusher to push the card rearwardly when the pusher is pushed forward;

said pusher being slideable in forward and rearward directions on said sheet metal cover;

said sheet metal cover includes a lower portion that lies under said support;

said pusher is formed of a piece of sheet metal that has upper and lower pusher flanges lying astride said upper and lower cover portions.

6. The connector described in claim 5 wherein:

said pusher has slots in said upper and lower pusher flanges, said slots extending in forward and rearward directions;

said upper and lower cover portions are formed with projecting portions that project into said slots to guide said pusher in sliding.

7. An electrical connector for use with a smart card which is of generally rectangular shape and which has an active face with a front portion having contact pads thereon, said connector comprising a support of insulating material which has laterally opposite sides and front and rear ends, said support having a support face for lying substantially against the front portion of said card active face, and said connector including a plurality of contacts mounted on said support for engaging said contact pads of a forwardly fully inserted card, said connector including:

a sheet metal cover that includes an upper cover portion lying above said support face to form a card-holding cavity between them;

a card ejecting mechanism for moving a fully forwardly inserted card rearwardly so it can be pulled out;

said ejecting mechanism including a pusher that can be manually pushed forward and a pivotally mounted lever that is pivoted by said pusher to push the card rearwardly when the pusher is pushed forward;

said pusher being slideable in forward and rearward directions on said sheet metal cover;

said sheet metal cover includes a lower cover portion with lower front flanges lying below portions of said support, and lower rear flanges each lying below a rear portion of said upper cover portion;

said lower rear flanges having main parts lying at a higher level than said lower front flanges and said lower rear flanges having rear ends forming tabs that extend at rearward-downward inclines.

8. An electrical connector for use with a smart card that is of generally rectangular shape but with an approximately 45° cutaway at a polarizing corner that lies at an intersection of imaginary extensions of a card front edge and a card slide edge, the card having an active face with a front portion having contact pads thereon, said connector including a housing that forms a card receiving cavity into which the card can be forwardly inserted to a fully inserted position until it hits a stop, with the housing including an insulative support with a support face forming a wall of said cavity and lying substantially against the front portion of the active face of a fully inserted card, said connector including a plurality of contacts mounted on said support for engaging said contact pads of a fully inserted card, said connector comprising:

an ejection mechanism for moving a forwardly fully inserted card rearwardly, including a lever that is pivotally mounted on said housing about a vertical axis, said axis lying rearward of said card front edge in said fully inserted position of said card;

said support face lies at a predetermined level and said support has a raised part that is raised above the level of said support face by at least one-fourth the thickness of the card, with said raised part forming an edge that substantially engages said card polarized corner when the card is fully installed;

said raised part has a top face lying below the top of an inserted card, and said lever lies on said top face of said raised part.

9. An electrical connector for use with a smart card that is of generally rectangular shape and that has an active face with a front portion having contact pads thereon, said connector including a housing that forms a card receiving cavity into which the card can be forwardly inserted to a fully inserted position until it hits a stop, with the housing including an insulative support with a support face forming a wall of said cavity and lying substantially against the front portion of the active face of a fully inserted card, said support having a lower face, said connector including a plurality of contacts mounted on said support for engaging said contact pads of a fully inserted card, wherein:

said housing includes a sheet metal cover with upper and lower cover portions lying respectively above and below portions of said support, and said cover has laterally opposite sides that connect said upper and lower cover portions;

said upper cover portion covers substantially the entire width and length of said cavity, and said lower cover portion includes a pair of flanges that lie rearward of said support and that extend toward each other and with a gap between them.

10. An electrical connector for use with a smart card that is of generally rectangular shape and that has an active face with a front portion having contact pads thereon and which has a front edge, said connector including a housing that forms a card receiving cavity into which the card can be forwardly inserted to a fully inserted position until it hits a stop, with the housing including an insulative support with a support face forming a wall of said cavity and lying substantially against the front portion of the active face of a fully inserted card, said support having a lower face, said connector including a plurality of contacts mounted on said support for engaging said contact pads of a fully inserted card, wherein:

said housing includes a sheet metal cover with upper and lower cover portions lying respectively above and below portions of said support; and including a card ejecting mechanism that includes a one-piece pusher that is slideably mounted on said cover, and a lever pivotally mounted on said support and having a first end in the path of said pusher and a second end that pushes said card front edge rearwardly when said first end is pushed forwardly;

said pusher being slideably mounted on said sheet metal cover to slide solely in forward and rearward directions, and said pusher having a rear end forming a tab that can be manually pushed.

11. An electrical connector for use with a smart card which is of generally rectangular shape and which has an active face with a front portion having contact pads thereon, said connector comprising a support of insulating material which has laterally opposite sides and front and rear ends, said support having a support upper face for lying substantially against the front portion of said card active face, said support face having opposite side portions, and said connector including a plurality of contacts with card-engaging ends lying in a primarily laterally extending row on said support and projecting above said support face, said connector including a sheet metal cover with cover upper and lower portions having front sections lying respectively above and below the level of said support face, wherein:

said upper cover portion has a rear end, and said support rear end has a rear edge, said contacts having tails lying at said rear edge, said rear edge lying forward of said upper cover portion rear end;

said upper cover has at least one slot, said at least one slot being aligned with each of said tails.

* * * * *